US006540321B1

(12) United States Patent
Hirano et al.

(10) Patent No.: US 6,540,321 B1
(45) Date of Patent: Apr. 1, 2003

(54) INK TANK, INK-JET CARTRIDGE, INK-SUPPLYING APPARATUS, INK-JET PRINTING APPARATUS AND METHOD FOR SUPPLYING INK

(75) Inventors: Hirofumi Hirano, Zama (JP); Yohji Ara, Yokohama (JP); Hiroyuki Inoue, Yokohama (JP); Hideo Fukazawa, Chigasaki (JP); Tetsuji Kurata, Yokohama (JP); Hiroshi Netsu, Yokohama (JP); Hideaki Okamoto, Yokohama (JP); Masaya Uetsuki, Yokohama (JP); Hiroki Hayashi, Kawasaki (JP); Noriyasu Asaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 09/580,410

(22) Filed: May 30, 2000

(30) Foreign Application Priority Data

| | | |
|---|---|---|
| May 31, 1999 | (JP) | 11-153060 |
| May 31, 1999 | (JP) | 11-153062 |
| May 31, 1999 | (JP) | 11-153063 |
| May 31, 1999 | (JP) | 11-153064 |
| Apr. 18, 2000 | (JP) | 2000-117063 |

(51) Int. Cl.[7] ..... B41J 2/165
(52) U.S. Cl. ..... 347/22; 347/86
(58) Field of Search ..... 347/22, 29–33, 347/35, 7, 84–86

(56) References Cited

U.S. PATENT DOCUMENTS

| | | | | |
|---|---|---|---|---|
| 4,967,207 A | | 10/1990 | Ruder | 347/7 |
| 4,968,998 A | | 11/1990 | Allen | 347/7 |
| 5,126,767 A | | 6/1992 | Asai | 347/86 |
| 5,481,289 A | * | 1/1996 | Arashima et al. | 347/93 |
| 5,534,899 A | * | 7/1996 | Uchikata et al. | 347/49 |
| 5,663,754 A | * | 9/1997 | Lorenze, Jr. et al. | 347/87 |
| 5,709,253 A | | 1/1998 | Maerzke | 141/18 |
| 5,812,168 A | | 9/1998 | Pawlowski, Jr. et al. | 347/92 |
| 6,022,102 A | * | 2/2000 | Ikkatai et al. | 347/85 |
| 6,325,498 B1 | * | 12/2001 | Higuma et al. | 347/86 |

FOREIGN PATENT DOCUMENTS

| | | | | |
|---|---|---|---|---|
| EP | 803362 | | 10/1997 | |
| EP | 803364 | | 10/1997 | |
| EP | 854046 | | 7/1998 | |
| JP | 59-207256 | | 11/1984 | |
| JP | 60-32671 | | 2/1985 | |
| JP | 60-220755 | | 11/1985 | |
| JP | 61-24458 | | 2/1986 | |
| JP | 2-70443 | | 3/1990 | |
| JP | 3-73355 | | 3/1991 | |
| JP | 4-187448 | | 7/1992 | |
| JP | 405162329 A | * | 6/1993 | 347/86 |
| JP | 7-101073 | | 4/1995 | |
| JP | 8-187874 | | 7/1996 | |
| JP | 8-207308 | | 8/1996 | |
| JP | 8-290577 | | 11/1996 | |
| JP | 10-128999 | | 5/1998 | |
| JP | 10-250105 | | 9/1998 | |
| JP | 11-58763 | | 3/1999 | |
| WO | WO 97/42035 | | 11/1997 | |
| WO | WO 98/40217 | | 9/1998 | |

* cited by examiner

*Primary Examiner*—Shih-Wen Hsieh
(74) *Attorney, Agent, or Firm*—Fitzpatrick, Cella, Harper & Scinto

(57) ABSTRACT

For the sake of achieving both the size and weight reductions of a printing apparatus and increasing the reliability thereof, an ink tank is provided with a gas-permeable member that permits air to pass without permitting ink. The ink tank is capable of introducing ink through an ink inlet by negative pressure introduced in the ink tank through a common suction port.

49 Claims, 62 Drawing Sheets

INK TANK, INK-JET CARTRIDGE, INK-SUPPLYING APPARATUS, INK-JET PRINTING APPARATUS AND METHOD FOR SUPPLYING INK

This application is based on Japanese Patent Application Nos. 11-153060 (1999) filed May 31, 1999, 11-153062 (1999) filed May 31, 1999, 11-153063 (1999) filed May 31, 1999, 11-153064 (1999) filed May 31, 1999, and 2000-117063 filed Apr. 18, 2000, the contents of which are incorporated hereinto by reference.

BACKGROUND OF THE INVENTION

1. Field of the Invention

The present invention relates to an ink tank, an ink-jet cartridge, an ink-supplying apparatus, an ink-jet printing apparatus, a method for supplying ink, an ink-jet printing head and a printing apparatus.

2. Description of the Related Art (First Prior Art)

Heretofore, a serial-scanning type printing apparatus has been known as an example of the ink-jet printing apparatus. This kind of the printing apparatus exchangeably carries a printing head as a printing means and an ink tank as an ink container on the carriage which is capable of movement in the direction of main-scanning perpendicular to the direction of sub-scanning (i.e., the direction of moving a printing medium such as a piece of paper). As for this kind of the printing system, images are sequentially printed on a printing medium by repeating the movement of the carriage on which the printing head and the ink tank are mounted in the direction of main-scanning and the movement of the printing medium in the direction of sub-scanning.

The serial-scanning type printing apparatus is able to print an image on a large sized printing medium (e.g., A1, A0 size) by enlarging the migration width of the carriage. In this case, however, the ink storage capacity of the ink tank should be increased for using a great volume of ink to print an image on the surface of a large-sized printing, so that the whole weight of the carriage is increased in proportion to the capacity of the ink. In addition, an inertial force in the movement of the carriage is also proportionally increased. For moving the carriage at a high speed against the inertial force, there is the need for installing a driving motor with a large amount of electric power for driving the carriage in high power, resulting in the problem of increasing the price of the printing apparatus in its entirety. In addition, as the total weight of the carriage is increased, there is another problem that the printing apparatus oscillates greatly as a whole by the counterforce contrary to the force for deaccelerating the carriage to zero against the inertial force when the carriage returns at a returning point of its reciprocating motion in the main-scanning direction. Therefore it was difficult for speeding up the travel speed of the carriage.

For reducing the weight of the carriage, on the other hand, the capacity of the ink tank may be lessened. In this case, however, the frequency of replacing the ink tank rises and thus there is a high possibility of replacing the ink tank with the new one in the middle of the printing movement.

One of the solutions to solve the problem about such a replacement of the ink tank is proposed in Japanese Patent Application Laying-open 9-24698 (1997). In this prior art document, a deformable ink container is connected to a printing head. The deformable ink container can be connected to an auxiliary ink container as necessary for supplying ink from the latter to the former. The deformable ink container comprises a bag that stores ink under the negative pressure enough to restrain the leakage of ink from the ink-eject port. Therefore, ink can be supplied from the auxiliary ink container to the deformable ink container by an effect of such a negative pressure.

The bag used in the deformable ink container is a flexible one enough to reduce its capacity in proportion to become flat, depending on the volume of ink ejected from the printing head (i.e., the usage of ink in the bag). When the volume of the bag is decreased to less than the fixed volume, a supply opening of the deformable ink container is opened to establish connection with the auxiliary ink container. As a result, ink is supplied into the bag of the deformable ink container from the auxiliary ink container by the negative pressure of the inside of the bag. When the ink capacity of the bag reaches to a maximum level, the negative pressure in the bag becomes zero and the supply of the ink is automatically stopped. According to such a prior art, therefore, the supply of ink can be automatically stopped by using the negative pressure without requiring the control using a pressure sensor, a volume detection sensor, and so on.

By the way, the upper limit of the negative pressure in the deformable ink container can be determined by its balance with the force of ejecting ink from the printing head. If the negative pressure becomes too high, the force of ejecting ink from the printing head is decreased by an effect of the negative pressure. Therefore, the negative pressure must be decided within the scope of the best ink-eject conditions in the printing head. In addition, a head location of ink in the auxiliary ink container must be configured so that it is lower than that of ink in the deformable ink container. If the deference between those heads is too large, ink cannot be supplied any more even if the negative pressure in the deformable ink container is defined so as to correspond to the conditions of ink-eject of the printing head.

As for the prior art, therefore, it is provided with the special device to configure a position of the auxiliary ink container in the vertical direction with respect to the deformable ink container. As for being provided with such a device, however, the problems of upsizing and cost up of the printing apparatus may be caused. If air enters into an ink flow path that connects between the auxiliary ink container and the deformable ink container from a part of the path at the time of ink supply, the entering air moves into the bag of the deformable ink container and then reduces the ink capacity of the deformable ink container by a large amount. Furthermore, the deformable ink container is filled with air if a large amount of the air is entered into the bag, so that there is a problem that a further supply of ink cannot be made. Still furthermore, the deformable ink container comprises an elastic container part that forms a bag and a movable part such as a spring that inflate the bag to a predetermined volume. Thus, there are further problems of the limitation of downsizing, complicated and heavy-weighted structure, and the rise in production cost.

(Second Prior Art)

Heretofore, a serial-scanning type printing apparatus has been known as an example of the ink-jet printing apparatus. This kind of the printing apparatus exchangeably carries a printing head as a printing means and an ink tank as an ink container on the carriage which is capable of movement in the direction of main-scanning perpendicular to the direction of sub-scanning (i.e., the direction of moving a printing medium such as a piece of paper). The printing head and the ink tank are connected each other by an ink path. As for this kind of the printing system, images are sequentially printed on a printing medium by repeating the movement of the carriage on which the printing head and the ink tank are mounted in the direction of main-scanning and the movement of the printing medium in the direction of sub-scanning.

On the other hand, a method for supplying ink to the ink tank of the ink-jet printing apparatus may be of the supply of ink through the application of pressure to the ink or the sucking of ink through the induction of negative pressure in the ink tank.

By the way, if the method for sucking of the ink into the ink tank is used as a method for supplying ink to the ink tank being connected to the printing head, there is the possibility of sucking ink in the printing head into the ink tank by an effect of the negative pressure to be introduced into the ink tank at the time of supplying ink under suction. If the ink in the printing head is introduced into the ink tank, a meniscus of ink to be formed on each of ink eject ports of the printing head is broken down and air enters into the printing head through the ink eject port. As a result, the supply of ink under suction cannot be performed as the negative pressure in the ink tank is reduced.

(Third Prior Art)

Heretofore, a printing apparatus that performs the printing using a printing material such as ink have been widely available. In recent years, in particular, a serial-scan type ink-jet printing apparatus is rapidly becoming in widespread use. Such an ink-jet printing apparatus comprises a carriage on which a printing head and an ink tank are mounted. The printing head ejects ink onto a printing medium to print an image thereon while the carriage moves directly above the printing medium in the main-scanning direction.

According to the configuration of such a printing apparatus, an empty ink tank must be replaced with the new one to continue its printing movement when the ink stored in the ink tank is exhausted. If the printing movement is continued long or performed on a larger-sized printing medium, a larger amount of ink may be consumed. In this case, therefore, the ink tank must be exchanged frequently, so that the printing movement in progress is suspended every time the ink tank is replaced with the new one. Such a replacement work is very troublesome.

As a consequence, there is another printing apparatus having a supplementary ink tank for automatically refilling ink when the ink tank mounted on the carriage becomes empty. The supplementary ink tank is connected to the ink tank on the carriage through a tube or the like. Ink can be supplemented from the supplementary ink tank to the ink tank on the carriage when the amount of ink stored in the ink tank decreases to a predetermined level. Therefore, the user may only replace the supplementary ink tank with the new one.

The conventional supplementary ink tank generally comprises an ink bag for storing ink and a case for encasing the ink bag.

The ink bag may be formed as the joining of two thin films by welding their opposite sides together or by any of other conventional techniques. Each of the thin films is generally in the shape of a rectangular, and also a part of one joining side of the rectangular is shaped like a cylinder as a protrusion being connected to a cylindrically shaped withdrawal member made of plastic or the like. Thus, the ink bag can be fixed in the inside of the case by putting the withdrawal member into an ink output opening of the case.

A main body of the printing apparatus has a hollow tube that has an external diameter enough to be inserted into the withdrawal member. If the supplementary ink tank is inserted into the predetermined position in the printing apparatus, the hollow tube fits into the withdrawal member of the ink bag and then the connection between the supplementary ink tank and the hollow tube is accomplished. Consequently, the ink tank on the carriage is able to receive ink passing through the hollow tube.

Alternatively, the supplementary ink tank may be prepared by welding thin films so that the ink bag itself has a cylindrical protrusion without installing any withdrawal means on the ink bag. In this case, the insertion of a needle-like tip of the tube into the protrusion of the ink bag allows the connection between the protrusion and the hollow tube for forming an ink passage.

However, the above conventional supplementary ink tank has the following programs.

That is, if a part of the ink bag is formed as a protrusion, the process of shaping the ink bag is complicated and the cost of production is increased.

Furthermore, if the ink passage between the withdrawal member and the hollow tube is not securely formed, leakage of ink might occur from the loosely connected portion. For automatically connecting them to make an ink passage at the time of mounting the supplementary ink tank, the supplementary ink tank must be precisely connected to the hollow tube so that a center of the withdrawal member coincides with an extension line of a center of the hollow tube. In this case, however, it is difficult to keep such an ink-passage connection consistently because there is a possibility that the hollow tube is curved by putting in and out the supplementary ink tank over and over again.

SUMMARY OF THE INVENTION

It is a first object of the present invention is to provide an ink tank, an ink-jet cartridge, an ink-supplying apparatus, an ink-jet printing apparatus, and a method for supplying ink, where ink can be reliably supplied to the ink tank by a simplified configuration of an ink passage to achieve both the size and weight reductions of the printing apparatus and to increase the reliability thereof.

It is a second object of the present invention is to provide an ink tank, an ink-jet cartridge, an ink-supplying apparatus, an ink-jet printing apparatus, and a method for supplying ink, where ink can be smoothly supplied during an extended period of time.

It is a third object of the present invention is to provide an ink-jet printing apparatus, an ink-supplying apparatus, and a method for supplying ink, where ink can be reliably supplied to the ink tank by a simplified configuration of an ink passage to achieve both the size and weight reductions of the printing apparatus and to increase the reliability thereof.

It is a fourth object of the present invention is to provide an ink tank, an ink-jet printing head, an inkjet cartridge, and an ink-jet printing apparatus, where ink can be reliably supplied to the ink tank by preventing the entry of ink or air from the ink-jet printing head connected to the ink tank when ink is supplied to the ink tank under suction caused by the induction of negative pressure in the ink tank.

It is a fifth object of the present invention is to provide an ink tank and a printing apparatus, where the ink tank has a main body that can be easily shaped like a bag and connected to an ink passage at the time of mounting the ink tank on the printing apparatus.

In the first aspect of the present invention, there is provided an ink tank capable of introducing ink into the ink tank through an inlet by a negative pressure introduced into the ink tank through a suction port, comprising:

gas-liquid separating means which is provided at the suction port and which permits gas to pass but inhibits ink from passing.

In the first aspect of the present invention, there is provided an ink tank capable of introducing ink into the ink tank through an inlet by a negative pressure introduced into the ink tank through a suction port, comprising gas-liquid separating means which is provided at the suction port and which permits gas to pass but inhibits ink from passing.

In the second aspect of the present invention, there is provided an ink-jet cartridge comprising an ink tank according to the first aspect, and an ink-jet printing head which is able to eject ink introduced from the ink tank.

In the third aspect of the present invention, there is provided an ink-supplying device for supplying ink to an ink tank according to the first aspect or an ink tank of an ink-jet cartridge according to the second aspect, comprising ink-supplying means for supplying ink stored in a main ink tank into the ink tank through the inlet, and negative-pressure loading means for loading negative pressure caused by a suction pump into the ink tank through the suction port.

In the fourth aspect of the present invention, there is provided an ink-supplying device for supplying ink to an ink tank according to the first aspect or an ink tank of an ink-jet cartridge according to the second aspect, comprising ink-supplying means for supplying ink stored in a main ink tank into the ink tank through the inlet, negative-pressure loading means for loading negative pressure caused by a suction pump into the ink tank through the suction port, and capping means capable of capping an ink eject port of the printing head by a cap member.

In the fifth aspect of the present invention, there is provided an ink-jet printing apparatus, comprising a mounting portion on which an ink tank according to the first aspect and an ink-jet printing head are mountable, where the ink-jet printing is able to eject ink supplied from the ink tank, and transfer means which performs the relative movements of the ink-jet printing head and a printing medium.

In the sixth aspect of the present invention, there is provided an ink-jet printing apparatus, comprising a mounting portion on which an ink-jet cartridge according to the second aspect is mountable, and transfer means for relatively moving the ink-jet cartridge and a printing medium.

In the seventh aspect of the present invention, there is provided a method for supplying ink to an ink tank according to the first aspect and an ink tank of an ink cartridge according to the second aspect, comprising the steps of supplying ink into the ink tank from the inlet by loading negative pressure into the ink tank from the suction port through the gas-liquid separating means, and stopping the load of negative pressure into the ink tank from the suction port.

In the eighth aspect of the present invention, there is provided an ink-jet printing apparatus, comprising a mounting portion on which an ink tank according to the first aspect and an ink-jet printing head are mountable, where the ink-jet printing is able to eject ink supplied from the ink tank, transfer means which performs the relative movements of the ink-jet printing head and a printing medium, and means for forming ink meniscus on the ink eject port by the recovery process which discharges ink from the ink eject port of the ink-jet printing head under suction before supplying of ink to the ink tank.

In the ninth aspect of the present invention, there is provided an ink-jet printing apparatus for printing an image on a printing medium employing an ink-jet printing head capable of ejecting ink supplied from an ink tank, comprising negative-pressure loading means which is able to introduce negative pressure into the ink tank, ink-supplying means for supplying ink into the ink tank using the negative pressure in the ink tank, gas-liquid separating means which lies in a negative-pressure loading passage between the ink tank and the negative-pressure loading means and which permits gas to pass but inhibits ink from passing, and disrupting means capable of disrupting a midcourse portion of the negative-pressure loading passage between the ink tank and the gas-liquid separating means.

In the tenth aspect of the present invention, there is provided an ink-supplying device, comprising negative-pressure loading means which is able to introduce negative pressure into an ink tank, ink-supplying means for supplying ink into the ink tank using the negative pressure in the ink tank, gas-liquid separating means which lies in a negative-pressure loading passage between the ink tank and the negative-pressure loading means and which permits gas to pass but inhibits ink from passing, and disrupting means capable of disrupting a midcourse portion of the negative-pressure loading passage between the ink tank and the gas-liquid separating means.

In the eleventh aspect of the present invention, there is provided a method for supplying ink to an ink tank, comprising gas-liquid separating means which lies in a negative-pressure loading passage between the ink tank and the negative-pressure loading means and which permits gas to pass but inhibits ink from passing, and disrupting means for disrupting a midcourse portion of the negative-pressure loading passage between the ink tank and the gas-liquid separating means, the method comprising the steps of loading negative pressure into the ink tank through the negative-pressure loading passage, supplying ink into the ink tank using negative pressure in the ink tank, stopping the loading of negative pressure into the ink tank by the gas-liquid separating means when ink touches the gas-liquid separating means, and disrupting the midcourse portion by the disrupting means except when ink is supplied into the ink tank.

In the twelfth aspect of the present invention, there is provided an ink tank which has an ink-supplying port for supplying ink into an ink-jet printing head, and which is capable of introducing ink into the ink tank by negative pressure introduced into the ink tank, comprising a valve provided at the ink-supplying port, which closes the ink-supplying port by negative pressure higher than a predetermined level in the ink tank.

In the thirteenth aspect of the present invention, there is provided an ink-jet printing head capable of ejecting ink supplied from an ink tank through an ink supplying port, comprising a valve provided at a connecting port connected to the ink-supplying port, which closes the ink-supplying port by negative pressure higher than a predetermined level in the ink tank.

In the fourteenth aspect of the present invention, there is provided an ink-jet cartridge comprising an ink tank according to the twelfth aspect, and an ink-jet printing head capable of ejecting ink supplied from an ink tank through an ink-supplying port.

In the fifteenth aspect of the present invention, there is provided an ink-jet cartridge comprising an inkjet printing head according to the thirteenth aspect, and an ink tank capable of supplying ink into the inkjet printing head through the connecting port.

In the sixteenth aspect of the present invention, there is provided an ink-jet printing apparatus comprising a tank mounting portion on which an ink tank according to the twelfth aspect is mountable, a head mounting portion on which an ink-jet printing head capable of ejecting ink supplied from the ink tank is mountable, and moving means for relatively moving the ink-jet printing head and a printing medium.

In the seventeenth aspect of the present invention, there is provided an ink-jet printing apparatus comprising a head mounting portion on which an ink-jet printing head according to the thirteenth aspect is mountable, a tank mounting portion on which an ink tank capable of supplying ink to the ink-jet printing head is mountable, and moving means for relatively moving the ink-jet printing head and a printing medium.

In the eighteenth aspect of the present invention, there is provided an ink tank having a bag-like tank body which is made of a sheet of a thin film that is folded down in one side to form a folding part, and which is capable of storing ink, wherein the folding part forms a connecting portion capable of connecting between the inside and the outside of the tank body by means of a hollow conduit that is able to penetrate the folding part.

In the nineteenth aspect of the present invention, there is provided a printing apparatus capable of printing of an image using ink in the tank body, comprising a tank mounting portion on which an ink tank according to the eighteenth aspect is mountable, wherein a hollow conduit that is able to penetrate the connecting portion of the tank body and is provided at the tank mounting portion.

The present invention is configured such that the supply of ink under suction can be automatically stopped using the function of a gas-permeable member, so that the supply of ink to the ink tank can be performed by a simple structure with reliability. This offers an advantage of being able to achieve both the size and weight reductions of the printing apparatus and an improved reliability thereof.

The present invention is also configured such that the formation of ink meniscus on an ink eject port of the printing head is performed by draining the ink from the printing head being connected to the ink tank under suction, before the supply of ink to the ink tank under suction is performed. This offers an advantage of being able to achieve the supply of ink to the ink tank under suction with reliability.

The present invention is configured such that a porous material with an oil repellent finish is used as the gas-permeable member to be functioned as a gas-liquid separate means. The gas-permeable member repels ink enough. This offers an advantage of being able to achieve the supply of ink smoothly over an extended period of time with reliability in addition to improve the durability of the gas-permeable member.

The present invention is configured such that the gas-liquid separate means is not connected to the inside of the ink tank except when the supply of ink is performed. This offers an advantage of being able to prevent that the performance of the gas-liquid separate means is decreased by exposing the gas-liquid separate means to ink for a long time.

The present invention is configured such that a valve is provided in an ink-supplying path between the ink tank and the ink-jet printing head and closed when the inside of the ink tank becomes a predetermined level of negative pressure. This offers an advantage of being able to achieve the supply of ink under suction with reliability by preventing the entry of ink or air from the ink-jet printing head to be connected to the ink tank.

The present invention is configured that the main body of the ink tank is shaped like a bag which is good enough for communicating the inside of a main body of the ink tank with the outside through a hollow tube by passing the hollow tube through a curved portion of a thin film that forms the bag-shaped main body of the ink tank. This offers an advantage of being able to achieve the cost reduction of manufacturing the ink tank as the bag-shaped main body of the ink tank is formed with ease.

The above and other objects, effects, features and advantages of the present invention will become more apparent from the following description of embodiments thereof taken in conjunction with the accompanying drawings.

BRIEF DESCRIPTION OF THE DRAWINGS

FIG. 57A is a perspective view that illustrates the filter and the valve which are separated from each other, while

FIG. 58A is a cross sectional view of another combination of the valve and the filter shown in FIG. 51, while

DETAILED DESCRIPTION OF THE PREFERRED EMBODIMENTS

Embodiments of the present invention will be described below by referring to the accompanying drawings.

First Embodiment

Figure 1:
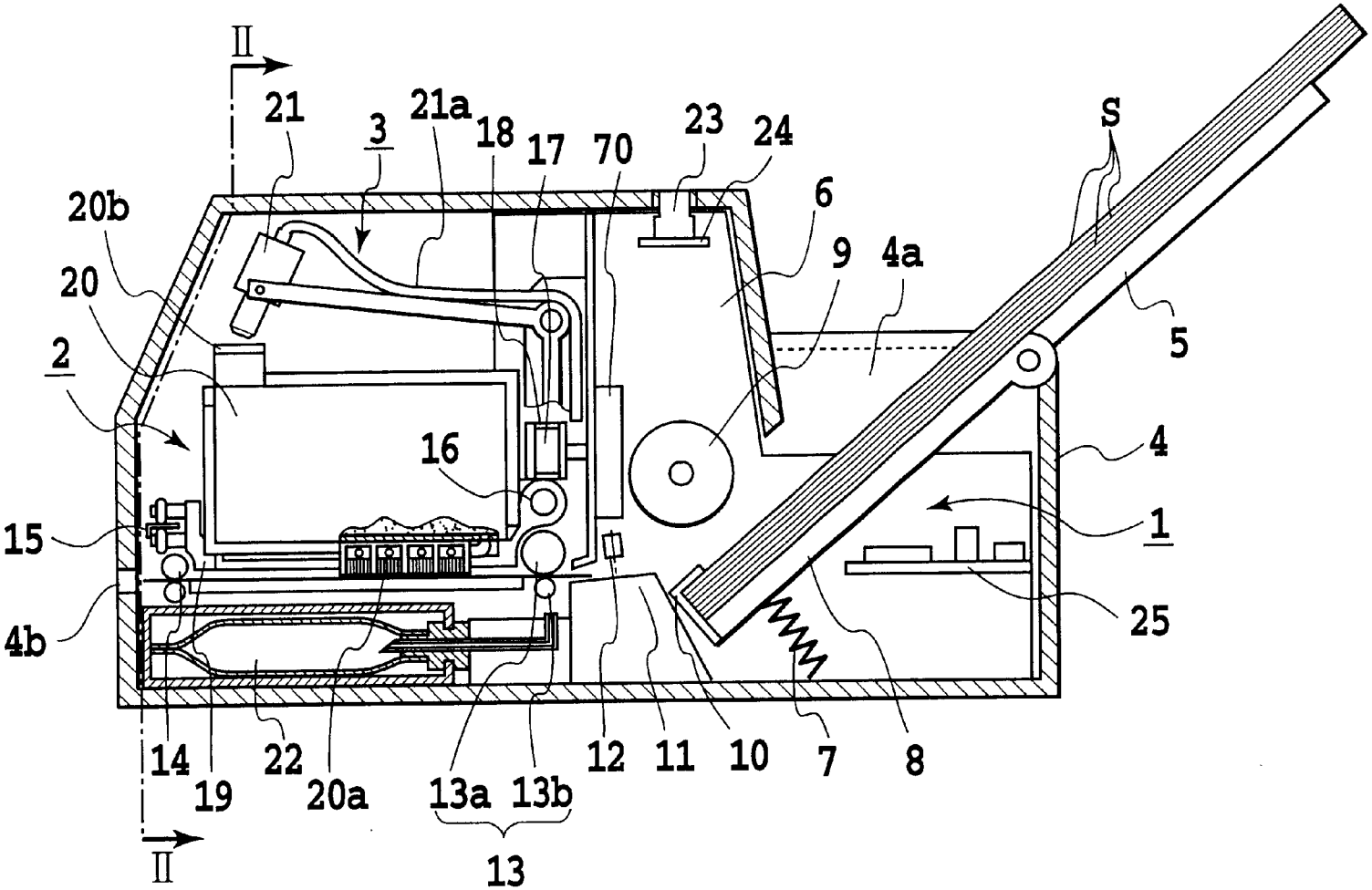
FIG. 1 is a cross sectional view of the printing apparatus in accordance with the first embodiment of the present invention.
Figure 2:
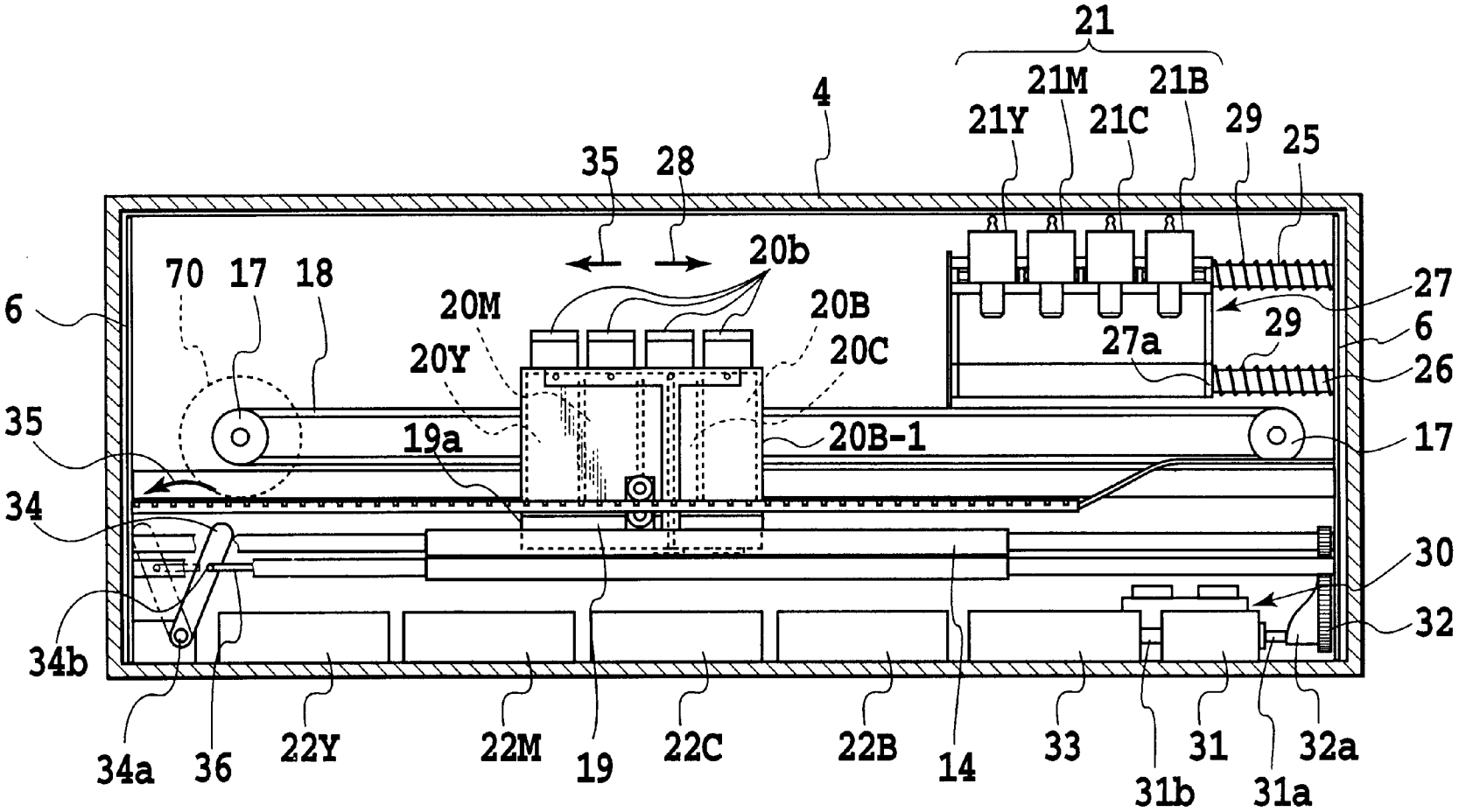
FIG. 2 is a cross sectional view along the line II—II in FIG. 1.

FIG. 1 and FIG. 2 illustrate the overall configuration of an ink-jet printing apparatus in accordance with a first preferred embodiment of the present invention. In this embodiment, the ink-jet printing apparatus applies to a serial-scanning system in which a printing head moves in the direction of main-scanning (i.e., the main-scanning direction).

Figure 6:
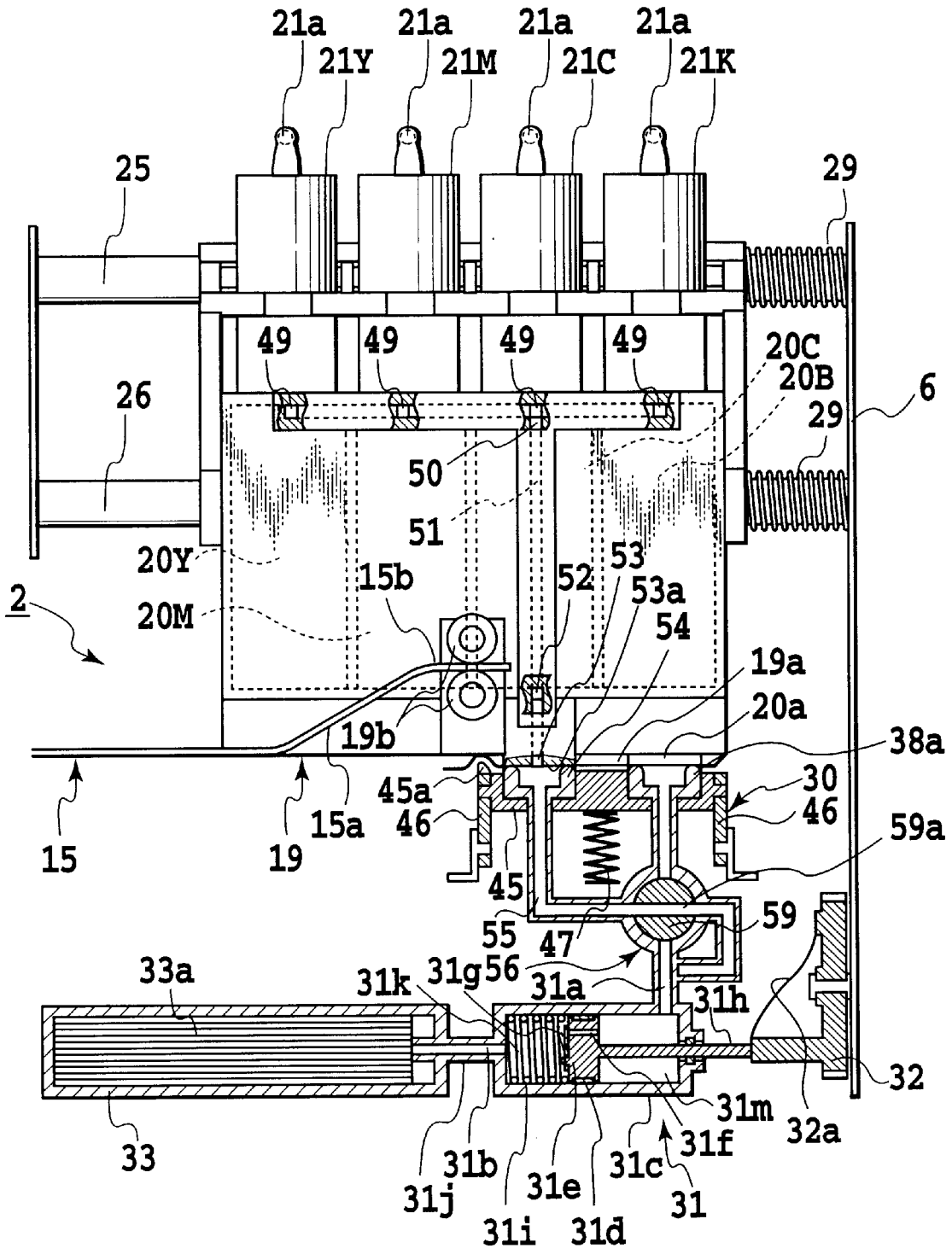
FIG. 6 is a cross sectional view of the air suction system during periods of supplying ink to the reserve ink tank shown in FIG. 3.

In FIG. 1, a main body of the printing apparatus comprises a transport device portion 1 for feeding a printing medium S such as a sheet of paper, a printing device portion 2 for performing a printing movement, an ink-supplying device portion 3 for supplying ink to the printing device portion 2, and a capping device portion 30 (see FIG. 6). These device portions 1, 2, and 3 will be individually described as follows.

A. [Configuration of the Transport Device Portion 1]

In the transport device portion 1, the reference numeral 4 denotes a cover. The cover 4 is provided on an external side of a main body of the printing apparatus. The reference numeral 5 denotes a platform on which a plurality of printing media S is placed. The cover 4 has an insertion opening 4*a* and an ejection opening 4*b*, so that the printing medium S is inserted into the insertion opening 4*a* and ejected from the ejection opening 4*b*. In the inside of side walls provided in the cover 4, a mounting base 8, a feed roller 9, and a guide member 11 are provided. The mounting base 8 is provided as a means for holding the printing media S. The mounting base 8 moves upward and pressed against the feed roller 9 by an extending force of a spring 7. The feed roller 9 is a part of feeding means and comes into contact with the topmost printing medium S on the mounting base 8. The guide member 10 leads a sheet of the printing medium S separated from a batch of the printing medium S by separating means 10 toward the printing portion device 2.

B. [Configuration of the Printing Device Portion 2]

In the printing device portion 2, the reference numeral 12 denotes a photo-sensor for detecting the printing medium S passing through the downstream side of the guide member 11. The reference numeral 13 denotes a pair of transport rollers that transports the printing medium S at a constant speed, which is fed from the transport device portion 1. The reference numeral 14 denotes a pair of carrying out rollers that carries out the printing medium S on which an image is printed. The reference numeral 19 denotes a carriage which is movably supported by guide members 15, 16, so that these guide members 15, 16 are able to guide the movement of the carriage 19 in the main scanning direction indicated by the arrows 28, 35 in FIG. 2. The main scanning direction corresponds to the direction along a width of the printing medium S. Therefore, the carriage 19 is able to shift its position along the guide members 15, 16 in the main scanning direction by means of a driving force of a carriage motor 70 transmitted through a belt 18 that runs between pulleys 17, 17. The reference numeral 20 denotes a replaceable reserve ink tank to be mounted on the carriage 19, while 20*a* denotes a printing head as a means for forming an image on the printing medium S. Depending on image information, the printing head 20*a* ejects ink supplied from the reserve ink tank 20. In the present embodiment, the reserve ink tank 20 and the printing head 20*a* are combined together to form an ink-jet cartridge. Alternatively, these components 20, 20*a* may be individually provided so that they can be detachably connected to each other and individually mounted on the carriage 19. As shown in FIG. 2, the reserve ink tank 20 of the present embodiment is divided into four ink tanks for reserving respective colors of ink, i.e., an ink tank 20Y for yellow colored ink, an ink tank 20M for a magenta colored ink, an ink tank 20C for cyan colored ink, and an ink tank 20B for black colored ink. Each of these ink tanks 20Y, 20M, 20C, and 20B has an ink inlet 20*b* for the admission of ink. The ink inlet 20B is formed as a valve member made of a flexible material such as a rubber.

Figure 4:
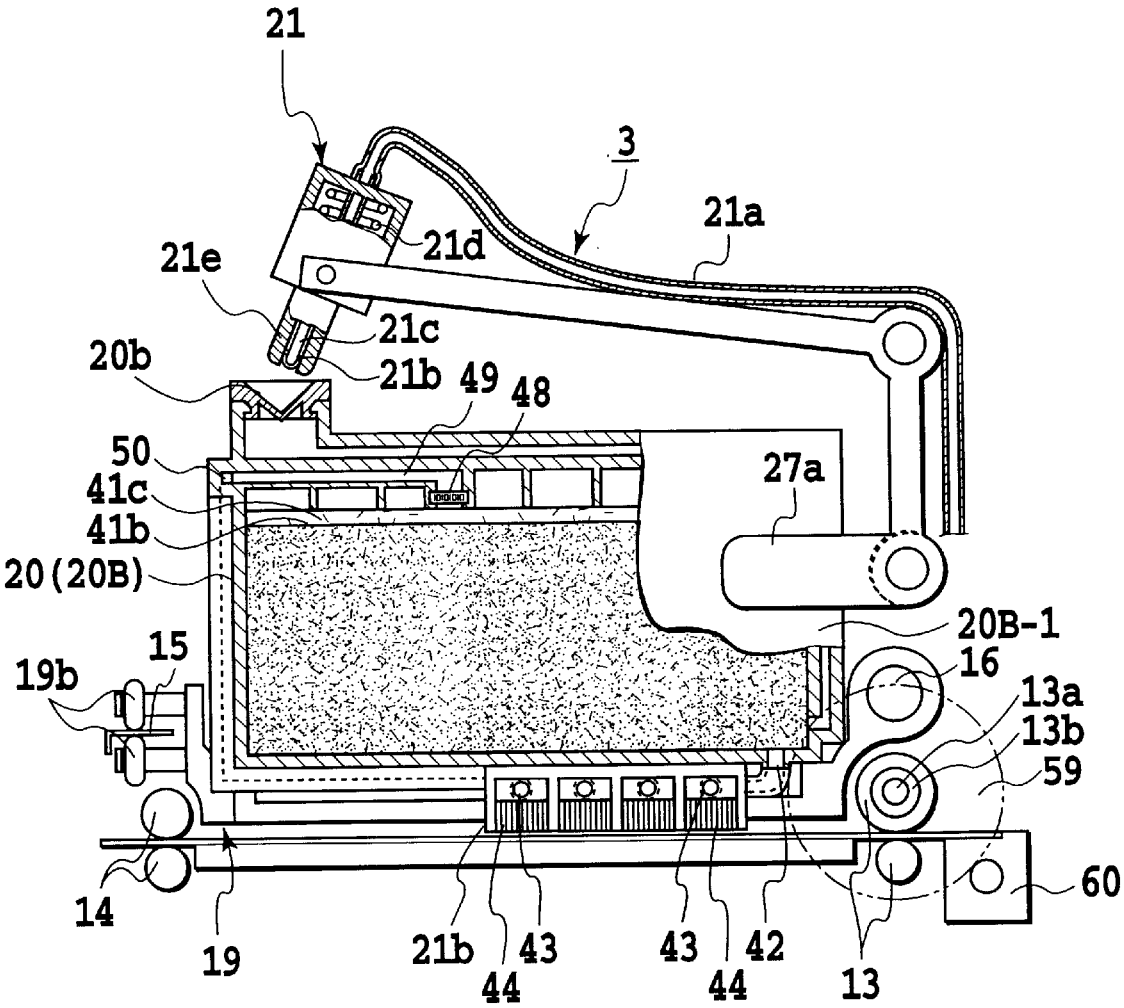
FIG. 4 is a cross sectional view of the reserve ink tank shown in FIG. 3.
Figure 7:
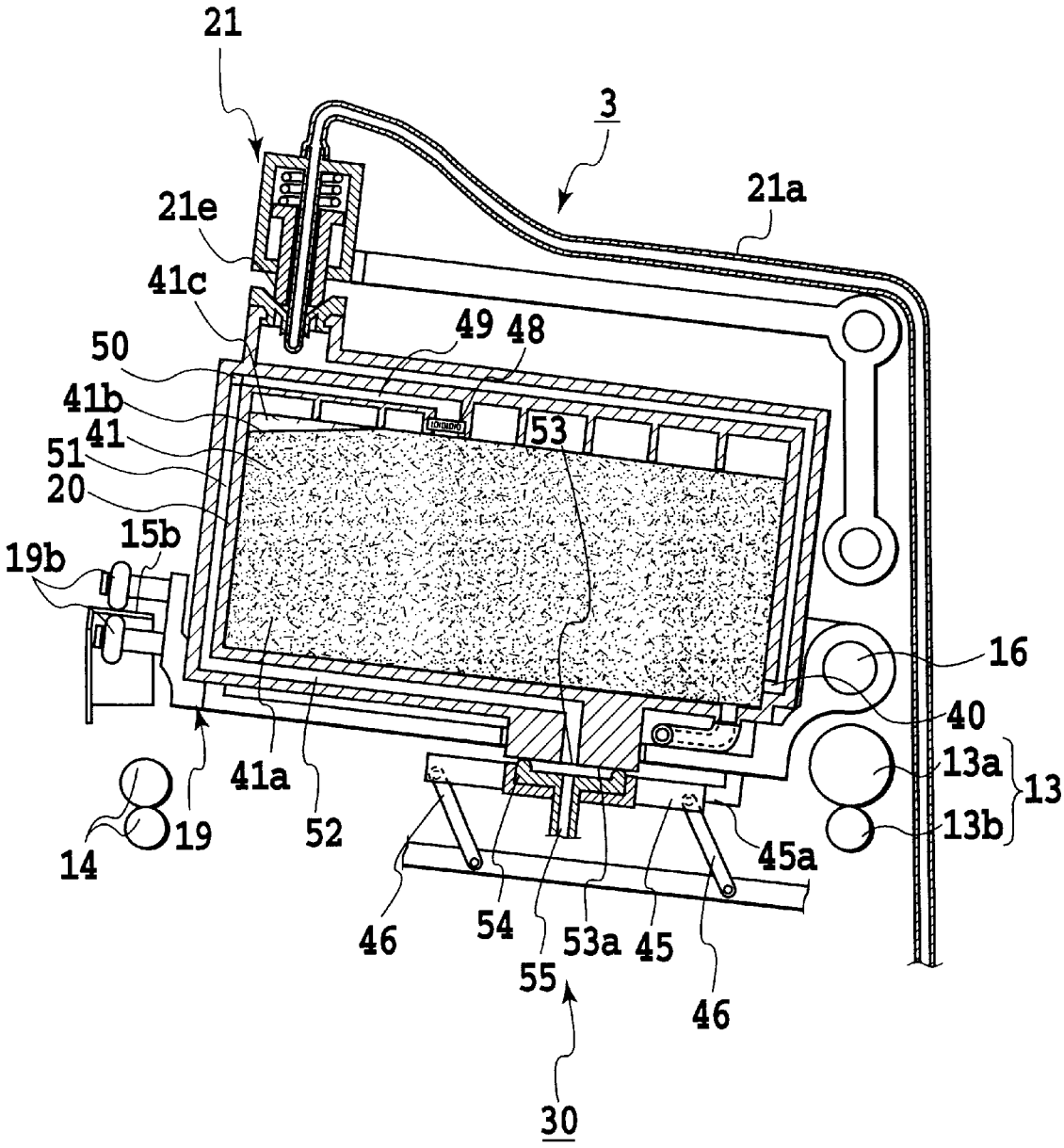
FIG. 7 is a cross sectional view of the reserve ink tank shown in FIG. 3 during periods of supplying ink to the reserve ink tank.

The reference numeral 48 in FIG. 4 denotes a gas-permeable member provided in a suction opening of each of the ink tanks 20Y, 2M, 20C, and 20B. The gas-permeable member 48 is provided as a means of separating air and liquid, which permeates gas but not ink. The gas-permeable member 48 may be of a thin-sheet type and made of a tetrafluoride ethylene resin or other porous resin materials. As shown in FIG. 6 and FIG. 7, each of passages for exhausting air in the ink tanks 20Y, 20M, 20C, and 20B communicates with the gas-permeable member 48 and an air ventilating path 49 and then communicates with a general suction hole 53 through common air ventilating paths 50, 51, and 52. Air in the ink tanks 20Y, 20M, 20C, and 20B can be sucked out of a cap member 54 closely adjacent to a surface 53*a* on which the general suction hole 53 is formed. As described later, the suction of air can be performed by a suction pump 31 through a ventilation tube 57.

The printing head 20*a* consists of a plurality of head parts. These parts are independent one another in every ink and comprises a plurality of ink eject nozzles 44 and their own liquid chambers 43 communicating with channels 41 of the respective ink tanks 20Y, 20M, 20C, and 20B. Each of the nozzles 44 forms a communicating passage that communicates with an ink eject port. In addition, each of the nozzles 44 has a means for generating an energy to be used for ejecting ink from the ink eject port.

C. [Configuration of the Ink-supplying Device Portion 3]

In the ink-supplying device portion 3, the reference numeral 21 denotes a means for supplying ink, which communicates with a supplementary ink tank 22 through the tube 21*a*. This ink-supplying means 21 replenishes ink of the supplementary ink tank 22 into the reserve ink tank 20 by tightly connecting to the ink inlet 20*b* of the reserve ink tank 20.

The supplementary ink tank 22 of this embodiment is divided into four ink tanks for reserving respective colors of ink, i.e., an ink tank 22Y for yellow colored ink, an ink tank 22M for a magenta colored ink, an ink tank 22C for cyan colored ink, and an ink tank 22B for black colored ink. Each ink tank 22Y, 22M, 22C, and 22B are connected to their respective ink-supplying means 21Y, 21M, 21C, 21B which cope with every color of ink through the associated inner tube 21*a*.

As shown in FIG. 2, furthermore, the ink-supplying means 21 is mounted on a migration board 27. The migration board 27 is guided by a guide member 25, 26 so as to be able to move in the left-right direction of FIG. 2. If the carriage 19 moves in the direction of the arrow 28, and the side surface 20B-1 of the reserve ink tank 20B runs into an arm portion of the migration board 27, the migration board 27 moves together with the carriage 19 in the direction of the arrow 28 against the force of a spring 29.

Figure 3:
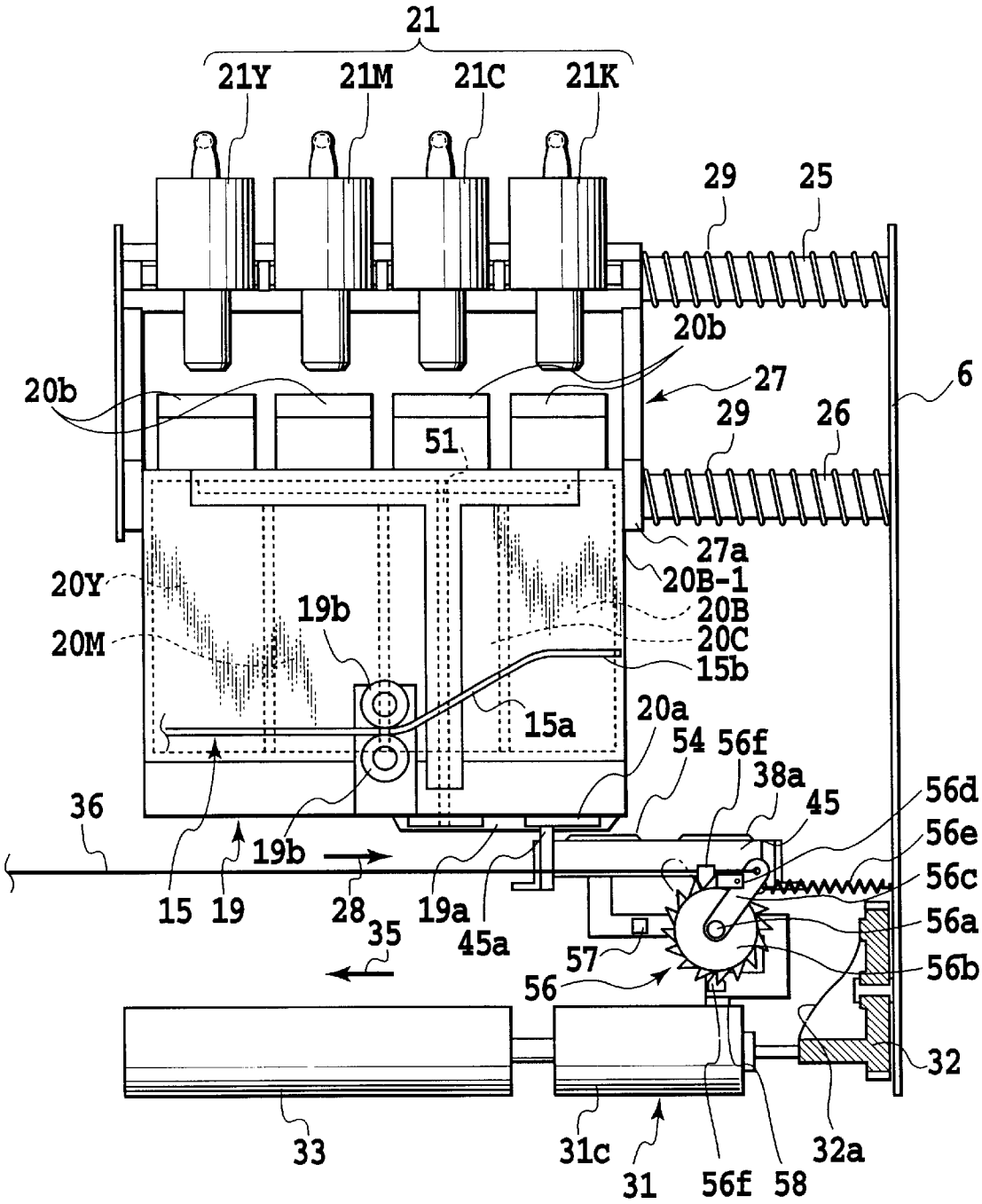
FIG. 3 is an enlarged front view of the reserve ink tank portion shown in FIG. 2.
Figure 5:
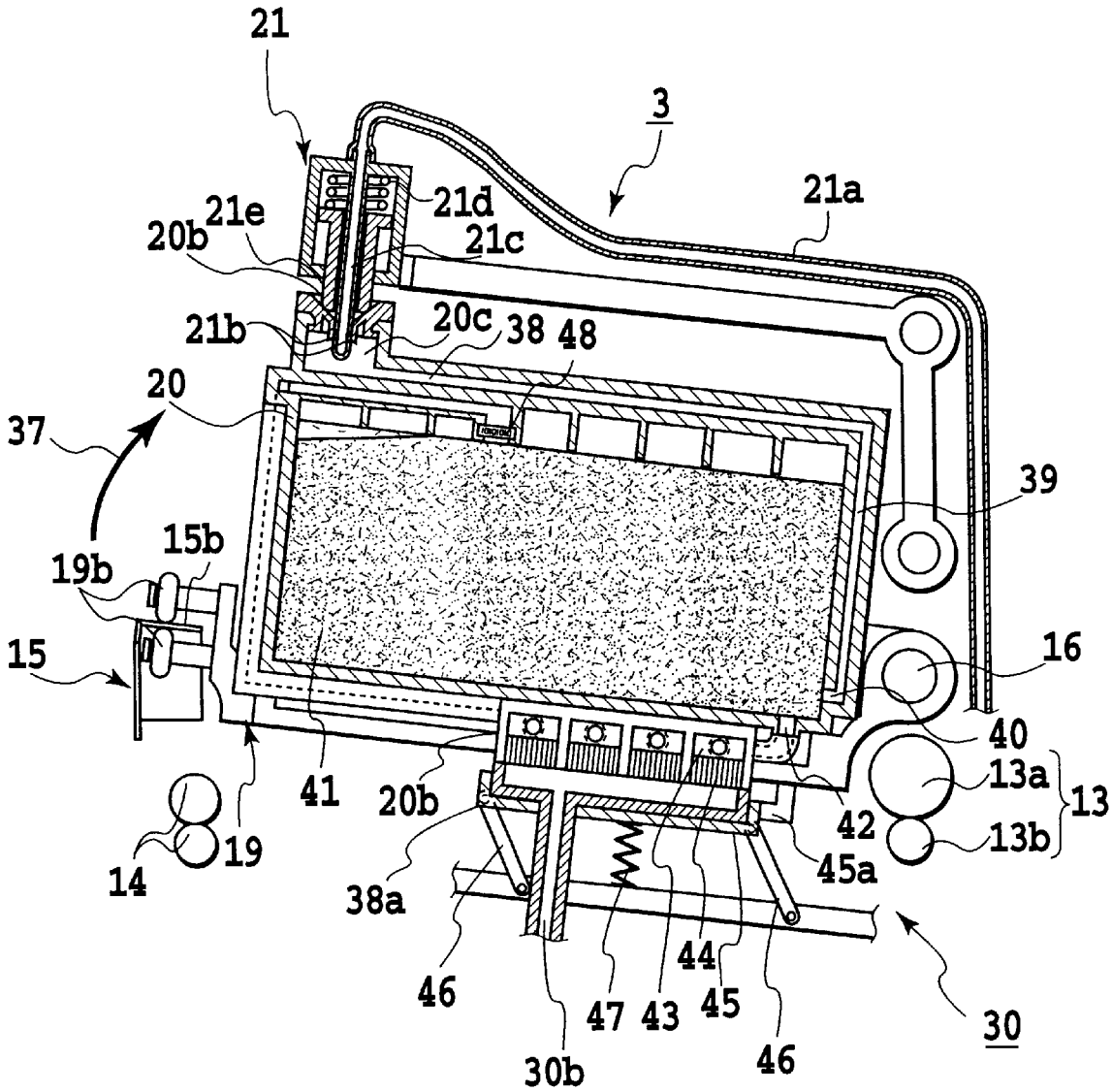
FIG. 5 is a cross sectional view of the reserve ink tank shown in FIG. 3 while the reserve ink tank is tilted to a predetermined angle.

In addition, as shown in FIG. 5, the carriage 19 turns around the guide member 16 as an axis on in the direction of the arrow 37 by moving the carriage 19 in the direction of the arrow 28. By the rotation of the carriage 19, connection between the ink-supplying means 21 and the ink inlet 20*b* of the reserve ink tank 20 is made. That is, as shown in FIG. 3, a pair of guide rollers 19*b* is mounted on the carriage 19 for supporting the carriage 19 on the guide member 15. If the carriage 19 moves in the direction of the arrow 28, the side surface 20B-1 of the reserve ink tank 20B runs against the arm portion 27*a* of the migration board 27. Consequently, the migration board 27 begins to move together with the carriage 19 in the direction of the arrow 28. Subsequently, a pair of the guide rollers 19*b* moves from a tilted portion 15*a* of the guide member 15 to a horizontal portion 15*b* thereof. Accordingly, as shown in FIG. 5, the carriage 19 turns around an axis of the guide member 16 in the direction of the arrow 37, resulting in the connection between the ink-supplying means 21 and the ink inlet 20*b* of the reserve ink tank 20.

As shown in FIG. 4 and FIG. 5, the ink-supplying means 21 comprises a needle 21*c* having a hollow body with a closed tip end. The closed tip of the needle 21*c* has a pore 21*b* passing through a circumferential surface thereof in the radial direction (the left-right direction of FIG. 5). In addition, a piston-shaped bung member 21*e* is co-axially provided on the outer circumference of the needle 21*c* and is able to move up or down along a central axis of the needle 21*c*. The bug member 21*e* is made of a flexible material such as rubber and spring-loaded in a downward direction by a spring 21*d*.

Before an ink-supplying means 21 is connected to the ink inlet 20*b* of the reserve ink tank 20, the pore 21*b* of the needle 21*c* is covered by a bung member 21*e* as shown in FIG. 4. In this case, therefore, there is no leakage of ink from the needle 21*c* at this time. At this time, as shown in FIG. 4, the ink inlet 20*b* of the ink tank 20 formed by a flexible valve member such as rubber is being closed by the stability of the valve member to restore its original state. On the other hand, as shown in FIG. 4, when an ink-supplying means 21 is connected to the ink inlet 20*b* of the reserve ink tank 20, the surface of the ink inlet 20*b* and the bottom of the bung member 21*e* are brought into intimate contact with each other. Furthermore, the bung member 21*e* moves upward against the force of the spring 21*b* to open the pore 21*b* of the needle 21*c* in the inside 20*c* of the inlet 20*b*. Subsequently, the ink flowed out from the pore 21*b* pass through flow channels 38, 39, and 40, and is absorbed by a sponge-like ink absorber 41 in the reserve ink tank 20.

D. [Configuration of the Capping Device Portion 30]

A capping device portion 30 makes good contact with the printing head 20*a* and sucks out foreign matter, such as air and thickened ink, which is the cause of the eject defect of the ink. In FIG. 5 and FIG. 6, the reference numeral 38*a* is a cap member which covers the surface on which ink eject ports of the printing head are formed (the ink eject port-formed surface). The reference numeral 54 is a cap member that makes good contact with the surface 53*a* on which a general suction port 53 is formed. The cap members 38*a*, 54 are held by a frame body 45, while the frame body 45 is supported by four link arm members 46 so as to allow the up-and-down movements of the frame body 45. The reference numeral 47 denotes a spring that pushes the frame body 45 upward. In addition, the cap members 30*a*, 54 are connected to ducts 30*b*, 55, respectively. The ducts 30*b*, 55 are also connected to a change-over mechanism 56 for changing the pump suction ways.

D-1. [Change-over Mechanism 56 for Changing the Pump Suction Ways]

The projection part 45*a* located on the migration tracking of the bank part 19*a* held in the predetermined position of the carriage 19 is held at one end of the frame body 45. When a bank part 19*a* hits the projection part 45*a* at the position of moving the carriage 19, as shown in FIG. 3, the frame body 45 is pushed down against the force of the spring 47. As a result, the surface of the printing head 20*a* on which the ink eject ports are formed and the surface 53*a* on which the general suction port 53 passes through the tops of the cap members 38*a*, 54 without touching. When the bank part 19*a* leaves the projection part 45*a*, as shown in FIG. 6, the frame body 45 is raised by the spring 47. As a result, the cap member 38*a* makes good contact with the surface 53*a* on which the ink eject ports are formed and also the cap member 54 makes good contact with the surface 53*a* on which the general suction port 53 is formed.

The change-over mechanism 56 to be connected with the ducts 30*b*, 55 has a rotary valve 59 made of rubber as shown in FIG. 6. The rotary valve 59 connects the ducts 30*b*, 55 to the pump suction port 31*a* of the suction pump 31 through a passage 59*a* in a selective manner in response to the positions every time the rotary valve 59 is rotated at 90 degrees. As shown in FIG. 3, the rotary valve 59 is fixed on a rotational shaft 56*a* on which a saw-tooth gear 56*b* is co-axially placed. In addition, a proximal end of an arm member 56*c* is supported by the rotational shaft 56*a* so as to be able to rotate about the shaft 56*a* while a ratchet teeth 56*d* is pivoted on the other end thereof. The ratchet teeth 56*d* engages with the saw-teeth gear 56*b* in one direction only. The reference numeral 56*e* denotes a spring that pulls the arm member 56*c* in a clockwise direction in FIG. 3. Two location indication members 56*f* are provided and staggered 180 degrees apart on the saw-tooth gear 56*b*. The reference numerals 57, 58 are location sensors provided in place 90 degrees apart to detect the position of the location indication members 56*f*. Each of the location sensors 57, 58 may be a micro-switch, a photo-sensor, or the like.

The tip of the arm member 56*c* is coupled to a pore portion 34*b* of a selector lever 34 (see FIG. 2) through a coupling shaft 36. An end of the selector lever 34 is pivoted around an axial shaft 34*a*. If the carriage 19 touches the tip of the selector lever 34 by moving the carriage 19 in the direction of the arrow 35, and the carriage 19 further shifts its position in the same direction, the selector lever 34 turns around the axial shaft 34*a* in the direction of the arrow 35 to the position indicated by a broken line. Synchronizing with the turn of the selector lever 34 in the direction of the arrow 35, the arm member 56*c* (see FIG. 3) turns 90 degrees in a counterclockwise direction in FIG. 3 against the force of the spring 56*e*. In this case, therefore, the ratchet teeth 56*d* engages with the saw-tooth gear 56*d*, so that the saw-tooth gear 56*d* turns 90 degrees in a clockwise direction with the rotational shaft 56*a* and rotary value 59. After that, when the carriage 19 leaves from the tip of the selector lever 34 in the direction of the arrow 28, the selector lever 34 and the arm member 46*c* are turned in the clockwise direction for returning to their original positions by the force of the spring 56*e*. In this case, the ratchet teeth 56*d* does not engage with the saw-tooth gear 56*d*, so that the saw-tooth gear 56*d* does not rotate.

Figure 8:
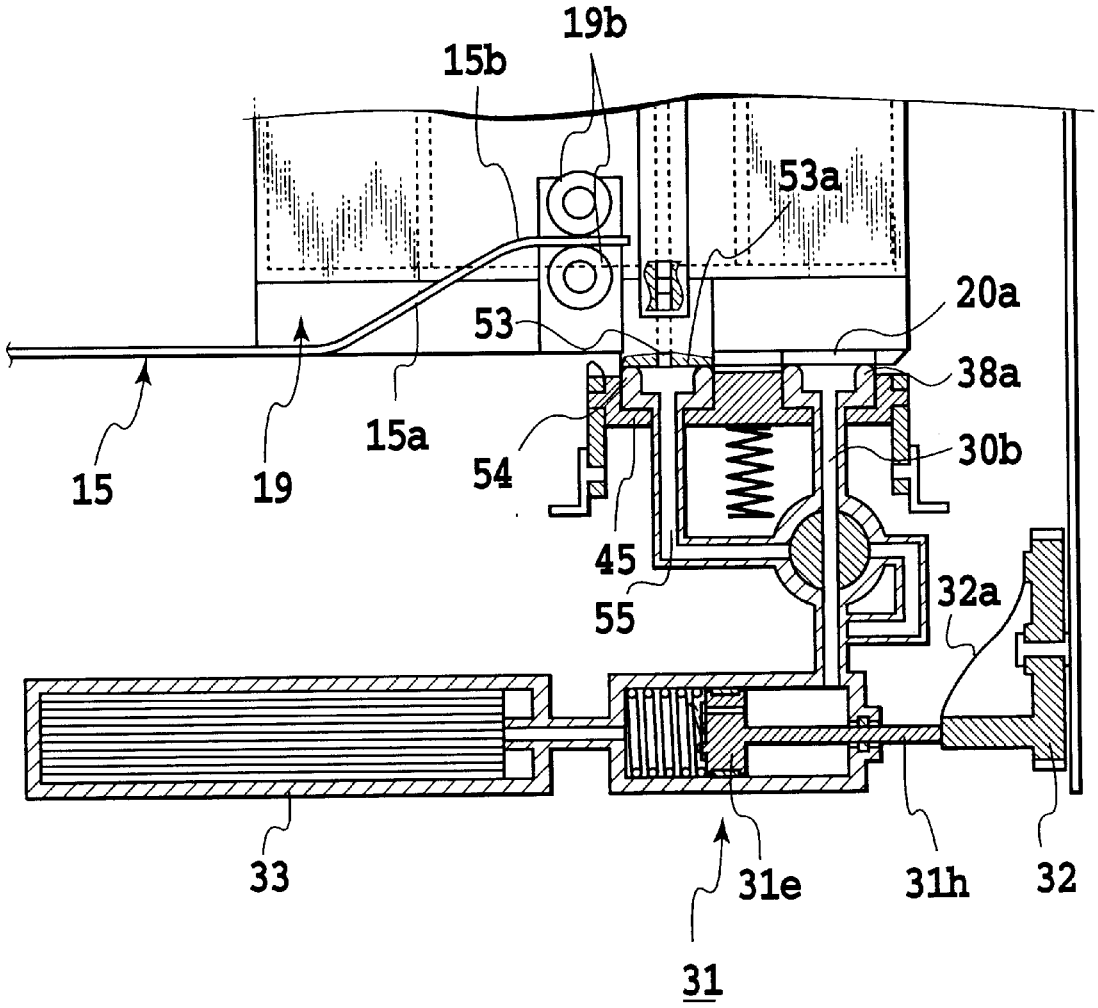
FIG. 8 is a partially cutaway cross sectional view of the air suction system while the printing head is subjected to the operation of recovering its function by suction.

Like this, every time the carriage 19 turns the selector lever 34 in the direction of the arrow 34, the rotary valve 59 is rotated by 90 degrees of a turn in a counterclockwise direction to switch from one of the pump suction ways to another. The condition of switching between the pump suction ways is detected by the location sensors 57, 58. FIG. 6 illustrates the state of switching between the pump suction ways when the location sensor 57 detects the location indication member 56*f*. Then, the general suction port 53 communicates with the pump 31 through the cap member 54, the duct 55, the passage 59*a*, the pump suction port 31*a*. On the other hand, FIG. 8 illustrates the state of switching between the pump suction ways when the location sensor 58 detects the location indication member 56*f*. Then, the ink eject ports of the printing head 20*a* communicate with the pump 31 through the cap member 38*a*, the duct 30*b*, the passage 59*a*, and the pump suction port 31*a*. A control means 25 (see FIG. 1) to be described later confirms the states of switching the pump suction ways on the basis of detection signals from the location sensors 57, 58. If the state of switching between the pump suction ways is not appropriate to the operation to be down, the control means 25 allows the movement of the carriage 19 in the direction of the arrow 35 and the turn of the selector lever 34 in the direction of the arrow 34. Consequently, the switching between the pump suction ways is down so as to be fit to the desired operation.

In FIG. 1, the reference numeral 24 denotes an electric substrate arranged in the inside of the cover 4 having a plurality of switch buttons 23 that project upward through the holes formed on the cover 4. The reference numeral 25 denotes a control means that comprises a microcomputer, a memory, and so on mounted on a control electric substrate arranged in the inside of the cover 4. The control means 25 controls the functions of the printing apparatus in communication with a host computer.

D-2. [Suction Pump 31]

As shown in FIG. 6, the suction pump 31 comprises a piston member 31*e* which is co-axially provided in a cylinder member 31*c* having a suction inlet 31*a* and an outlet 31*b*. In addition, a seal member 31*d* is placed between the piston member 31*e* and the cylinder member 31*c*. The piston member 31*e* is able to perform a reciprocating motion in the cylinder member 31*c*. A pore 31*f* provided in the piston member 31*e* has a reed valve 31*g* that restricts the flow of ink only to the one-way (i.e., the left side of FIG. 6). Furthermore, the reference numeral 31*h* is a piston shaft that actuates the piston member 31*e*, and 31*i* denotes a spring member that pushes the piston member 31*e* to the right side of FIG. 6. Ink and air absorbed by such a suction pump 31 pass from the outlet 31*b* to the discharge pipe 31*j*. Then, they are discharged toward the sponge-like ink absorber 33*a* in a liquid waste container 33.

The piston shaft 31*h* performs a reciprocating motion in the left-right direction of FIG. 6 in response to the turn of a cam part 32*a* of a cam gear 32 to be described later. The piston member 31*e* performs a reciprocating motion in the left-right direction in synchronization with the movement of the piston shaft 31*h*, so that air and ink absorbed from the suction port 31*a* are discharged to the outlet 31*b*.

As shown in FIG. 4, a gear 56 is installed on the shaft 13*a* of the transport roller 13 through a one-way clutch 13*b*. The gear 56 can be rotated by a drive motor 60. If a drive shaft of the drive motor 60 is rotated counterclockwise, the shaft 13*a* of the transport roller 13 is rotated. If the drive shaft of the drive motor 60 is rotated clockwise, the cam gear 32 is rotated. The cam gear 32 has a cam part 32*a* that touches the piston shaft 31*h* by the force of the spring 31*i*. The location where the cam part 32*a* touches the piston shaft 31*h* changes in response to the turning of the cam gear 32. As a result, the piston shaft 31*h* is moved right and left as a reciprocating motion. Also, the piston member 31*e* is moved right and left as a reciprocating motion in conjunction with the piston shaft 31*h*. If the piston member 31*e* moves toward the light side, the valve 31*g* is closed by a pressure generated in a pressure chamber 31*k* on the left side to exhaust ink and air in the pressure chamber 31*k* from the outlet 31*b* to the liquid waste container 33. Moreover, the volume of a pressure chamber 31*m* on the right side is increased, and simultaneously negative pressure is generated in the pressure chamber 31*m*. The negative pressure allows the suction of ink and air from the suction port 31*a*. On the other hand, ink and air in the pressure chamber 31*m* on the right side are moved to the pressure chamber 31*k* on the left side by passing through the pore 31*f* when the piston member 31*e* is moved to the right side.

Next, the actuation of the printing apparatus will be described.

[Printing Movement]

The image data to be transmitted to a printing device portion 2 from a host computer is expanded on the occasion of the printing movement. The control means 25 controls the movement of the carriage 19 in the main-scanning direction, the transport of the printing medium S by a pair of the transport rollers 13, 14 in the sub-scanning direction, and the actuation of the printing head 20*a*. The printing head 20*a* prints a color image on the printing medium S by ejecting ink droplets of each color using nozzles 44 being controlled on the basis of the process of gradating an image (the procedures of overlaying color dots).

The photosensor 12 detects the end of the printing medium S. After performing the printing movement on the end of the printing medium S, a pair of rollers 14 rotates to discharge the printing medium S on which an image is printed from the outlet 4*b*.

[Recovery Action]

When the power of the printing apparatus turns on, or the printing movement is not operated during more than predetermined time after the power of the printing apparatus turns on, the control means 25 allows an automatically start of the recovery action to get rid of thickened ink or air bubbles formed in the nozzles of the printing head 20*a*. If the printed image has some color faint, inconsistencies in density, or the like, the control means 25 starts the recovery action in the same way by pushing predetermined control buttons (see FIG. 1).

On the occasion of the recovery action, at first, the control device 25 confirms whether the location sensor 58 in the mechanism 56 that switches between suction ways is in the state of detecting the location indication member 56*f*. If the location indication member 56*f* is detected by the location sensor 57, the carriage 19 is moved in the direction of the arrow 35 (the left side direction) so that the selector lever 34 turns in the direction of the arrow 35. Consequently, it becomes the condition of detecting the location indication member 56*f* by the location sensor 58 (i.e., the condition of switching between the suction ways as shown in FIG. 8). The control means 25 confirms that it is in the state that the location sensor 58 detects the location indication member 56*f*. After that, as shown in FIG. 5, FIG. 7, and FIG. 8, the carriage 19 is moved so that the cap member 38*a* touches the printing head 20*a* and the cap member 54 touches the general suction port 53. Subsequently, the control means 25 rotates the cam gear 32 by running a motor 60 (see FIG. 4) in the clockwise direction through the gear 59. Consequently, the suction pump 31 absorbs thickened ink and air in the nozzles 44 of the printing head 20*a* and discharges them into the liquid waste container 33.

The piston member 31*e* of the suction pump 31 does the actuation of one cycle of the absorption and the discharge by a turn of the cam gear 32. The number of rotate of the cam gear 32 depends on the magnitude of the essential negative pressure for the recovery of the eject defect of the printing head 20*a*.

[Ink-supplying Movement]

The number of ink droplets ejected by the printing head 20*a* is counted with the control means 25 in each ink color. If at least one of the count value of each ink color meets a predetermined number, when the printing movement to the printing medium S is completed, and so the printed printing medium S is ejected from the printing apparatus, the control means 25 starts to actuate the ink-supply to the reserve ink tank 20 from the supplementary ink tank 22 (see FIG. 1).

The control means 25 confirms whether it is in the condition that the location sensor 57 in the suction-way switching mechanism 56 detects the location indication member 56*f*. When the location indication member 56*f* is detected by the location sensor 58, the selector lever 34 is turned in the direction of the arrow 35 by moving the carriage 19 in the direction of the arrow 35 (the left side). Consequently, it becomes the condition that the location sensor 57 detects the location indication member 56*f*, that is, the condition of switching between the suction ways as shown in FIG. 6. The control means 25 confirms that it is in the state that the location sensor 57 detects the location indication member 56*f*. After that, as shown in FIG. 5, FIG. 6, and FIG. 7, the carriage 19 is moved so that the cap member 38*a* touches the printing head 20*a* and the cap member 54 touches the general suction port 53. Subsequently, the control means 25 rotates the cam gear 32 by running a motor 60 (see FIG. 4) in the clockwise direction through the gear 59. Consequently, the suction pump 31 absorbs air in the reserve ink tank 20 through the gas-permeable member 48, and ejects them into the liquid waste container 33.

The inside of the reserve ink tank 20 becomes negative pressure as a result of absorbing air in the reserve ink tank 20 by the suction pump 31. At this time, as shown in FIG. 7, the supply means 21 connects the supplementary ink tank 22 (see FIG.1) to the reserve ink tank 20. Therefore, ink in the supplementary ink tank 22 is absorbed into the inside 41 of the reserve ink tank 20 by the negative pressure in the reserve ink tank 20. The ink being entered into the inside 41 of the reserve ink tank 20 permeates an ink absorber 41*a* that consists of a cluster of small cells that communicate with each other. Thus, a liquid level 41*b* of the ink rises as the ink permeates the ink absorber 41*a*. The rise rate of the liquid level 41*b* of the ink is adjusted properly on the basis of rotational frequency of the cam gear 32 as it depends on the suction force of the suction pump 31. If the liquid level 41*b* of the ink reaches the gas-permeable member 48, the supply of ink is automatically stopped because the gas-permeable member 48 does not permeate a fluidal material such as ink. Ink is supplied from the supplementary ink tanks 22 (22Y, 22M, 22C, 22B) to the respective reserve ink tanks 20 (20Y, 20M, 20C, 20B) at the same time. Then, the supply of ink to the reserve ink tanks 20 (20Y, 20M, 20C, 20B) is automatically stopped one after another in order of treaching the liquid level 41*b* of the ink to the gas-permeable member 48. If the supply of ink is completed, the control means 25 resets the counter of ejected ink droplets to zero for each of ink color.

Thus, air in all of the reserve ink tanks 20 (20Y, 20M, 20C, 20B) can be absorbed through the use of a single cap member 54 and simultaneously refilled. Therefore, there is no need to provide a suction port 53 and a cap member 54 for each of the reserve ink tanks 22 (22Y, 22M, 22C, 22B), so that both the size and weight reductions of the structural components of the capping device portion 30 on the side of the carriage 19 are achieved. In addition, the reliability of a device area that makes the reserve ink tanks 20 (20Y, 20M, 20C, 20B) negative pressure can be secured.

The reserve ink tank 20 is inclined at an angle as shown in FIG. 7 during the step of supplying ink, so that an area 41*c* where ink is not absorbed is found in an ink absorber 41*a* in the inside 41 of the tank 20. After the supply of ink, the reserve ink tank 20 gets back to a horizontal position as shown in FIG. 4. In this case, ink permeates through the area 41*c* of the ink absorber 41*a*. Thus, the liquid level 41*b* of ink over the surface of the gas-permeable member 48 as shown in FIG. 7 moves downward and leaves from the surface of a gas-permeable member 48 as shown in FIG. 4. If there is a possibility that the gas-permeable. member 48 permeates ink as a result of its decreased function when it is being touched ink, as the characteristics of the gas-permeable member 48, it is effective to leave ink from the surface of the gas-permeable member 48 all the times except the time of supplying ink.

By the way, the suction pump 31 of the present embodiment combines the function as an absorbing means to absorb ink for the recovery operation to the printing head 20*a* with another function as an absorbing means to absorb air in the reserve ink tank 20 for the supply of ink. Therefore, the present embodiment is able to provide a substantially simplified and low-cost printing apparatus, compared with the one having a plurality of suction pumps for those functions. Furthermore, negative pressure to be applied on the inside of the reserve ink tank 20 during the period of supplying ink is adjusted to a predetermined level in order to prevent a backward current of ink from the nozzles 44 to the reserve ink tank 20 when the ink eject ports are being opened. During the period of supplying ink, the ink eject ports may be sealed with the cap member.

In addition, if air is introduced into an ink flow path between the reserve ink tank 20 and the supplementary ink tank 22 from a port of the ink flow path, the air can be discharged through the gas-permeable member 48 and subsequently the supply of ink can be carried on. Ink is supplied under suction by means of negative pressure in the reserve ink tank 20. Therefore, ink can be supplied even if there is a difference between the height of a head of the ink in the reserve ink tank 20 and the height of a head of the ink in the supplementary ink tank.

If ink is supplied under suction without using the gas-permeable member 48, the following programs are caused. When air intrudes into the reserve ink tank 20 from the nozzle 44, meniscus of ink must be formed on the ink eject port while the intruded air must be discharged from the reserve ink tank 20 by absorbing ink again from the nozzle 44 after the action of supplying ink. Therefore, useless waste ink is produced with taking unnecessary time. If a space is present in the cap even if the nozzle 44 is being sealed with the cap as the action of supplying ink is performed, air in such a space intrudes into the reserve ink tank 20 through the nozzle 44 to cause the same kind of trouble.

Second Preferred Embodiment

In the first preferred embodiment described above, a negative pressure may be applied on the cap member of the nozzles 44 by the same way as that of being performed at the time of recovering the printing head 20*a* at the same time when the action of supplying ink is performed.

In this case, the negative pressure to be used for supplying ink into the reserve ink tank 20 is adjusted so as to be smaller than the negative pressure to be applied on the nozzles 44.

Therefore, while the supply of the ink is performed, the negative pressure with the extent to which ink is not absorbed and ejected is applied on the nozzles 44. As a result, the second preferred embodiment is able to prevent the retraction of ink from the nozzles 44 to the reserve ink tank 20, the destruction of meniscus, and the entry of air even if the ink eject ports of the nozzles 44 are being opened.

Furthermore, if ink in the reserve ink tank 20 touches the whole surface of the gas-permeable member 48 and the supply of ink is automatically stopped, i.e., the suction of air in the reserve ink tank 20 is completed during the action of supplying ink, negative pressure in a suction way of the air rises rapidly while negative pressure in the cap member of the nozzles 44 that communicate with the suction way of the air also rises rapidly. In this case, the negative pressure level in the cap member is restricted to the extent that ink is not absorbed and discharged from the nozzles 44. If the negative pressure in the cap member is adjusted to such an appropriate level, ink is never absorbed from the nozzles 44 excessively at the time of completing the suction of air in the reserve ink tank 20. Therefore, the present preferred embodiment is able to prevent the entry of air form the nozzles 44 during the action of supplying ink without absorbing an excess amount of ink, so that the running cost of the printing apparatus can be lowered.

Additionally, if negative pressure in the cap member of the nozzle 44 rises rapidly at the time of completing the suction of air from the reserve ink tank 20 during the action of supplying ink, the negative pressure may be adjusted to a predetermined level that allows the suction and discharge of ink from the nozzles 44. In this case, the recovery processing of ejecting ink from the nozzles 44 under suction can be carried out automatically and immediately after the action of supplying ink, i.e., when the reserve ink tank 20 is filled with ink with reliability.

Third Preferred Embodiment

FIGS. 9 to 17 illustrate a third preferred embodiment of the present invention.

Figure 9:
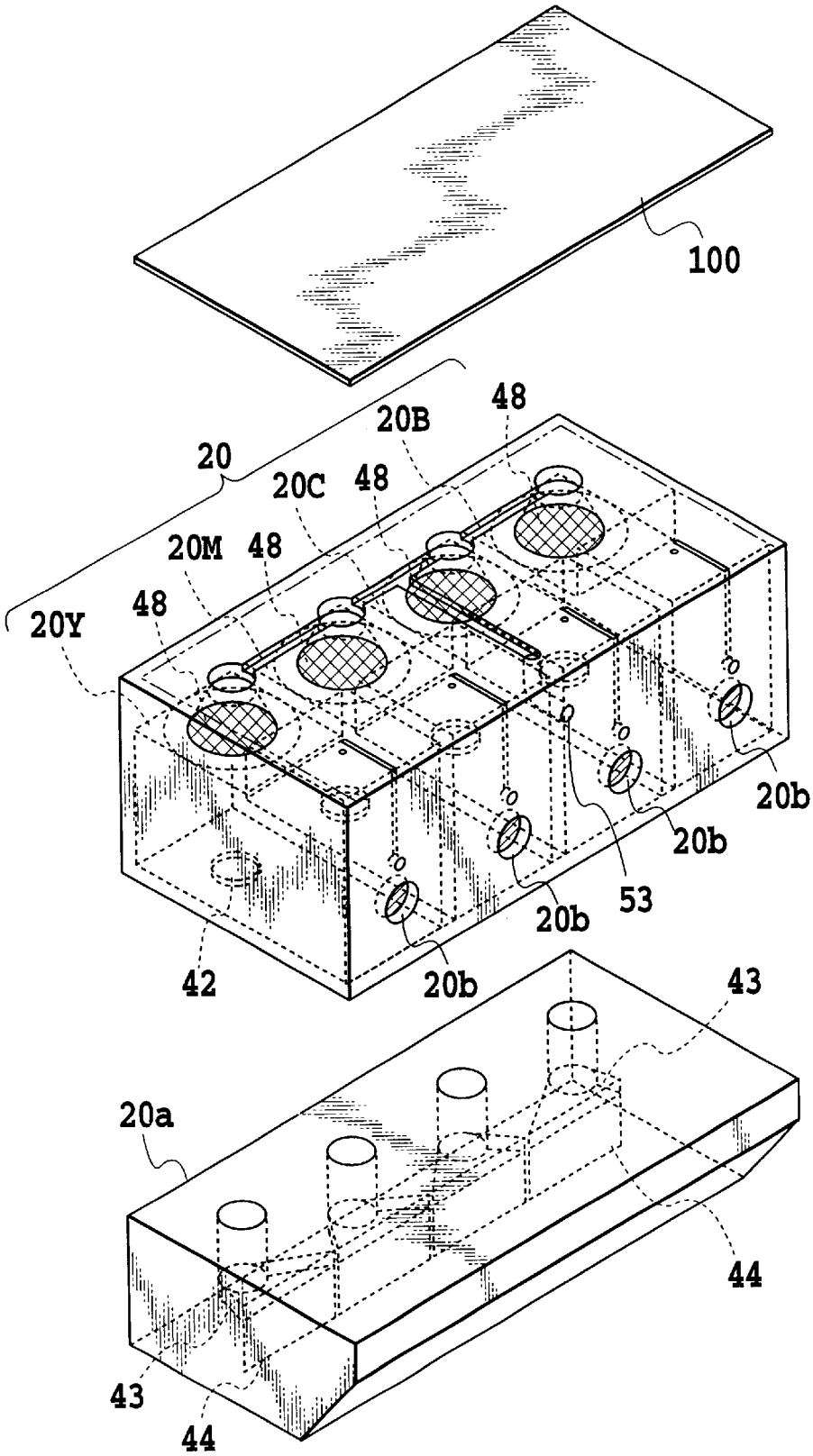
FIG. 9 is an exploded perspective view of the reserve ink tank in accordance with the third embodiment of the present invention.
Figure 10:
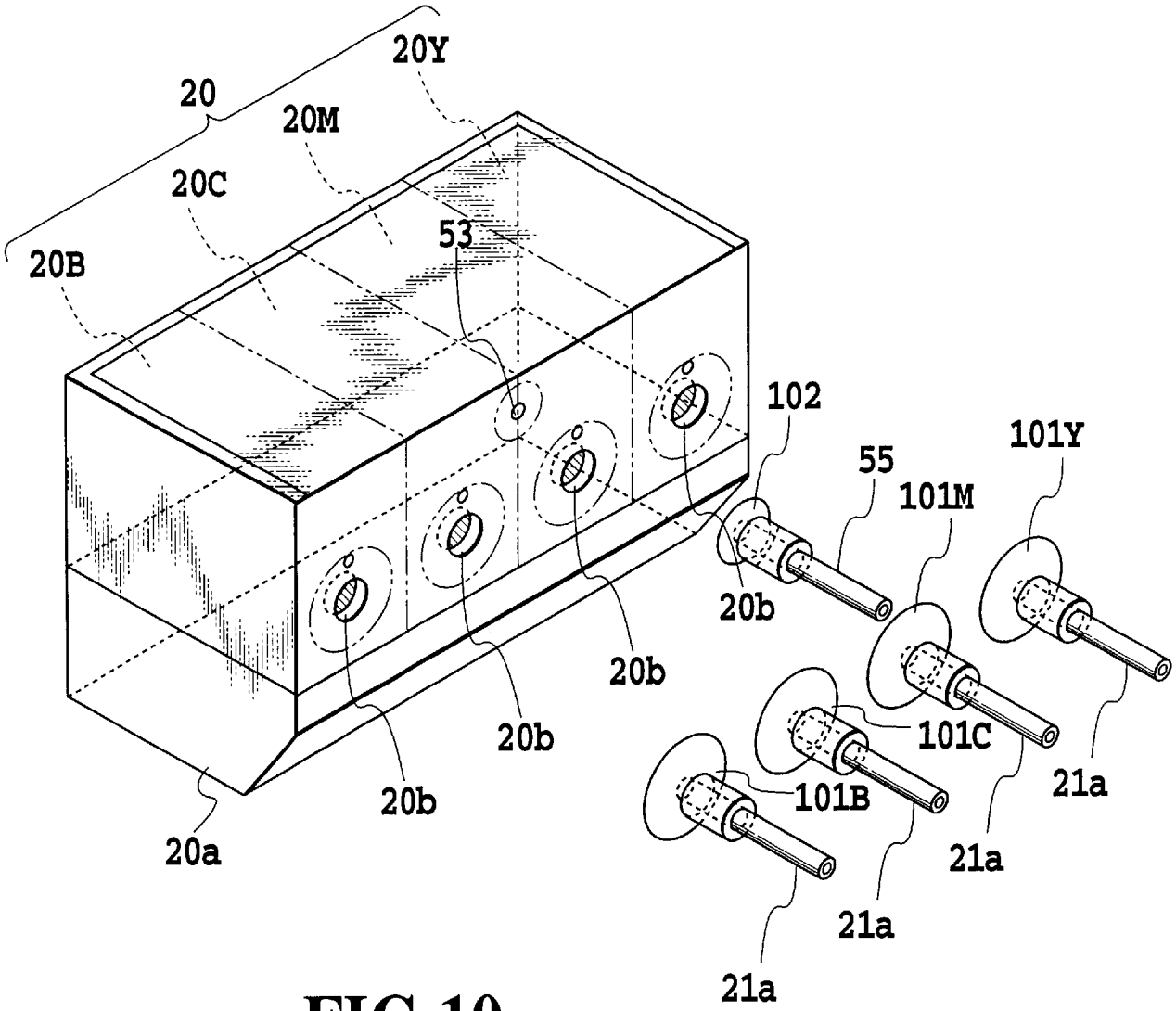
FIG. 10 is a perspective view of the reserve ink tank shown in FIG. 9.
Figure 11:
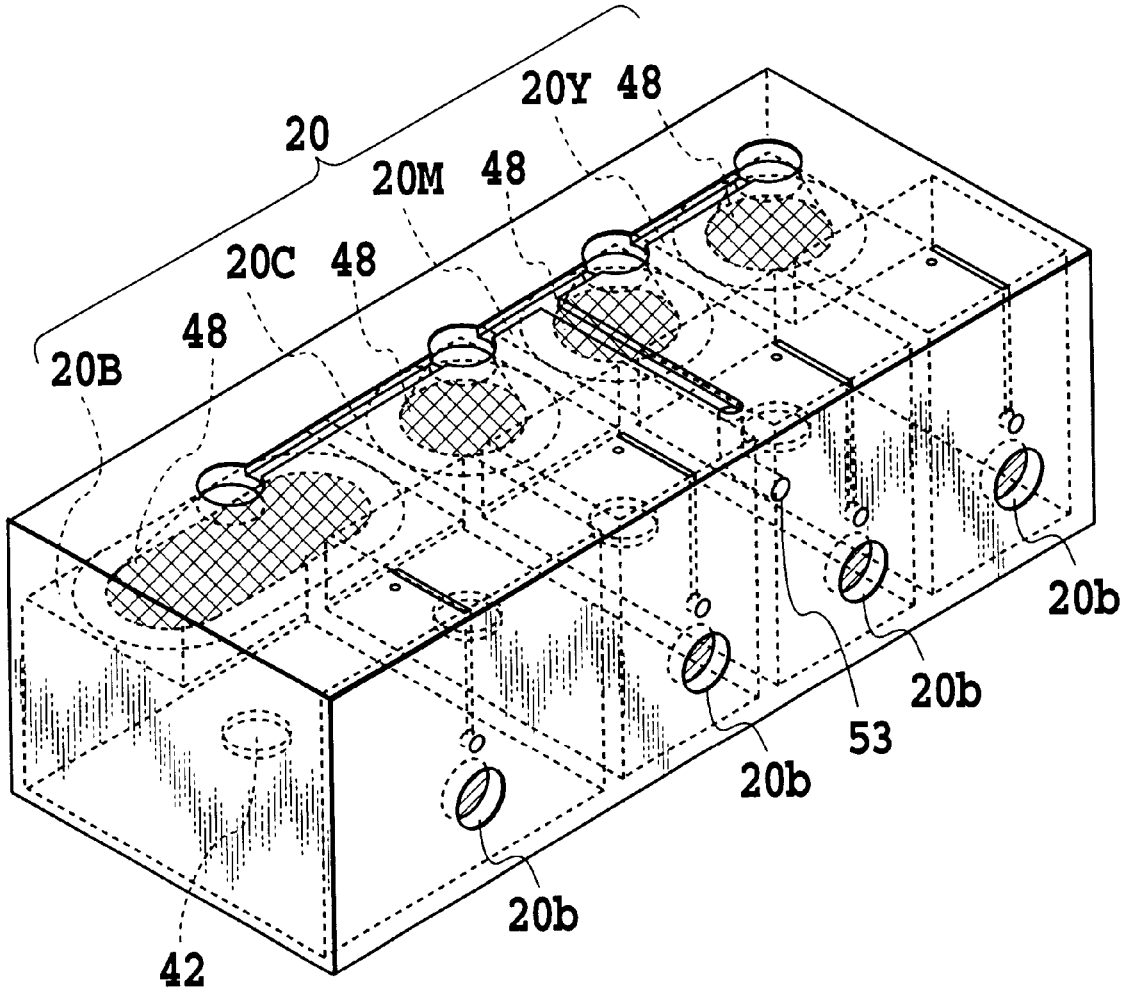
FIG. 11 is a perspective view of the reserve ink tank as a modification of the one shown in FIG. 9.

In this embodiment, as shown in FIG. 9 and FIG. 10, a general suction port 53 and ink inlets 20*b* are formed on the side of the reserve ink tank 20. In addition, grooves are formed on a top surface of a main body of the reserve ink tank 20. The top surface of the main body is covered with a cover member 100, so that an air ejecting route is formed the grooves and the cover member 100. The air ejecting route communicates each of the ink tanks 20Y, 20M, 20C, and 20B to the general suction port 53. Each of the ink tanks 20Y, 20M, 20C, and 20D comprises a gas-permeable member 48 in the same way as that of the first preferred embodiment. In addition, the same printing head 20*a* as that of the first preferred embodiment is fitted to the reserve ink tank 20. FIG. 11 illustrates a modification of the present embodiment in which a capacity of the black ink tank 20B is larger than those of the other ink tanks 20Y, 20M, and 20C. In this modification, a gas-permeable member 48 of the ink tank 20B is also larger than those of the other ink tanks 20Y, 20M, and 20C, so that the supply of black ink can be accelerated by smoothly absorbing air in the ink tank 20B passing through the comparatively large sized gas-permeable member 48.

In FIG. 10, the reference numerals 101Y, 101M, 101C, and 101B denote supply joints connectable to the respective ink inlets 20*b* of the ink tanks 20Y, 20M, 20C, and 20B. These supply joints 101Y, 101M, 101C, and 101B are connected to the tubes 21*a* respectively in the same way as those of the supply means 21Y, 21M, 21C, and 21B as described in the first preferred embodiment. The reference numeral 102 denotes a suction joint connectable to the general suction port 53. The suction joint 102 is connected to the duct 55 in the same way as that of the cap member 54 as described in the first preferred embodiment.

Figure 12:
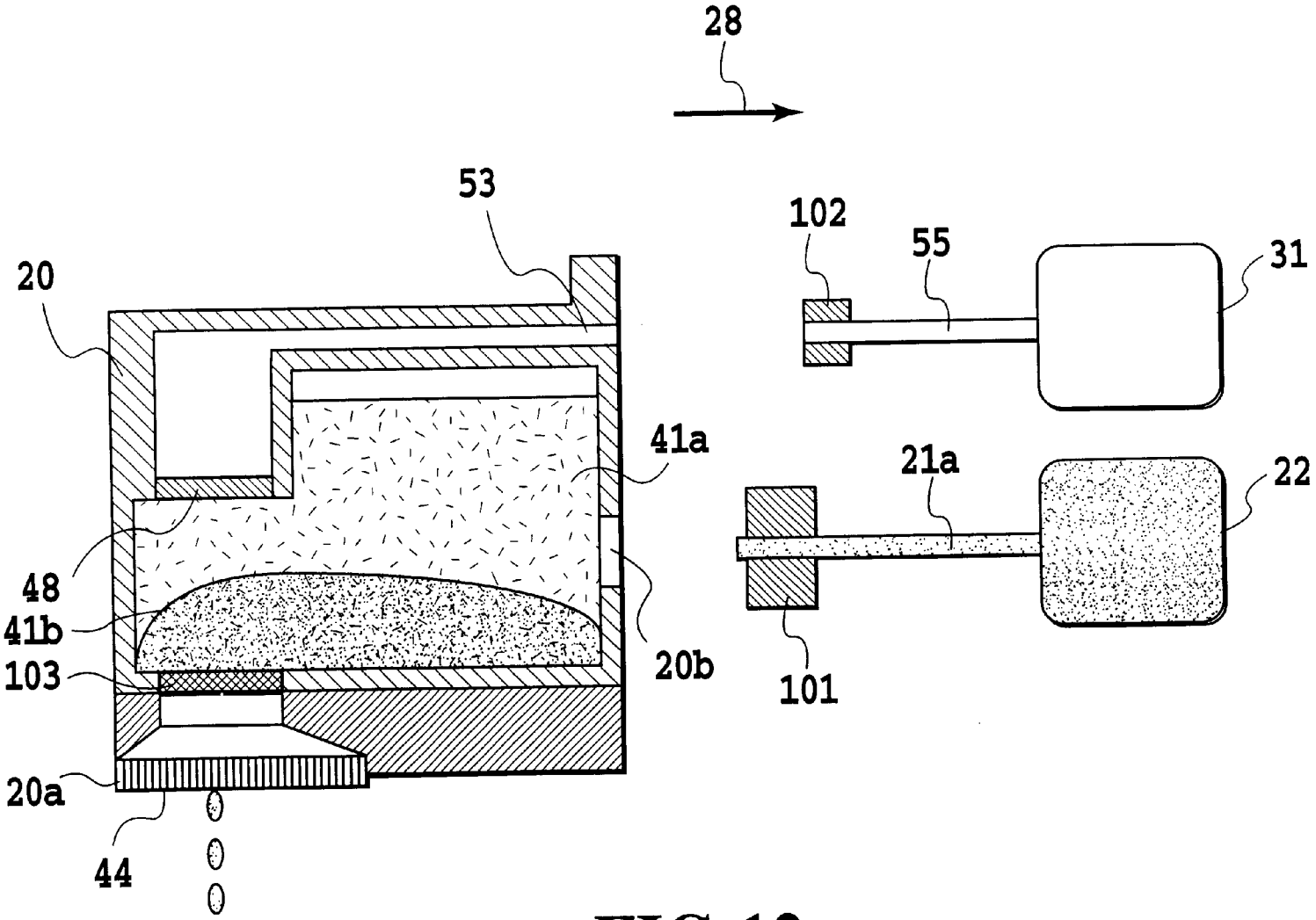
FIG. 12 is a schematic structural view for illustrating the configuration of the ink-supplying system to be connected to the reserve ink tank shown in FIG. 9.

FIG. 12 is an explanatory view for illustrating the positional relationship between the reserve ink tank 20 on the side of the carriage 109 and the joint 101 (101Y, 101M, 101C, and 101B), 102 on the side of the main body of the printing apparatus. The ink inlet 20*b* and the general suction port 53 are configured so that they are connected to the corresponding joints 101, 102 by moving the carriage 19 in the direction of the arrow 28. In FIG. 12, an ink-supplying system between the supply joint 101 and the supplementary ink tank 22 and a suction system between the suction joint 102 and the suction pump 31 are illustrated simple. The reference numeral 103 denotes a filter being provided in a flow path 42.

FIGS. 13 to 17 are explanatory views for illustrating the action of supplying ink.

Figure 13:
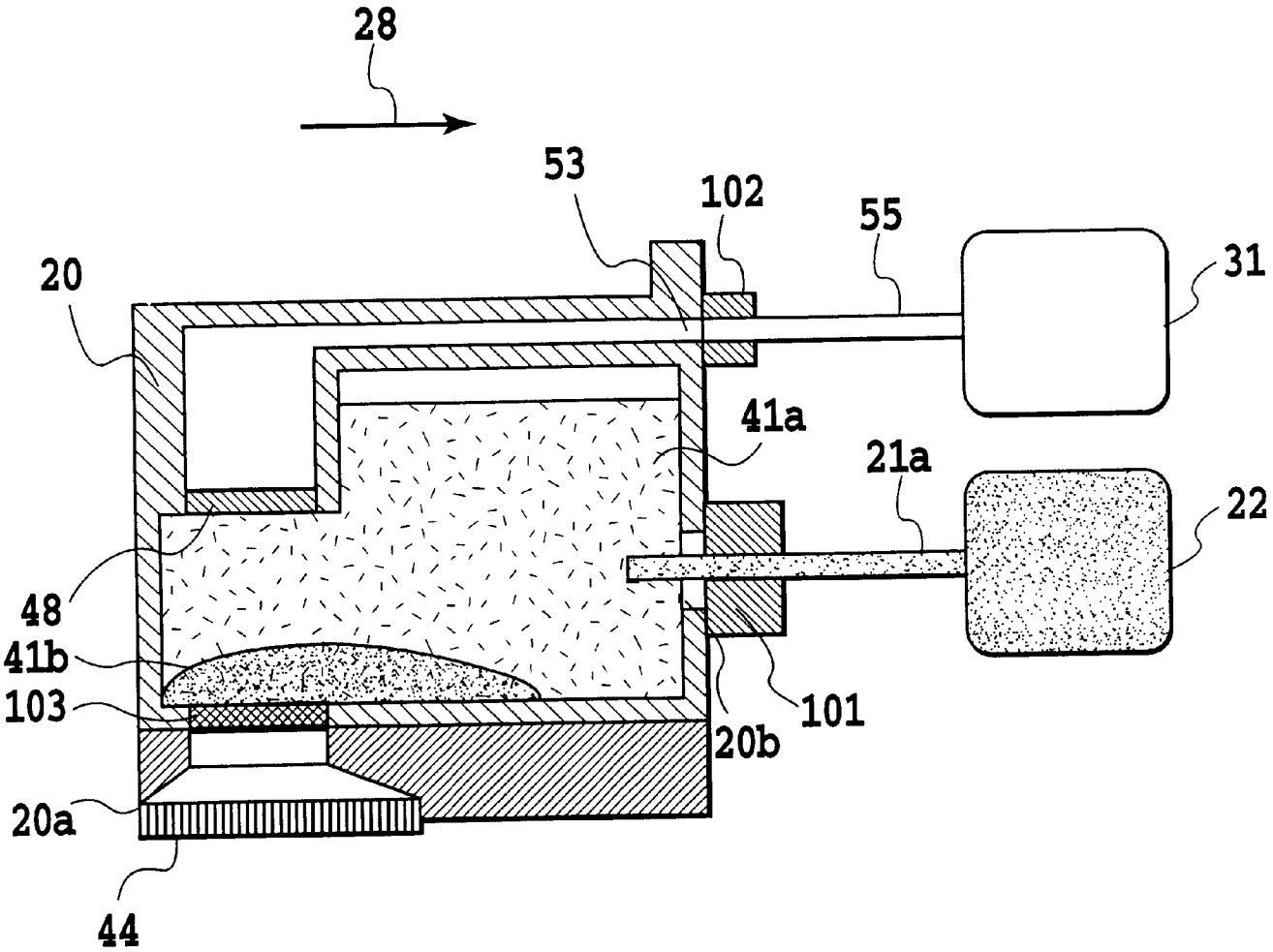
FIG. 13 is an explanation view for illustrating the connection between the reserve ink tank and the ink-supplying system shown in FIG. 12.
Figure 14:
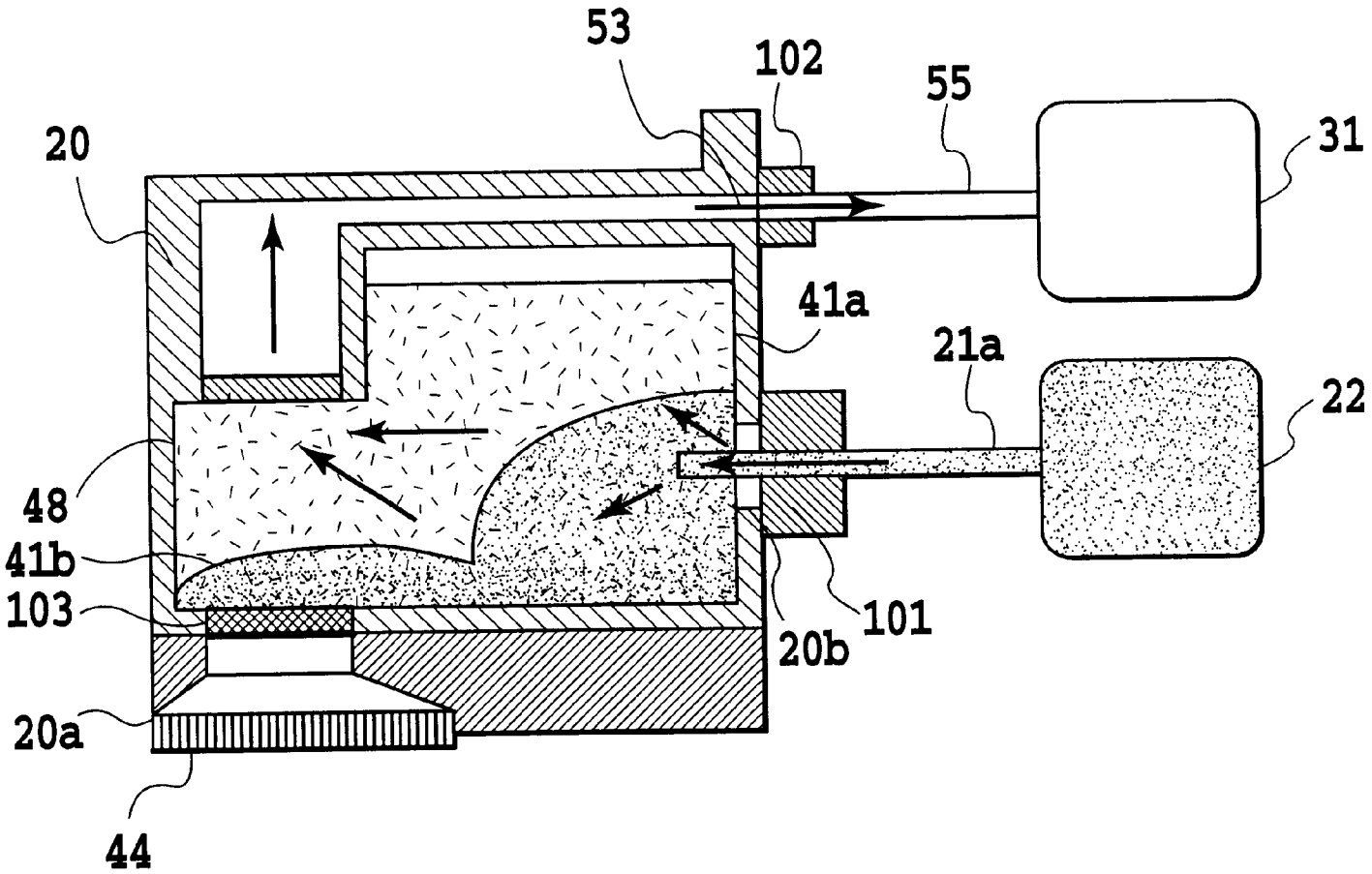
FIG. 14 is an explanation view for illustrating the condition of half way through the supply of ink by the ink-supplying system shown in FIG. 12.
Figure 15:
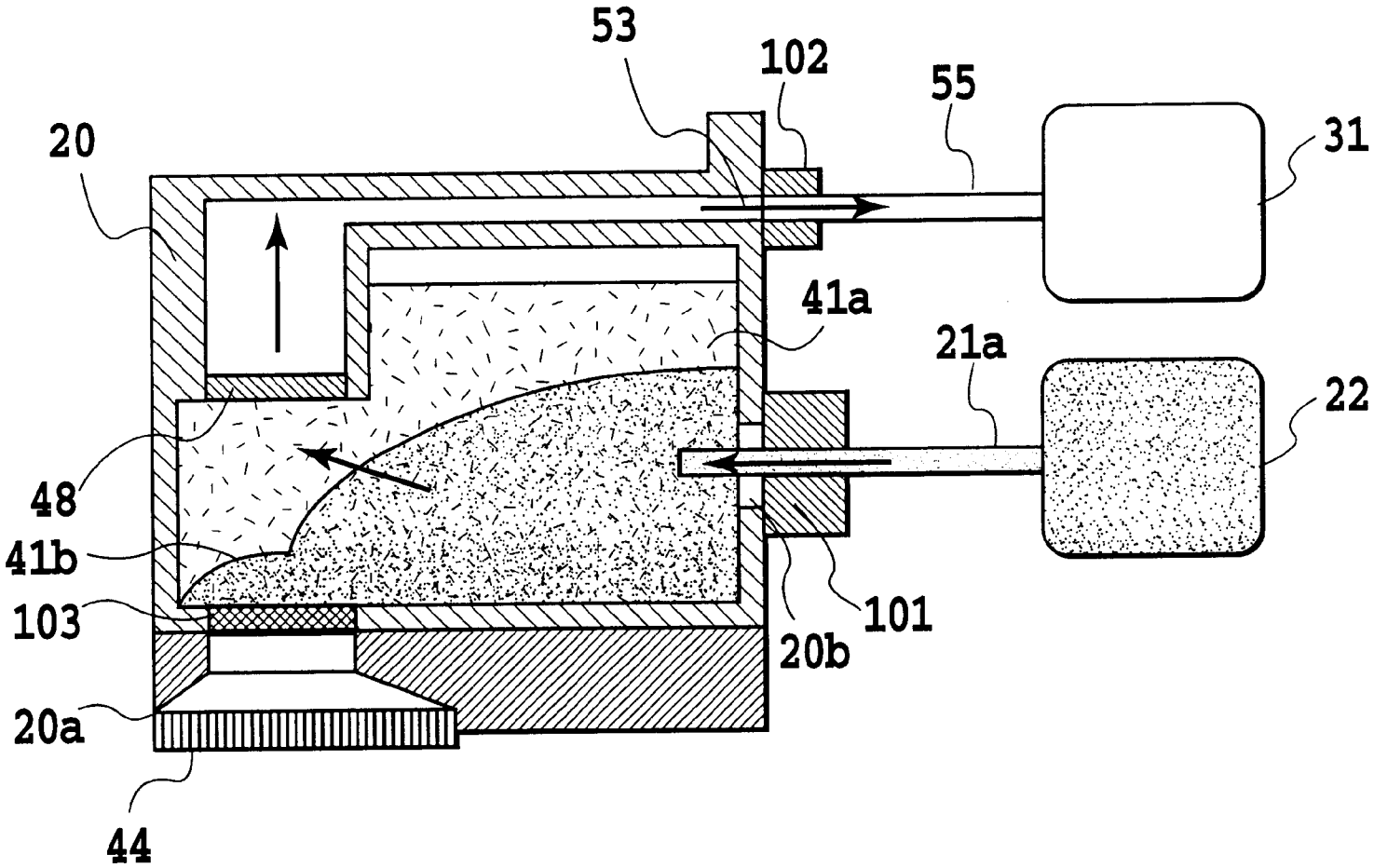
FIG. 15 is an explanation view for illustrating the condition of half way through the supply of ink by the ink-supplying system shown in FIG. 12.
Figure 16:
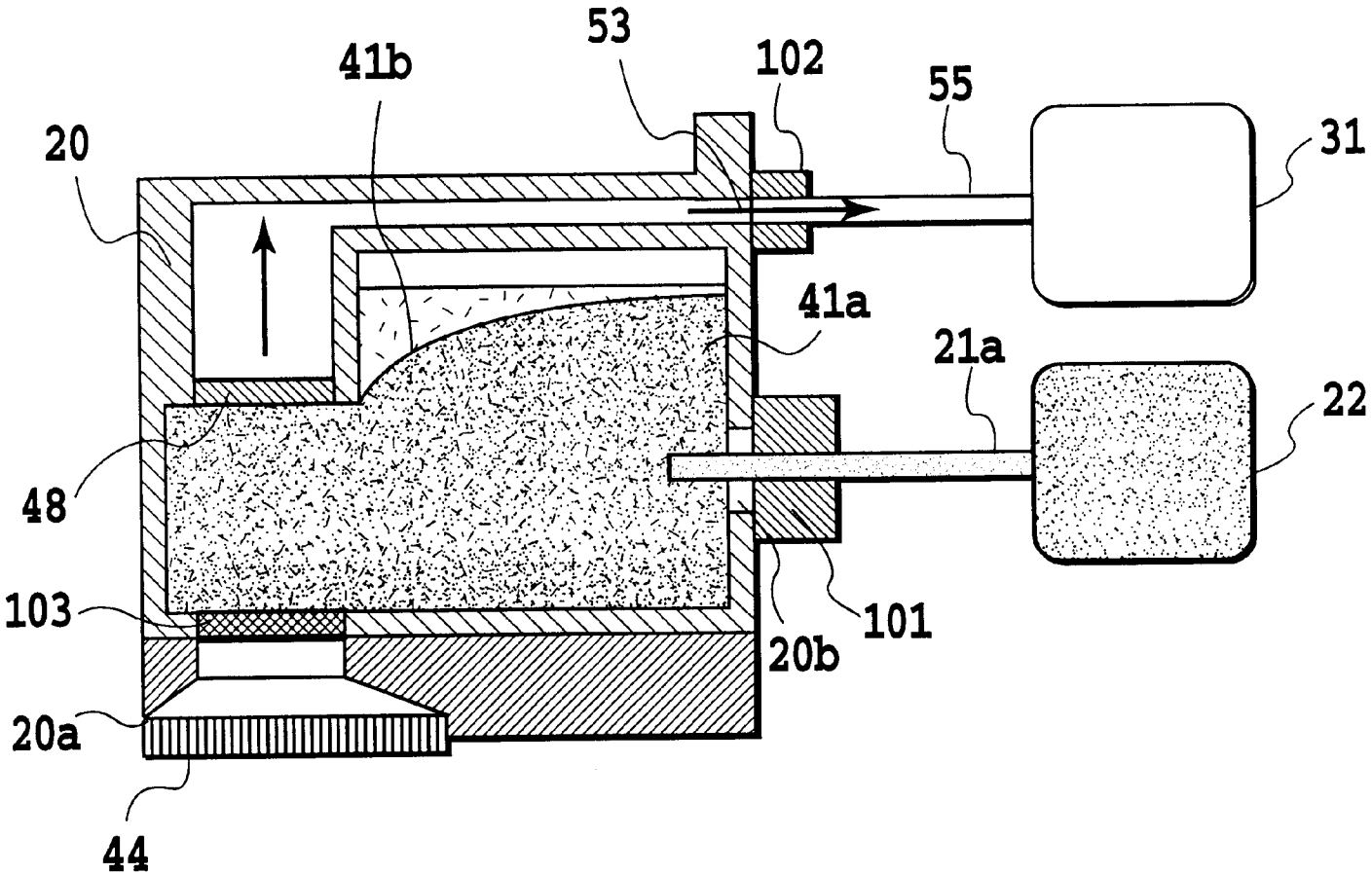
FIG. 16 is an explanation view for illustrating the condition in which the supply of ink is suspended by the ink-supplying system shown in FIG. 12.
Figure 17:
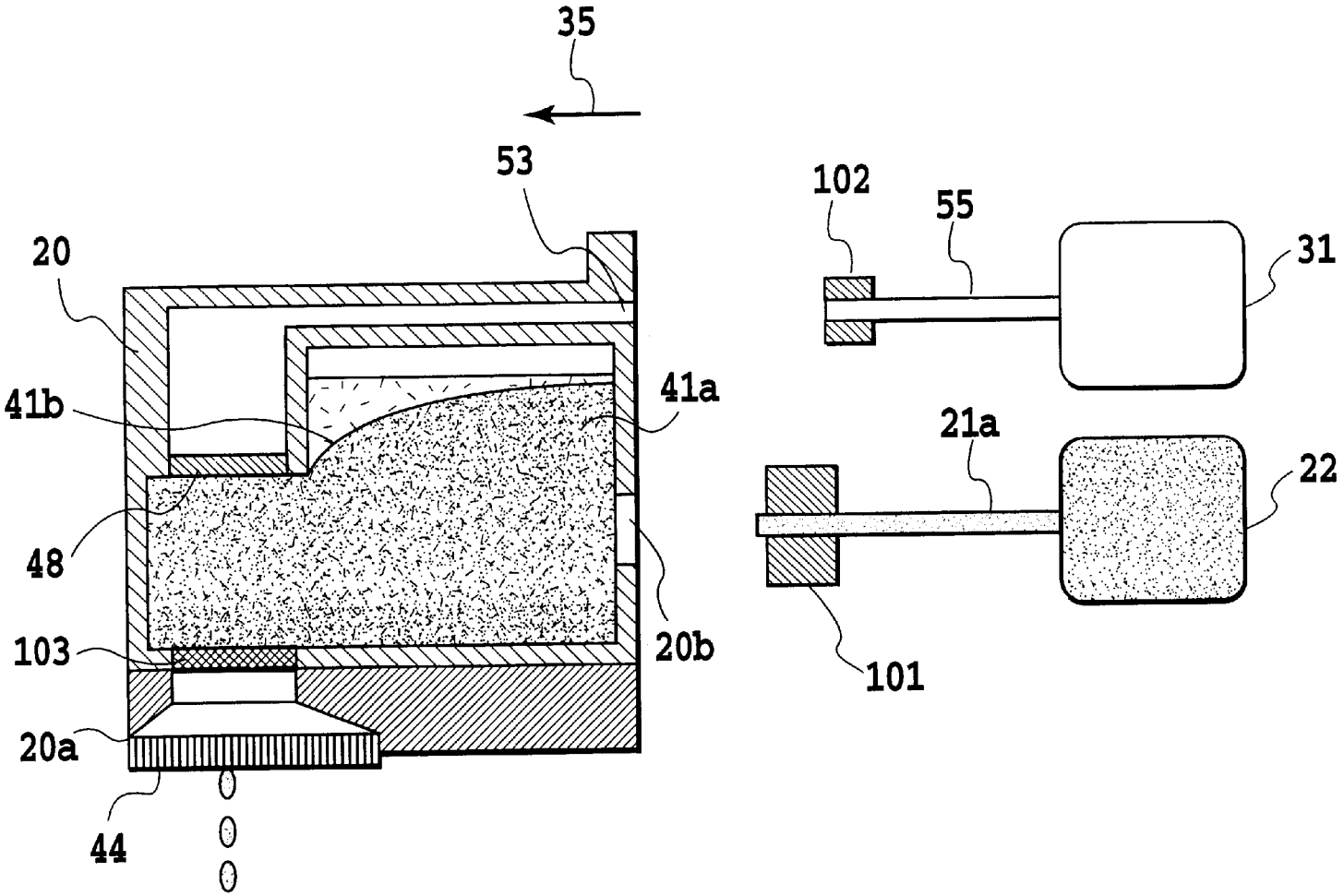
FIG. 17 is an explanation view for illustrating the operation of the ink-supplying system shown in FIG. 12 after completing the supply of ink.

On the occasion of the supply of ink, as shown in FIG. 13, the carrier 19 moves in the direction of the arrow 28 at first and then the ink inlet 20*b* and the general suction port 53 are connected to the associated joints 101, 102. After that, air in the reserve ink tank 20 is absorbed under suction by the suction pump 31 through the gas-permeable member 48, resulting in negative pressure in the reserve ink tank 20. As shown in FIG. 14 and FIG. 15, ink in the supplementary ink tank 22 is absorbed in the inside 41 of the reserve ink tank 20 under suction by the negative pressure in the reserve ink tank. As shown in FIG. 16, furthermore, the supply of ink is automatically stopped when a liquid surface 41*b* of the ink in the reserve ink tank 20 reaches to the gas-permeable member 48 because a liquid such as ink cannot pass through the gas-permeable member 48. After that, as shown in FIG. 17, the ink inlet 20*b* and the general suction port 53 are separated from the associated joints 101, 102 by moving the carriage 19 in the direction of the arrow 35, resulting in the completion of a series of the action of supplying ink.

The Fourth Embodiment

Characteristics and shape of the gas-permeable member 48 to be installed in the reserve ink tank 20 (20Y, 20M, 20C, 20B) may be modified according to the characteristics of ink or the amount of ink to be stored in the reserve ink tank 20 (20Y, 20M, 20C, 20B).

For example, the gas-permeable member 48 may be a porous body having its own varyingly characteristics and shape. In this case, a level of negative pressure to be caused in the reserve ink tank 20 may be varied in accordance with the type of ink to be stored and the ink capacity of the reserve ink tank 20 in which the gas-permeable member 48 is installed. Concretely, the gas-permeable member 48 may be a porous body having its own varyingly pore diameter and thickness. Alternatively, an opening area of a ventilating path 49 in which the gas-permeable member 48 is installed may be varied, while the gas-permeable member 48 may be adopted in size or shaped in accordance with the opening area of the ventilating path 49. The supply rate of ink to each of the reserve ink tanks 20 (20Y, 20M, 20C, and 20B) can be controlled by adjusting a level of negative pressure in the reserve ink tank 20. If the reserve ink tank 20 stores the ink having a large flow resistance or the capacity of the ink tank 20 is comparatively large, an appropriate gas-permeable member 48 is selected to adjust negative pressure in the reserve ink tank 20 to a comparatively large level for efficiently supplying ink to one or more reserve ink tanks 20.

As described above, the characteristics of the gas-permeable member 48 can be appropriately adjusted using parameters such as a pore size and a thickness of the gas-permeable member 48 or an opening area of the ventilating path 49. Also, the materiality (e.g., the air permeability) of the gas-permeable member 48 itself can be made different.

The Fifth Preferred Embodiment

FIGS. 18 to 24 illustrate a fifth preferred embodiment of the present invention.

In this embodiment, the supply of ink begins after the perfect formation of ink meniscus on the ink eject port of the nozzle 44. in the printing head 20*a*. If the action of supplying ink is performed under negative pressure in the reserve ink tank 20 as described in the above embodiments, without the formation of ink meniscus on the ink eject port, there is a possibility of drawing air from the nozzle 44 into the reserve ink tank 20.

For performing the action of supplying ink under negative pressure in the reserve ink tank 20 with more reliability, the present embodiment allows the formation of ink meniscus on the ink eject port by absorbing ink from the nozzle 44 before carrying out the supply of ink. Therefore, the supply of ink can be performed with more reliability by effectively using negative pressure in the reserve ink tank 20.

Figure 18:
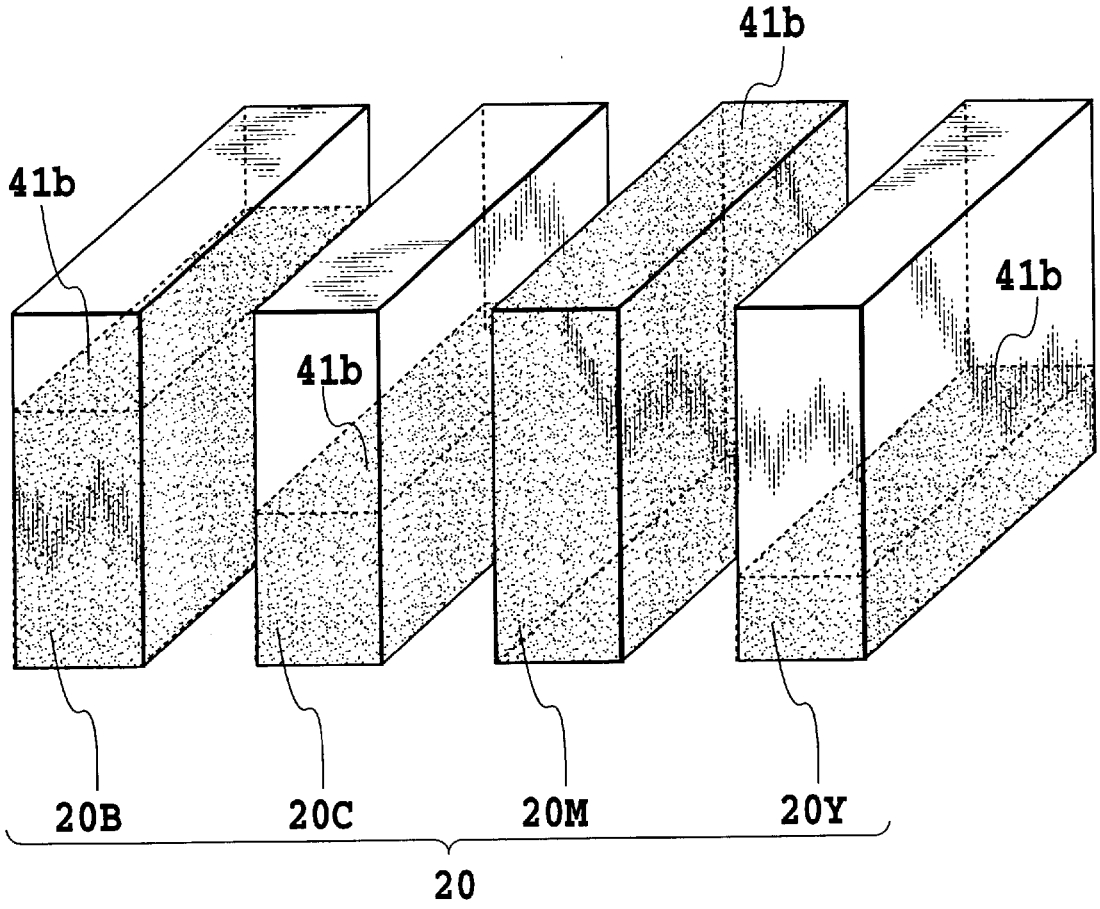
FIG. 18 is a schematic perspective view of the reserve ink tank in accordance with the fifth embodiment of the present invention.
Figure 19:
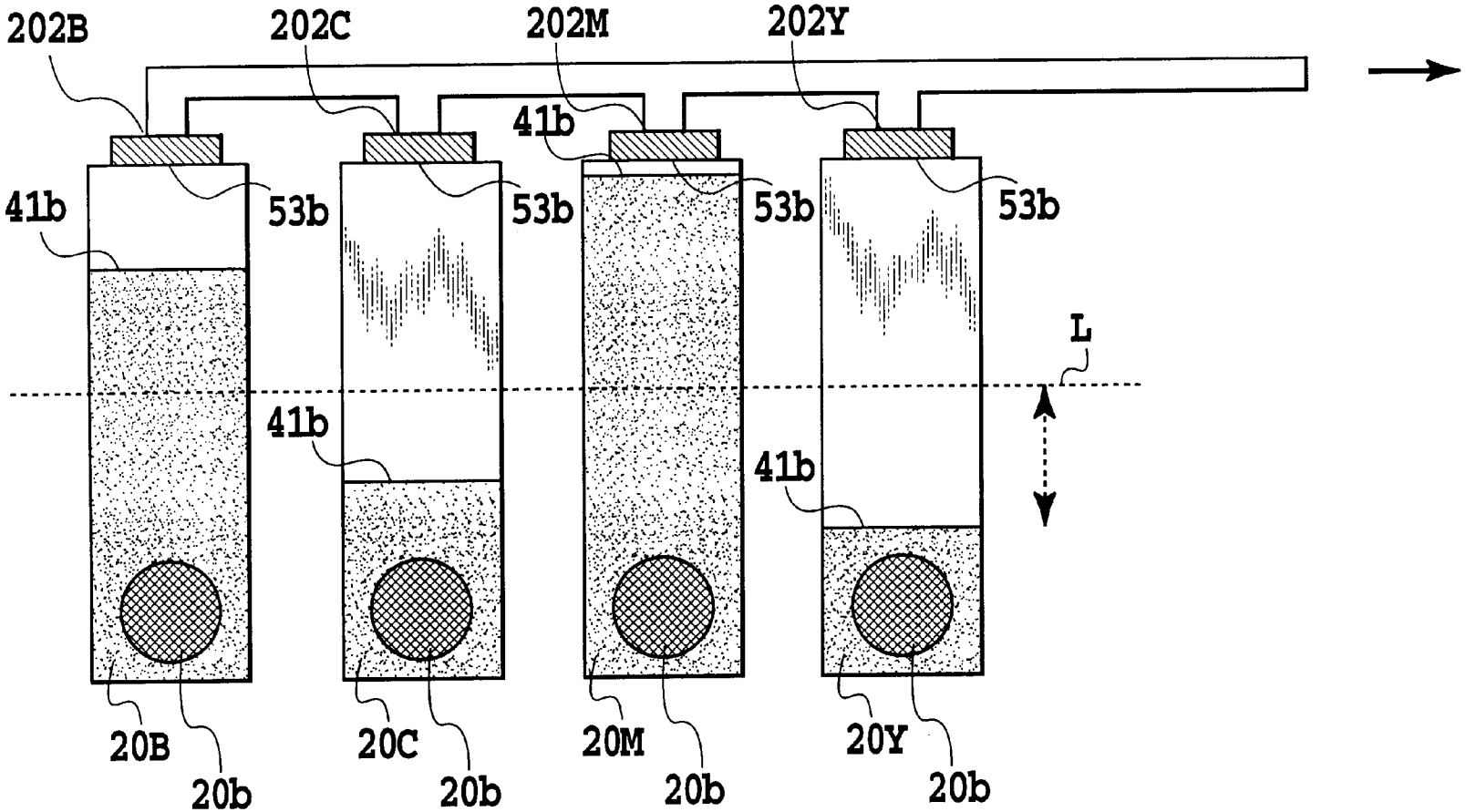
FIG. 19 is an explanation view of the air-suction system to be connected to the reserve ink tank shown in FIG. 18.

In the present embodiment, as shown in FIG. 19, an ink inlet 20*b* and a suction port 53*b* are formed on each of the reserve ink tanks 20Y, 20M, 20C, and 20B shown in FIG. 18. The reference numeral 201 (see FIG. 20) denotes supply joints connectable to the respective ink inlets 20*b* of the reserve ink tanks 20 (20Y, 20M, 20C, and 20B). These supply joints 201 are connected to an ink-supplying system in the same way as those of described in the embodiment described above. The reference numeral 202 denotes each of suction joints connectable to each suction port 53*b*. The suction joints 202 are gathered together into the suction way and then connected to the suction system in the same way as that of the embodiment described above.

The letter "L" in FIG. 19 represents a detection reference level with reference to a level 41*b* of ink. The action of supplying ink is performed when the level 41*b* of ink in at least one of the reserve ink tanks 20 is lower than the level "L" by a predetermined degree. An electric level sensor or an optical level sensor may be used as a means for detecting a level 41*b* of ink. The electric level sensor detect the level 41*b* due to the existence of ink between electrodes placed in the reserve ink tank 20.

Figure 24:
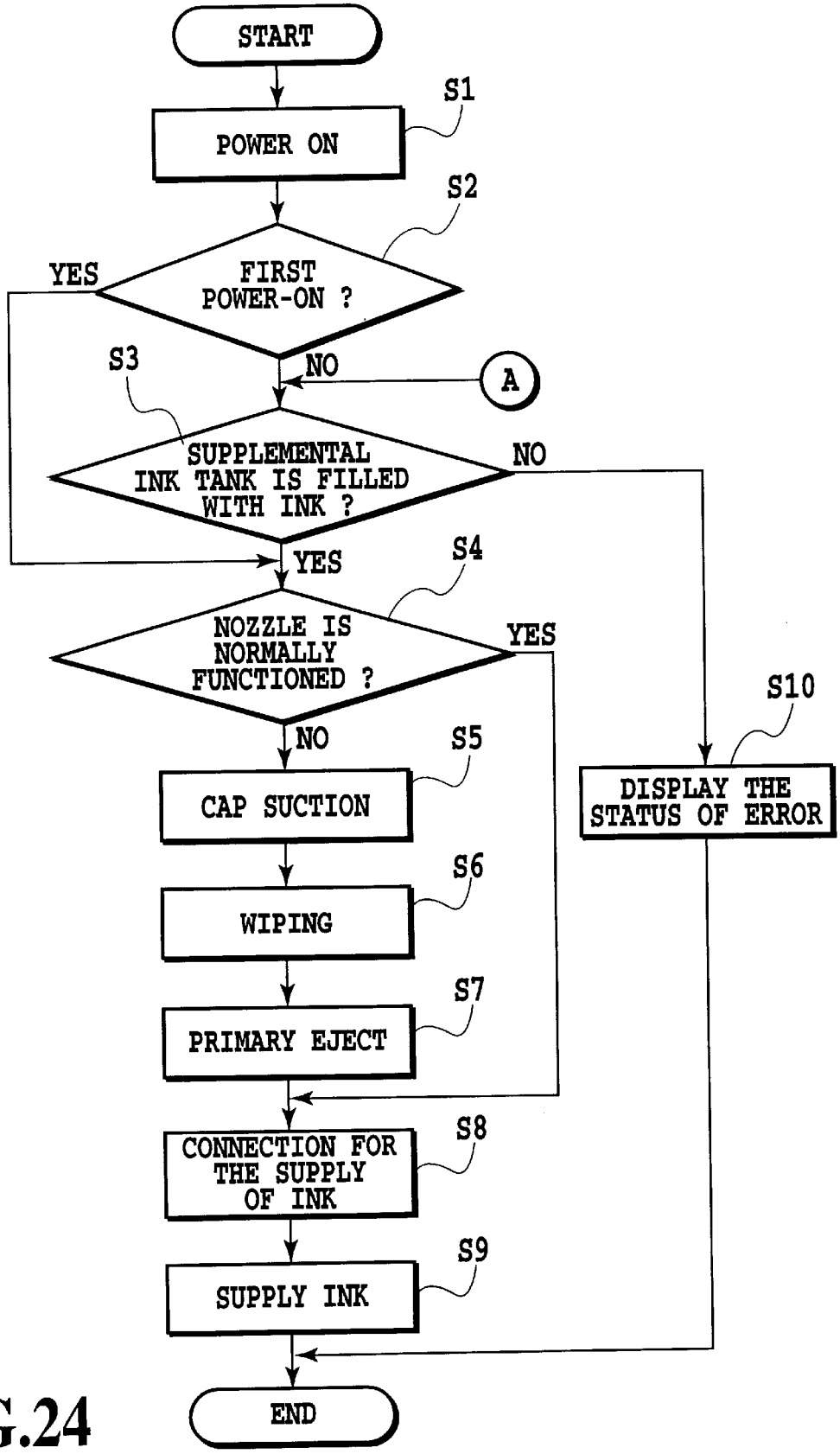
FIG. 24 is a flow chart for illustrating the operation of supplying ink to the reserve ink tank shown in FIG. 18.

FIG. 24 is a flow chart for illustrating the action of supplying ink at the time of turning on the power of the printing apparatus.

After powering on (step S1), it is judged whether it was the first switched on of the printing apparatus. If it was not the first switched on, it is judged whether the remaining amount of ink in the supplementary ink tank 22 is sufficient (step S2). If the remaining amount of ink is not sufficient, an error message appears on a display means (step S10). The operation is completed. If it was the first switched on and the remaining amount of ink in the supplementary ink tank 22 is sufficient, it is judged whether nozzles 44 are in the normal condition (i.e., whether ink meniscus is formed on each ink eject port) (step S4).

The above judgements may be performed by one of various sensors including an optical sensor, an acoustic sensor, a reading sensor, and a temperature sensor. The optical sensor allows an optical detection of each ink droplet to make a judgement on whether the ink droplets were ejected from all nozzles 44 at the time of actuating the printing head 20*a*. The acoustic sensor allows the detection of a sound to be caused when each ink droplet touches its own predetermined point on the printing medium. In those cases, ink droplets may be simultaneously ejected from all nozzles 44, or ejected form a group of the nozzles 44 grouped into one or more groups. The reading sensor may be used to read out a printed image prepared by printing a predetermined test pattern on the printing medium by ejecting ink droplets from all nozzles 44. The temperature sensor may be used to detect the change in temperature which corresponds to the presence or absence of ink in the nozzle 44 when the printing head 20*a* ejects ink droplets through the use of thermal energies to be caused by electrothermal converter. Furthermore, the optical sensor may be also used to detect a reflectivity of light in response to the presence or absence of ink in the ink eject ports to eliminate the need for ejecting ink from the printing head 20*a*. Any of the sensors described above may be used to confirm whether ink meniscus is formed on the ink eject port by the action of absorbing ink using a cap member as described later.

Figure 20:
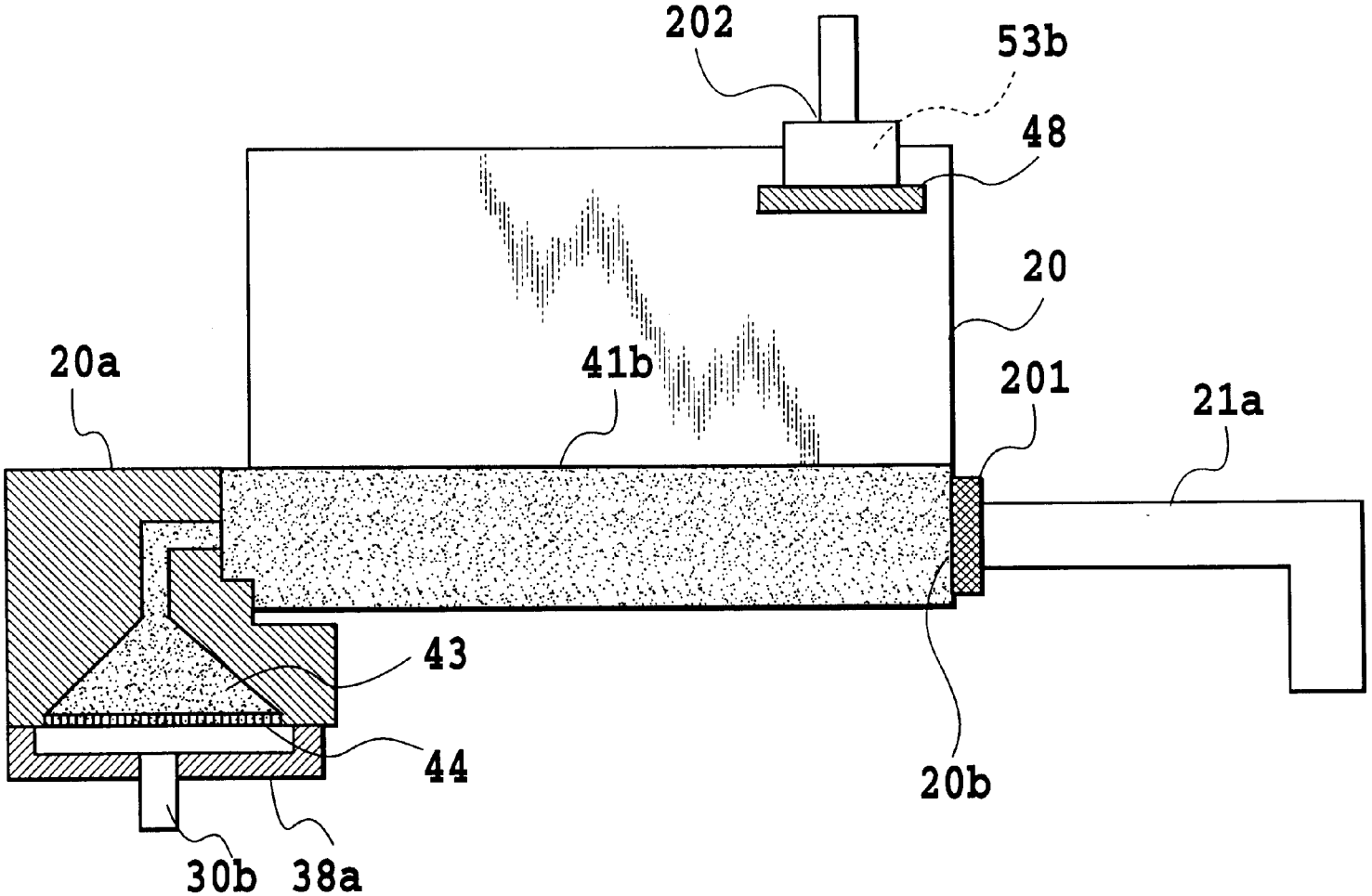
FIG. 20 is an explanation view for illustrating the operation of supplying ink to the reserve ink tank shown in FIG. 18 when the meniscus is formed on an ink eject port.
Figure 21:
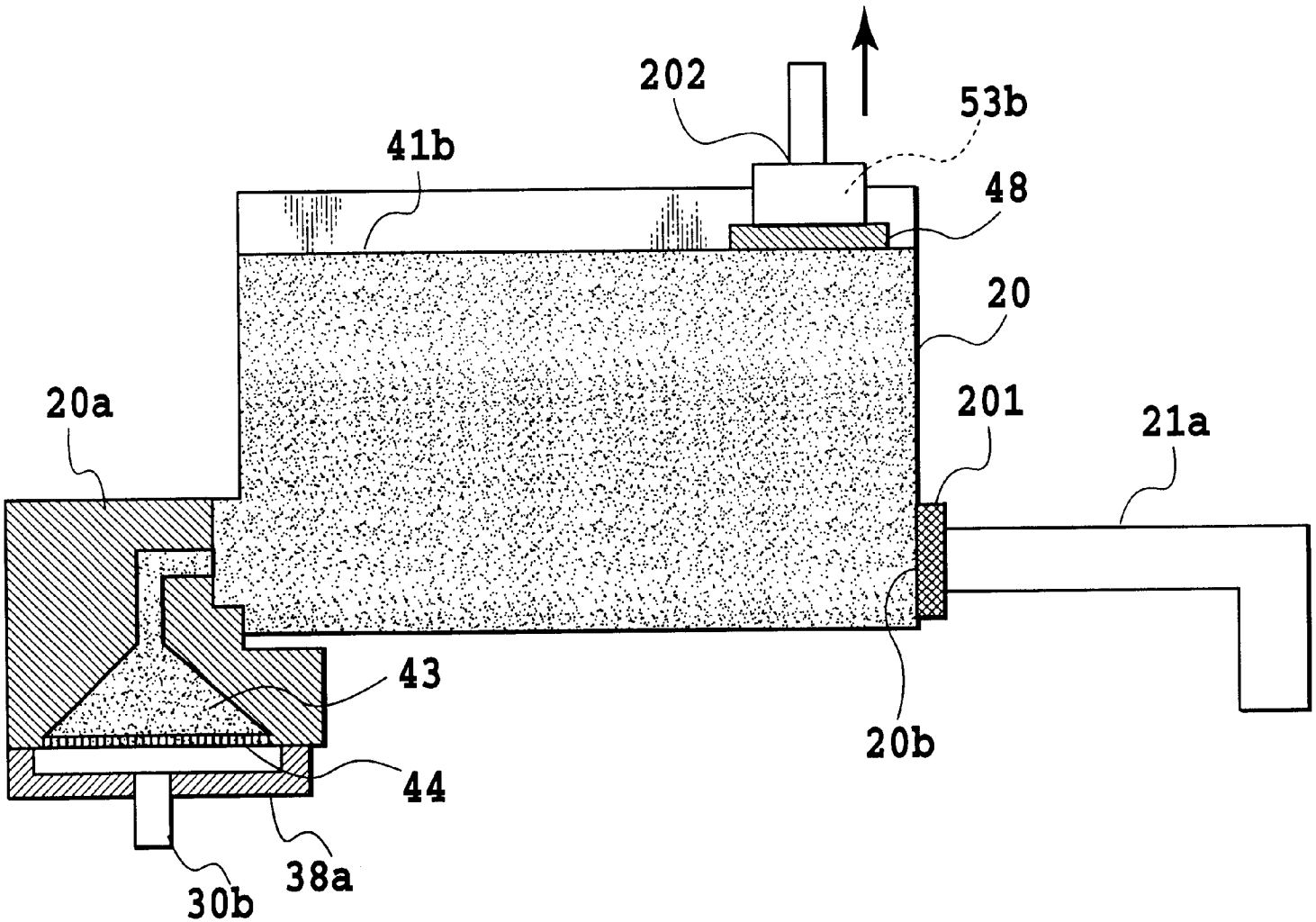
FIG. 21 is an explanation view for illustrating the operation of supplying ink to the reserve ink tank shown in FIG. 18 when the meniscus is formed on an ink eject port.

When the meniscus of ink is normally formed on the ink eject port, as shown in FIG. 20, the connection for the ink supply is established (step S8). After that, the action of supplying ink is performed as shown in FIG. 21 (step S9), where ink is supplied from the ink inlet 20*b* to the reserve ink tank 20 by absorbing the reserve ink tank 20 through the suction joint 202.

Figure 22:
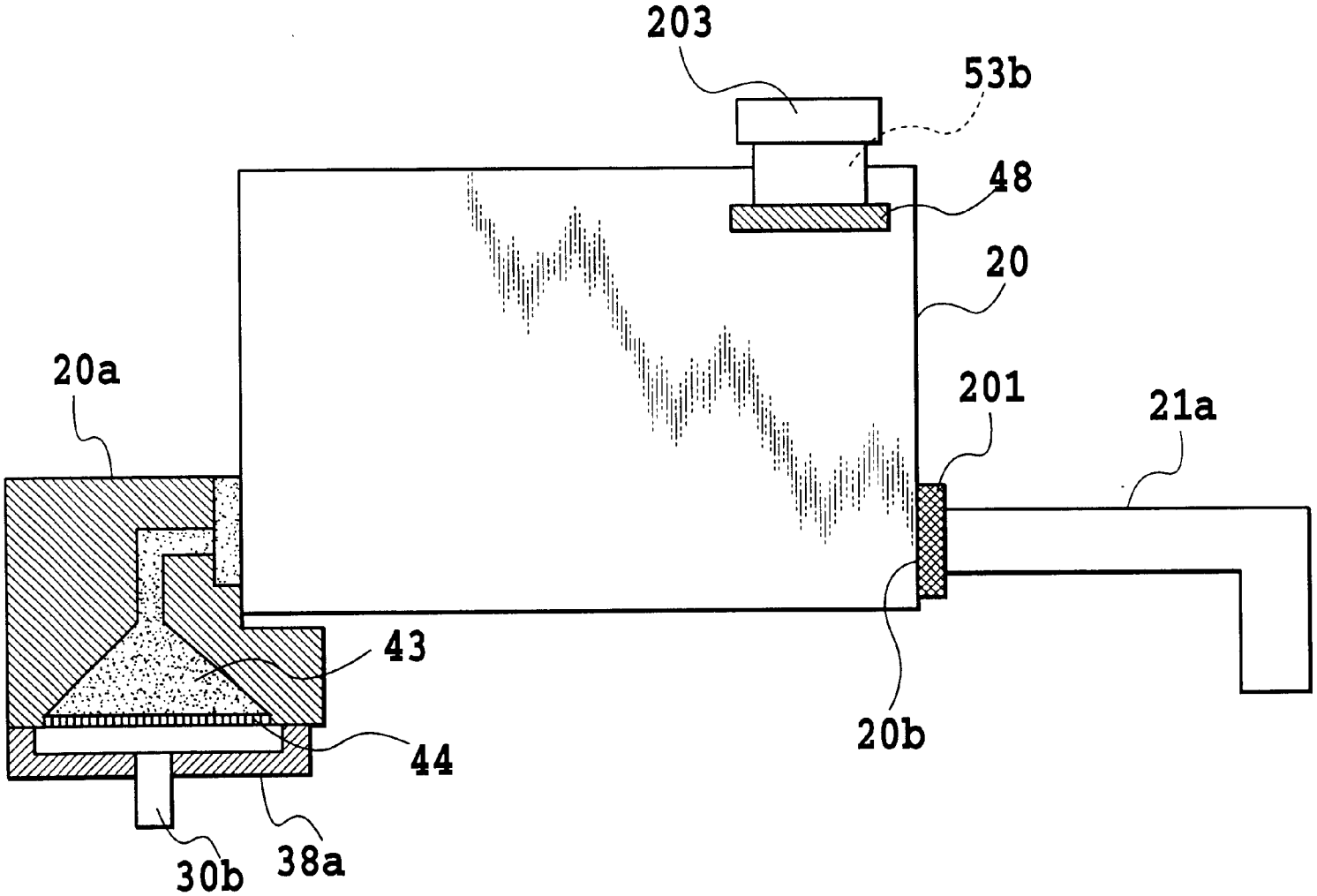
FIG. 22 is an explanation view for illustrating the operation of supplying ink to the reserve ink tank shown in FIG. 18 when the meniscus is not formed on an ink eject port.
Figure 23:
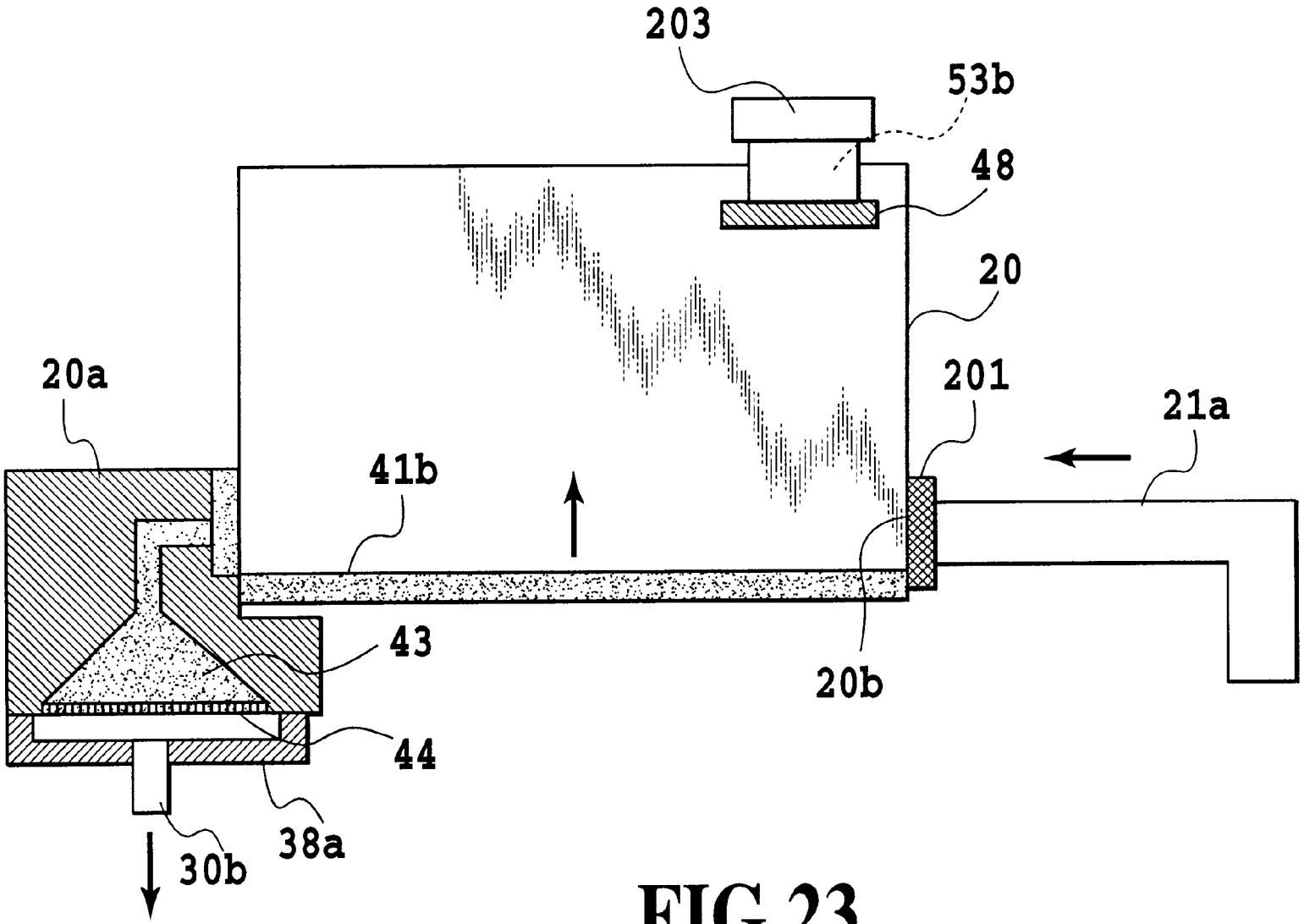
FIG. 23 is an explanation view for illustrating the operation of supplying ink to the reserve ink tank shown in FIG. 18 when the meniscus is not formed on an ink eject port.

On the other hand, when the meniscus of ink is not formed normally as shown in FIG. 22, the suction port 53 is closed by the cap member 203 in addition to set the supply joint 201 and the cap member 38*a* as shown in FIG. 22. After that, as shown in FIG. 23, the inside of the cap member 38*a* is sucked (step S5), thereby, ink is introduced into the reservoir ink tank 20 and the printing head 20*a* through the inlet 20*b* to form the meniscus of ink on the ink eject port. Subsequently, the printing head 20*a* is wiped by a wiping member (not shown) (step S6) and then the printing head 20*a* ejects ink that does not contribute to the image printing (i.e., a primary eject) (step 7). In the primary eject, ink may be ejected in the cap member 38*a*. The printing apparatus starts the supply of ink (step S9) after performing the recovery procedure by the steps of the cap suction (step S5), the wiping (step S6), the primary eject (step S7), and the connection for the ink supply (step S8).

During the printing movement of the printing apparatus, furthermore, the printing apparatus may skip the steps S1–S2 to start the process from the step S3 as indicated by the arrow "A" in FIG. 24 when the remaining amount of ink in the reserve ink tank 20 decreases to less than a predetermined level. The remaining amount of ink in the reserve ink tank 20 can be estimated by counting the number of ejecting ink, detecting a level of ink in the reserve ink tank 20, or the like.

In addition, the printing apparatus of the present embodiment has the gas-permeable member 48 on each suction port 53*b*, so that the supply of ink is automatically stopped when the ink level 41*b* reaches to the gas-permeable member 48 in the same way as that of the embodiment described above.

The Sixth Preferred Embodiment

In the fifth preferred embodiment, the step of supplying ink (step S9) may be followed by the step of cap suction or the step of primary eject to be performed just as is in the case of the step S5 or the step S7, respectively.

In this case, immediately following the supply of ink, ink is drained from the nozzles 44 under suction or ejected as a primary eject. Thus, the ink level 41*b* in the reserve ink tank 20 decreases as the amount of ink decreases. As a result, the ink level 41*b* leaves the gas-permeable member 48 to prevent that the performance of the gas-permeable member 48 is decreased by the long contact with ink. Furthermore, a pressure in the reserve ink tank 20 following the supply of ink is appropriately adjusted, so that ink meniscus can be formed on the nozzle 44 with reliability. Such an effect can be obtained irrespective of whether the ink absorber for absorbing ink is placed in the reserve inktank 20. In particular, it is effective when the level 41*b* of ink that is not retained by the ink absorber touches the gas-permeable member 48. Because, the level 41*b* of ink immediately down by ejecting ink from nozzles 44 under suction or ejecting ink as the primary eject. Furthermore, ink can be also drained from the nozzle 44 under pressure by applying pressure in the reserve ink tank 20.

The Seventh Preferred Embodiment

Figure 25:
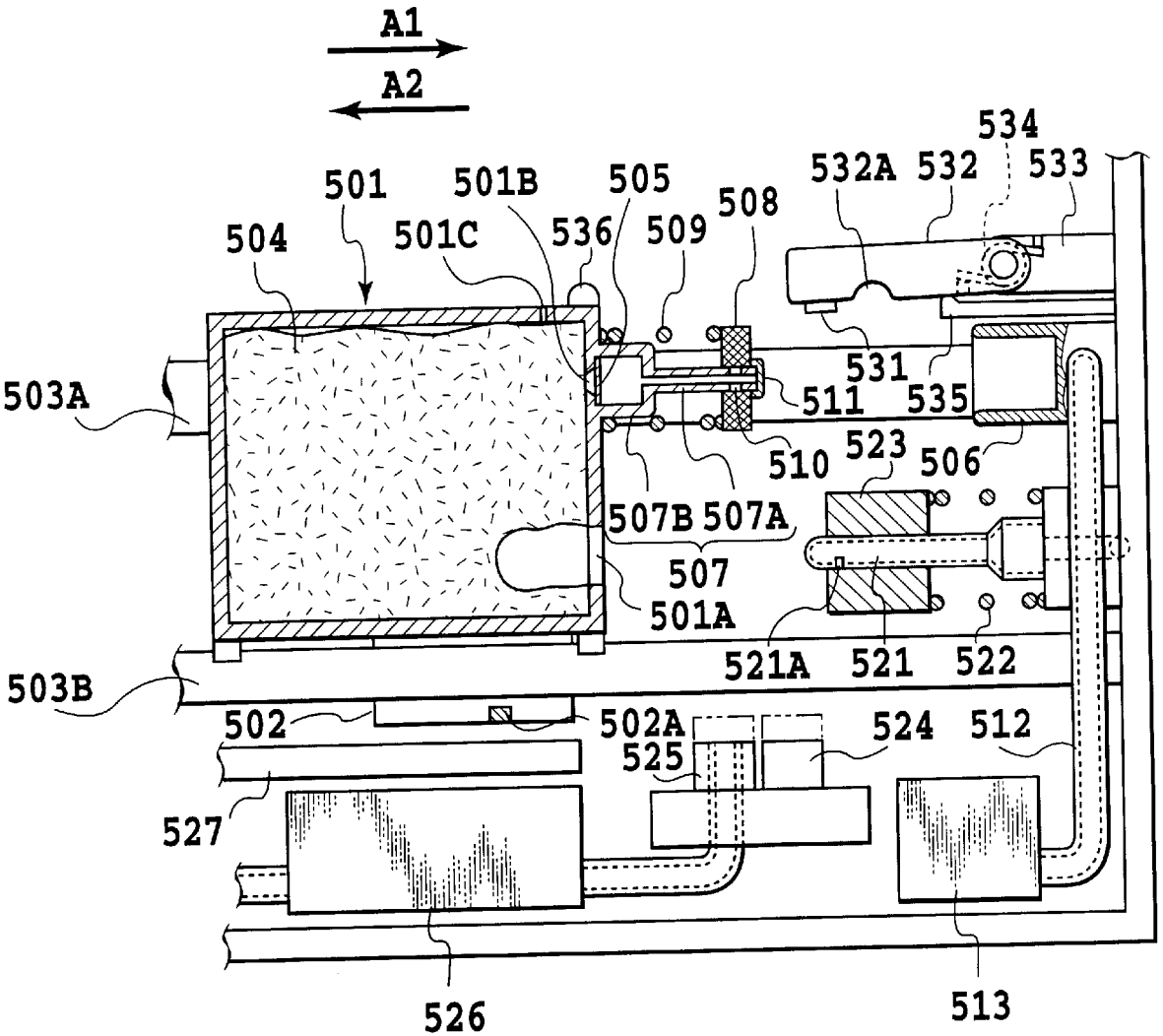
FIG. 25 is a cross sectional view of a main part for illustrating the seventh embodiment of the present invention.
Figure 26:
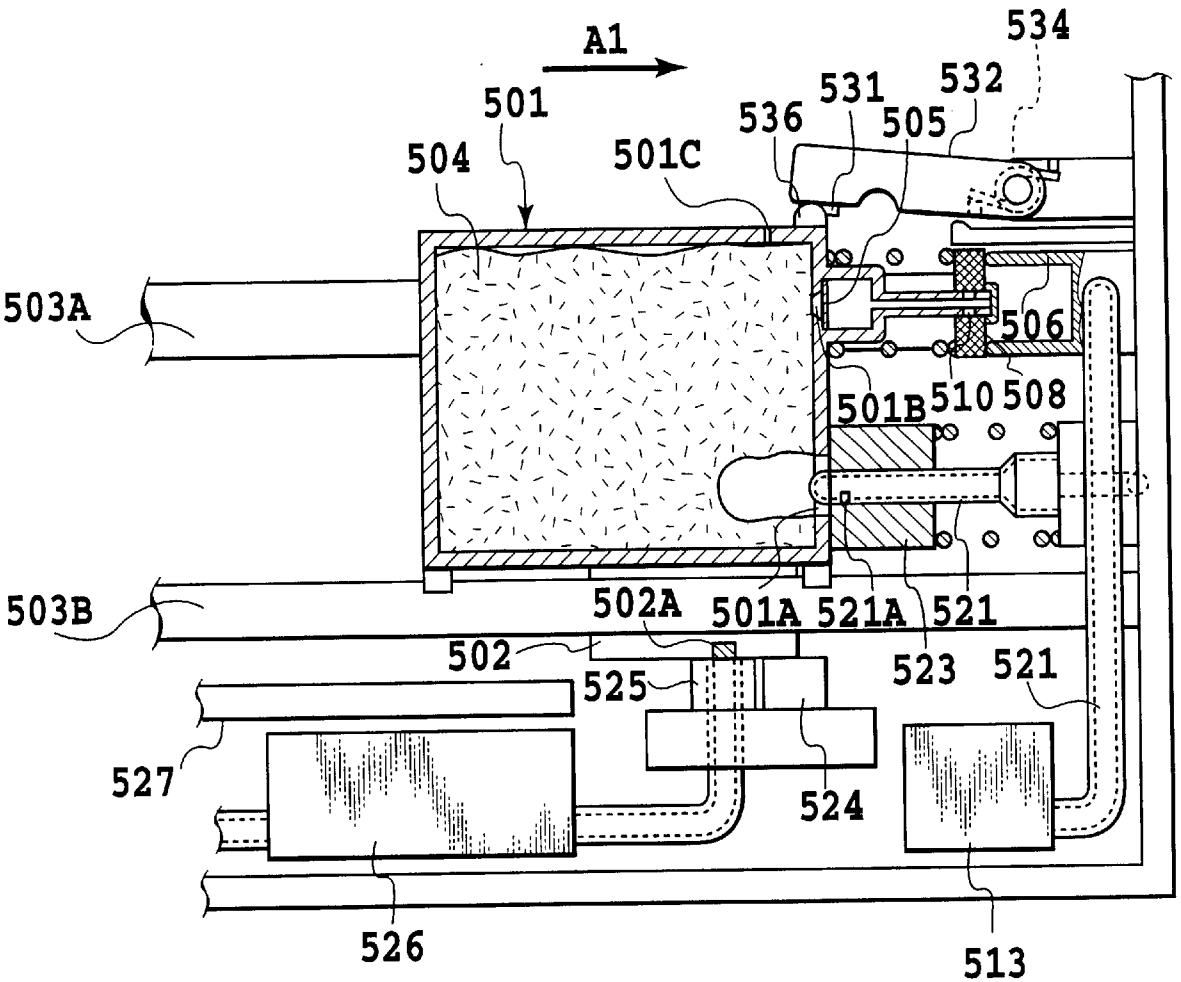
FIG. 26 is an explanation view for illustrating the condition of the printing head of FIG. 25 being capped.
Figure 27:
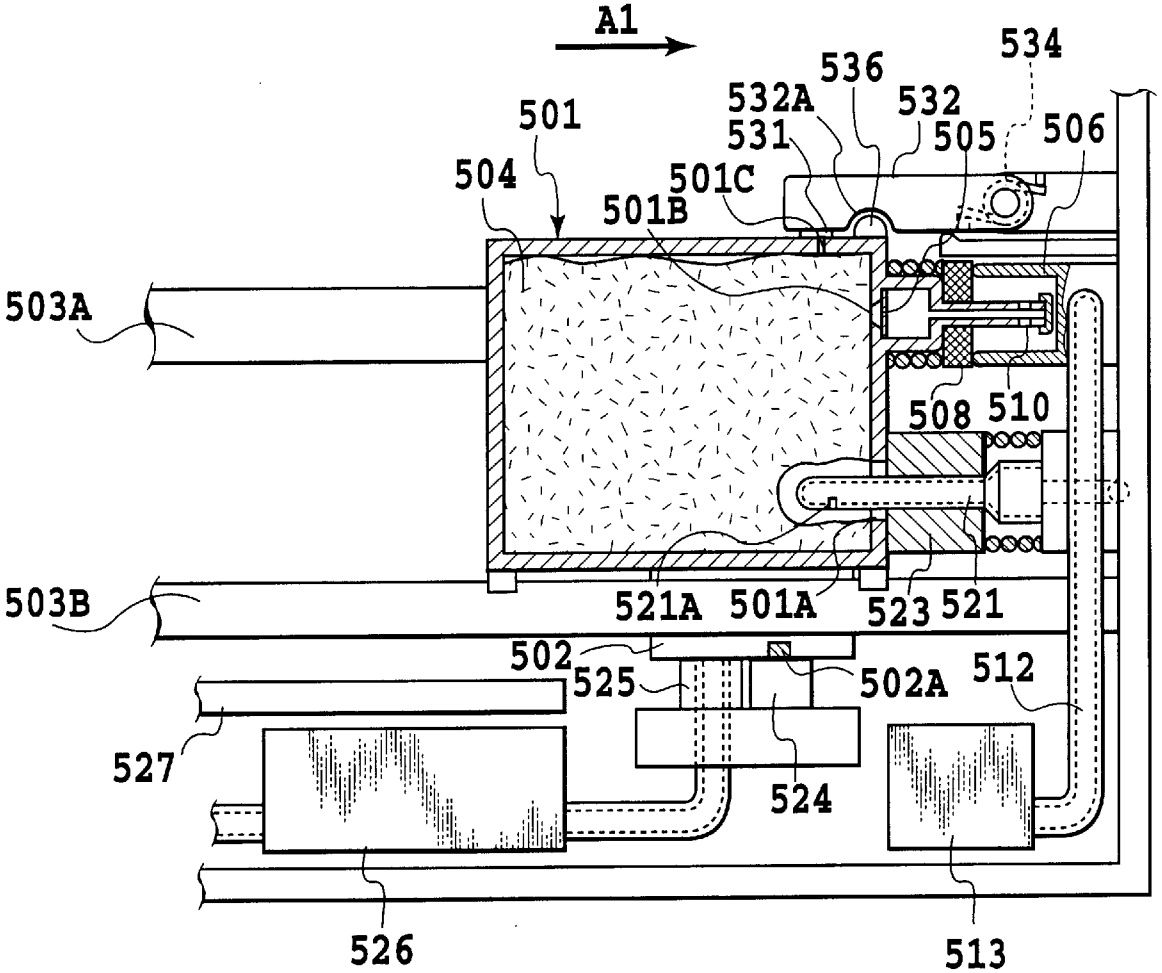
FIG. 27 is an explanation view for illustrating the condition of supplying ink to the sub-tank shown in FIG. 25.

FIGS. 25 to 27 illustrate a seventh preferred embodiment of the present invention.

In FIG. 25, the reference numeral 501 denotes a sub ink tank (hereinafter, also referred to as a sub-tank); and 502 denotes a printing head that is able to eject ink from a nozzle portion 502, where the ink is supplied from the sub-tank 501, which are configured to move along guide shafts 503A, 503B in the main scanning direction (i.e., the direction of the arrow A1 or A2). The sub-tank 501 comprises an ink inlet 501A, a suction port 501B, an air-communicating port 501C, and a communicating port (not shown) for communicating with the printing head 502. In addition, an ink absorber 504 is provided for retaining ink by absorption and installed in the sub-tank 501. The suction port 501B is conical in cross section with a gradual increase in diameter outwardly. A gas-permeable member 505 is placed on the external side of the suction port 501B. The gas-permeable member 505 is provided as a means for separating gas and liquid. The gas-permeable member 505 may be of a thin-sheet type and made of a tetrafluoride ethylene resin or other porous resin materials.

Furthermore, a hollow-projection portion 507 formed on the outside of the suction port 501B. The hollow-projection portion 507 can be inserted into a cap member 506 on the side of a main body of the printing apparatus. In addition, a seal member 508 fits over a small-diameter portion 507A on the tip side of the projection portion 507 so that the seal member 508 is able to slide over a small-diameter portion 507A. On the other hand, a spring 509 that pushes the seal member 508 rightward is fit over a large-diameter portion 507B on the base side of the projection portion 507. A through hole 510 is formed on the peripheral surface of the small-diameter portion 507A, which is opened or closed by the seal member 508. The tip of the small-diameter portion 507A is closed by a cap member 511. The cap member 511 is also configured to function as a stopper that prevents the seal member 508 from becoming disengaged. The cap member 506 is connected to a suction pump 513 through a suction conduit 512.

The reference numeral 521 denotes a hollow-projection member formed on the side of the main body of the printing apparatus. A seal member 523 is able to fit over the outer peripheral surface of the projection member 521 and pushed leftward by the force of a spring 522 so as to slide thereon. A through hole 521A is formed on the peripheral surface of the protrusion member 521, which is opened or closed by the seal member 523. The tip of the protrusion member 521 is formed as a closed end, while the base side thereof is connected to a main ink tank (hereinafter, also referred to as a main-tank).

The reference numerals 524 and 525 denote first and second cap members that are provided on the side of the main body of the printing apparatus. These cap members 524, 525 are able to move up and down. In addition, the second cap member 525 is connected to a waste ink tank (not shown) through a suction pump 526. The reference numeral 527 denotes a platen for guiding a printing medium to a printing position where an image formation is performed by the printing head 502. The printing medium is fed by a feeding mechanism (not shown) in the sub-scanning direction that crosses with the main-scanning direction. Every part of the image is formed successively on the printing medium by repeating the printing movement of the printing head in the main-scanning direction while ejecting ink and the feeding movement of the printing medium in the sub-scanning direction.

The reference numeral 531 denotes a seal member which is able to close the gas-communicating port 501C of the sub-tank 501. The seal member 531 is mounted on the tip portion of an arm member 532. A base portion of the arm member 532 is by a support member 533 so as to turn up and down and downwardly spring-loaded by a spring 534, where the support member 533 is placed on the side of the main body of the printing apparatus. The reference numeral 535 denotes a stopper member that regulates the position of downward movement of the arm member 532. The reference numeral 536 denotes a projection portion formed on the main-tank 501. The projection portion 536 actuates the arm member 532 up and down in response to the location of the sub-tank 501 being moved. The arm member 532 has a recess 532A in which the projection portion 536 can be slipped.

During the printing movement, the printing head 502 is initially located in the moving range on the left side from a home position (see FIG. 26) and then moves in the direction of the arrow A1 or A2 while printing an image by ejecting ink.

If the printing head 502 reaches to the home position, both the first and second cap members 524, 525 are raised as shown in FIG. 26. As a result, the nozzle portion 502A of the printing head 502 is capped by the second cap member 525. At this time, the seal member 523 closes the ink inlet 501A while keeping the through hole 521A of the projection member 513 in a closed state. In addition, the seal member 508 closes an opening of the cap member 506 while keeping the through hole 510 of the projection portion 507 in a closed state. The printing head 502 being located on the home position is subjected to the recovery procedure in which the printing head 502 discharges ink that is not used in the process of printing an image, so that the condition of ejecting ink can be kept in a favorable condition. The recovery procedure includes the process of sucking and draining ink and the process of ejecting the ink. The process of sucking and draining ink comprises the step of forcing ink out of the ink eject port of the nozzle portion 502A under suction by causing negative pressure in the second cap member by the suction pump 526. The process of ejecting ink comprises the step of ejecting ink from the ink eject port of the nozzle portion 502A into the second cap member 525.

During the action of supplying ink, as shown in FIG. 27, the printing head 502 moves from the home position to the ink-supplying position in the direction of the arrow A1. If the printing head 502 arrives at the ink-supplying position, as shown in FIG. 27, both the first and second cap members 524, 525 are raised, and then the nozzle portion 502A of the printing head 502 is capped by the first cap member 524. As a result, the cap member 524 seals the ink eject port of the nozzle portion 502A. At this time, as shown in FIG. 26, the seal member 523 opens the through hole 521A by its relative movement with reference to the projection member 521 while keeping the ink inlet 501A in a closed state. The through hole 521A forms an ink-supplying system between the sub-tank 501 and the main-tank by communicating the through hole 521A with the inside of the sub-tank 501. In addition, the seal member 508 opens through hole 510 by its relative movement with reference to the projection portion 507 while keeping the opening of the cap member 506 in a closed state. Furthermore, a suction system between the suction port 501B and the suction pump 513 is formed by communicating the through hole 510 with the inside of the cap member 506. The gas-permeable member 505 lies in the suction system. In addition, the seal member 531 closes the air-communicating port 501C by actuating the arm member 532 upward at first and then actuating it downward.

On the occasion of the supply of ink, air in the sub-tank 501 is aspirated by the suction pump 513 through the gas-permeable member 505 to discharge the air into a liquid waste container (not shown), causing negative pressure in the sub-tank 501. Thus, ink in the main-tank is introduced into the sub-tank 501 under suction by an effect of the negative pressure. The ink flowing in the sub-tank 501 permeates the ink absorber 504, so that a level of ink rises as the permeation of ink proceeds. The rising rate of the level of ink depends on the suction force of the suction pump 513, so that it is adjusted to an appropriate rate corresponding to the degree of actuating the suction pump 513. If the level of ink reaches to the gas-permeable member 505, the supply of ink is automatically stopped because liquid such as ink cannot pass through the gas-permeable member 505.

After completing such an action of absorbing ink, the printing apparatus to its original state as shown FIG. 26 or FIG. 25 by returning the printing head 502 to its home position or its position of starting the printing movement.

By the way, the gas-permeable member 505 and the ink absorber 504 are separated by the space of the suction port 501B, so that they do not contact to each other. If the gas-permeable member touches ink for a long time, the functions of the gas-permeable member might decrease. In this embodiment, however, there is the space between the gas-permeable member 505 and the ink absorber 504, so that the gas-permeable member 505 does not touch to ink except when the supply of ink is performed. Consequently, the functional decline of the gas-permeable member can be prevented.

Furthermore, an inner surface of the suction port 501B is inclined, so that the ink that has arrived in the suction port 501B at the time of supplying ink is promptly exhausted along the inner surface of the suction port 501B after completing the action of supplying ink. Therefore, the duration of contact between the gas-permeable member 505 and the ink can be minimized inescapably. In this embodiment, an inner bottom surface of the suction port 501B is inclined downward on the right in FIG. 25, so that ink tends to be easily discharged to the outside of the sub-tank 501. If the inner bottom surface of the suction port 501B is inclined downward on the left in FIG. 25, ink tends to be easily discharged to the inner side of the sub-tank 501. Ink in the suction port 501B can be smoothly discharged therefrom when the inner side of the suction port 501B is subjected to water-repellent finishing.

As the through hole 510 is closed by the seal member 508 except when the suction of ink is performed, furthermore, the thickening of ink in the main-tank 501 in addition to the depositing of ink on the suction port 501B and the gas-permeable member 505 can be prevented.

The Eighth Preferred Embodiment

Figure 28:
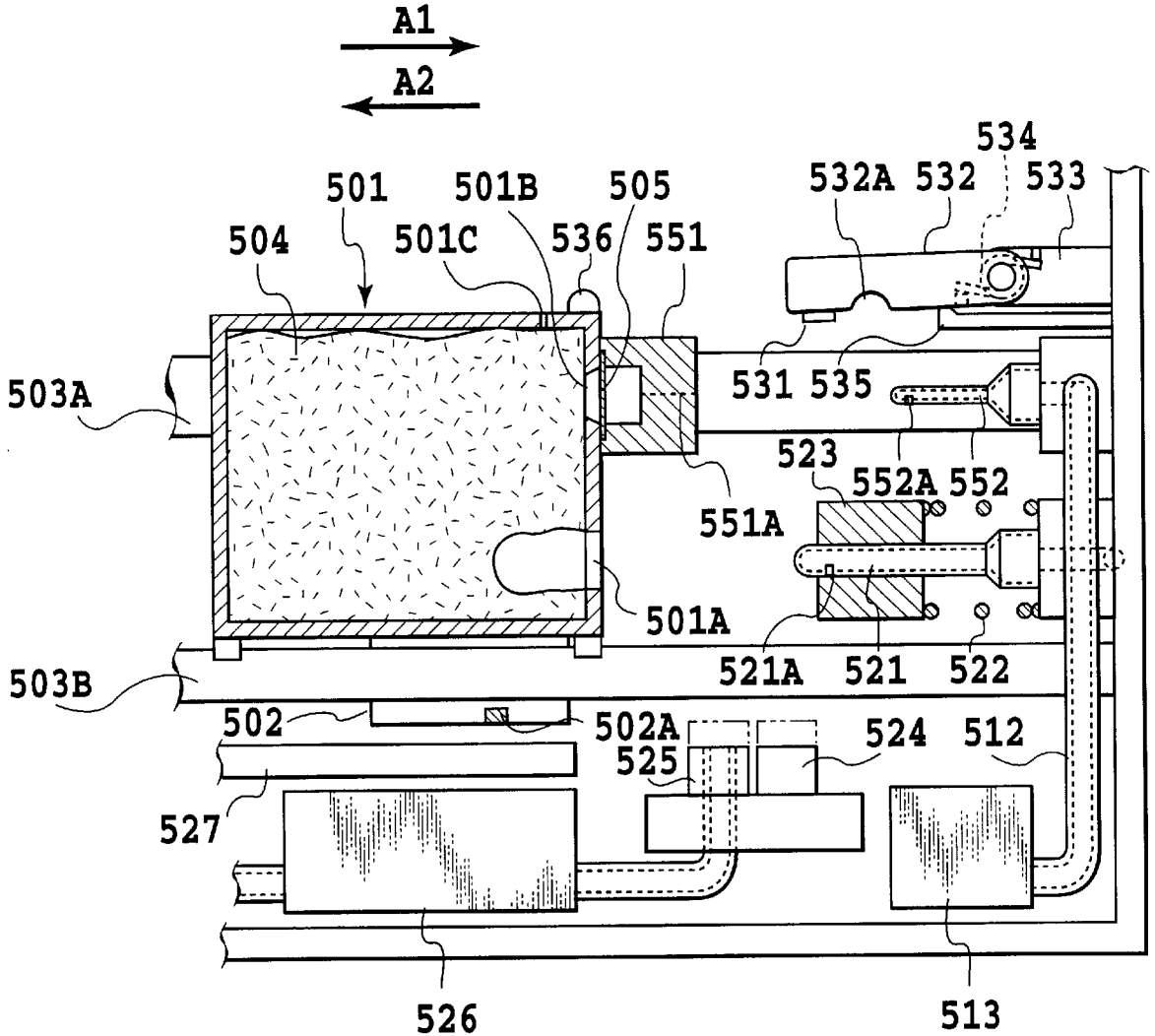
FIG. 28 is a cross sectional view of a main part for illustrating the seventh preferred embodiment of the present invention.
Figure 29:
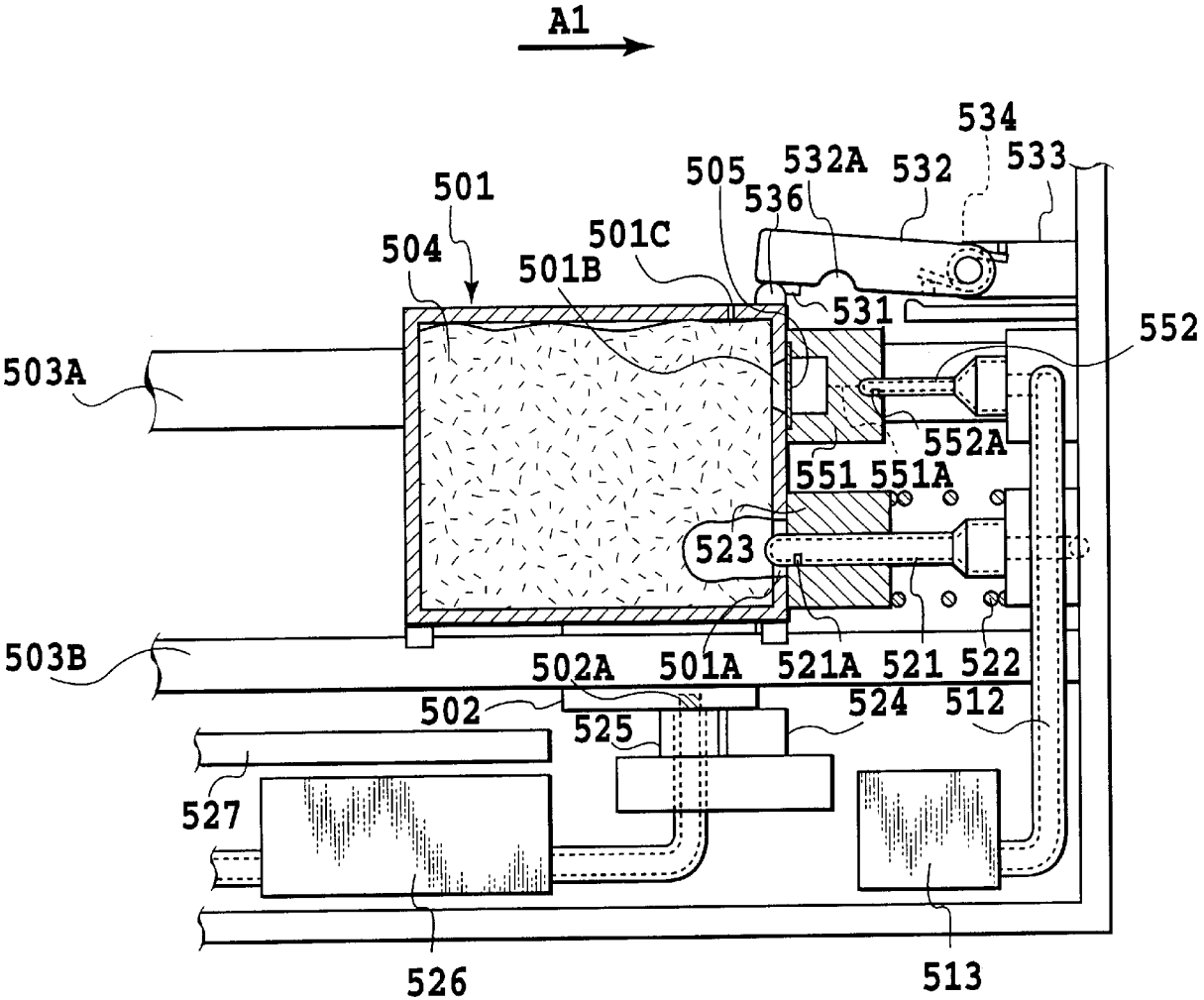
FIG. 29 is an explanation view for illustrating the condition of the printing head of FIG. 28 being capped.
Figure 30:
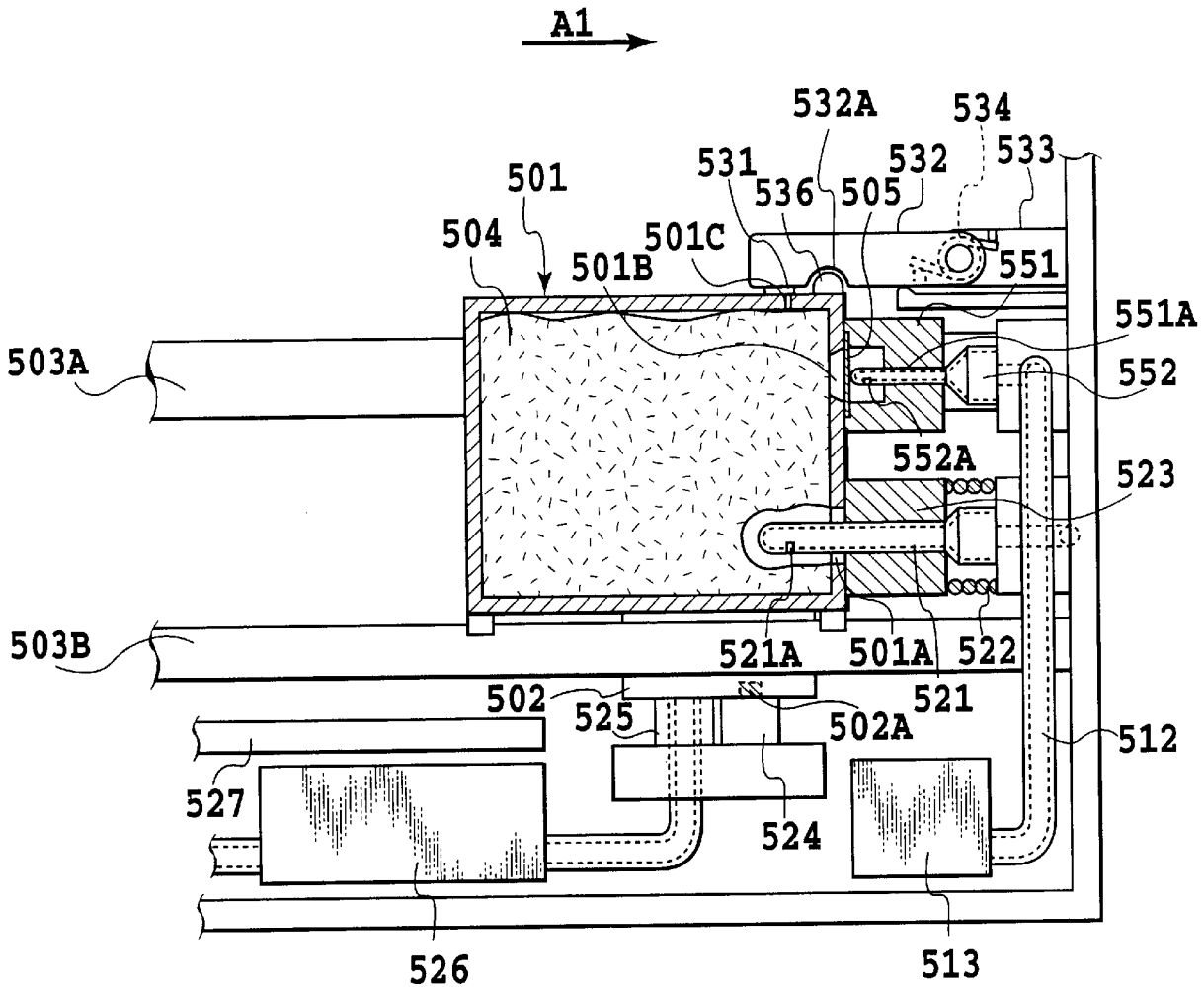
FIG. 30 is an explanation view for illustrating the condition of supplying ink to the sub-tank shown in FIG. 28.

FIGS. 28 to 30 illustrate an eighth preferred embodiment of the present invention. An explanation for the same reference numerals as those of the seventh preferred embodiment will be omitted in the following description.

In the present embodiment, an elastic cap member 551 is formed on the outside of the suction port 501B of the sub-tank 501 and a hollow projection member 552 is formed on the body's side of the printing apparatus. In addition, a notched portion 551A that permits the penetration of the projection member 552 is formed on the cap member 551. A suction tube 512 communicates with a cavity of the projected member 552, while the tip of the projected member 552 has a through hole 552A opening into the cavity thereof.

During the printing movement, as shown in FIG. 28, the notched portion 551A is closed by the elastic force of the cap member 551. Therefore, the suction port 501B is also closed by the cap member 551. If the printing head 502 moves to its home position, as shown in FIG. 29, the tip of the projected member 552 enters into the notched portion 551A of the cap member 551 by force and the elastic restoring force of the cap member 551 closes the through hole 552A.

For the supply of ink, as shown in FIG. 30, the tip of the projected member 551 penetrates the notched portion 551A of the cap member 551 when the printing head 502 moves to the ink-supplying position. Consequently, the through hole 552A communicates with the inside of the cap member 551 to form a suction system between the suction port 501B and the suction pump 513. The gas-permeable member 505 lies in the suction system.

The Ninth Preferred Embodiment

FIGS. 31A, 31B, and 31C, and FIGS. 32A, 32B, and 32C illustrate different suction ports 501B as modifications of the seventh and eighth embodiments described above, respectively.

Figure 31A:
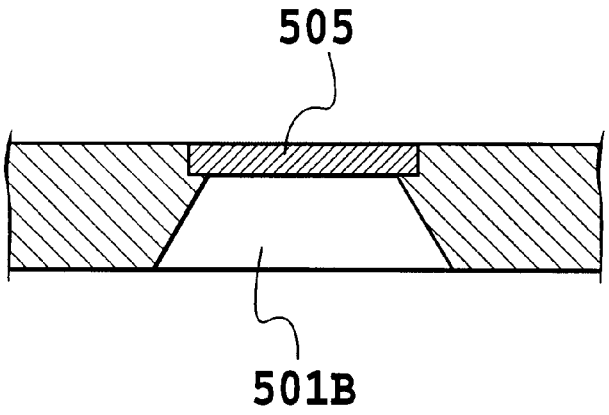
FIGS. 31A, 31B, and 31C are schematic cross sectional views of different configurations of the suction port for the sub-tank shown in FIGS. 25 and 28.
Figure 31B:
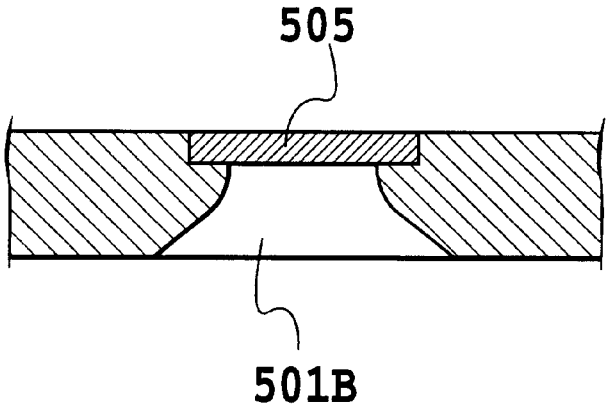
Figure 31C:
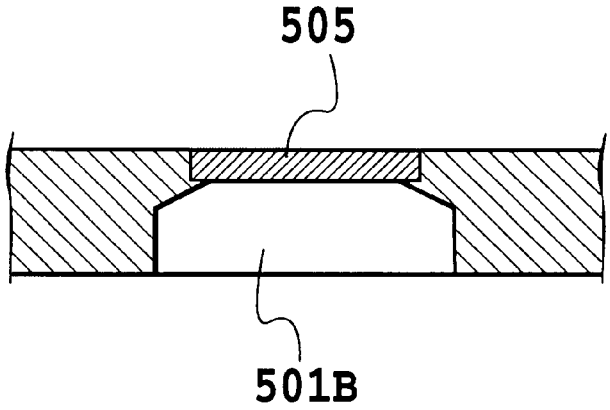

A suction port 501B of FIG. 31A has an inner surface which is conical in shape. That is, it is gradually increased in diameter toward the sub-tank which s located on the lower side of the figure. A suction port 501B of FIG. 31B has a curved inner surface so as to be increased in diameter toward the sub-tank which is located on the lower side of the figure. A suction port 501B of FIG. 31C is conical in shape and has an inner surface on which one or more stages are formed. That is, it is gradually increased in diameter toward the sub-tank which is located on the lower side of the figure. The ink persisted in the suction port 501B at the time of supplying ink is easy to move into the sun-tank, so that the period of contacting the ink with gas-permeable member 505 can be minimized.

Figure 32A:
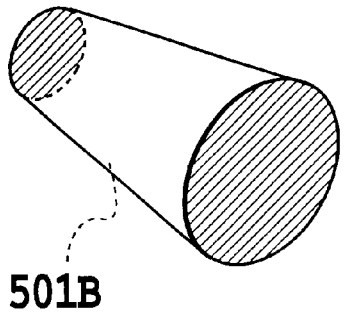
FIGS. 32A, 32B, and 32C are schematic cross sectional views of further different configurations of the suction port for the sub-tank shown in FIGS. 25 and 28.
Figure 32B:
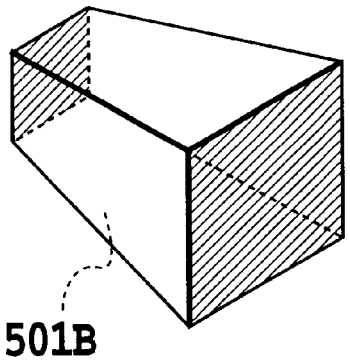
Figure 32C:
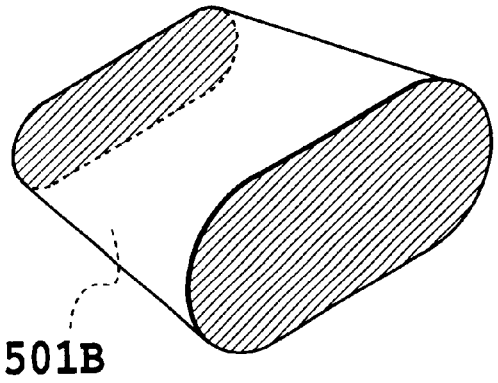

The opening shape of the suction port 501B may be selected from various shapes such as circle, square, and ellipse as indicated by sloped lines in FIGS. 32A, 32B, and 32C, respectively. In short, an inner side of the suction port 501B may be inclined.

The Tenth Preferred Embodiment

Figure 33:
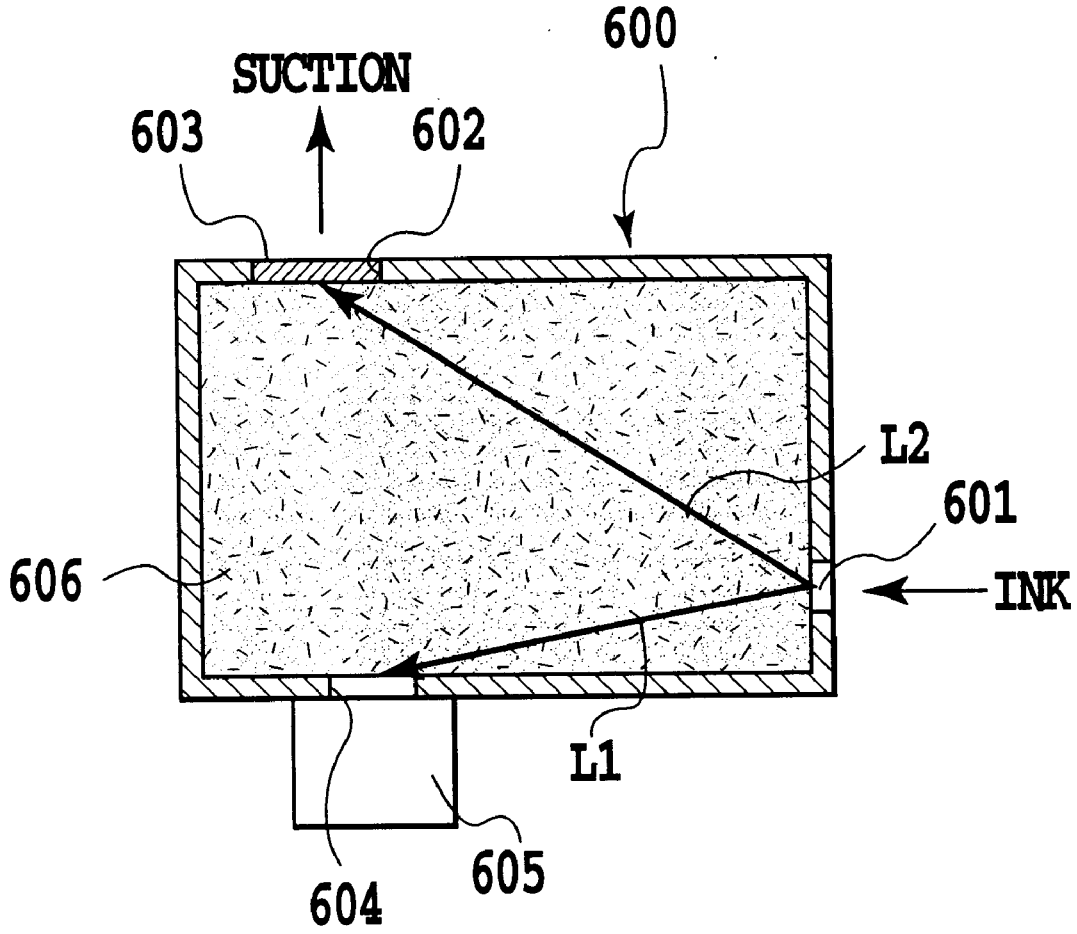
FIG. 33 is a cross sectional view of the ink tank in accordance with the tenth embodiment of the present invention.

FIG. 33 illustrates a tenth preferred embodiment of the present invention.

In an ink tank 600, the reference numeral 601 denotes a supply port (hereinafter, also referred to as a replenishment port) to be connected to the same ink-supplying system as that of each embodiment described above. The reference numeral 602 denotes a suction port to be connected to the same suction system as that of each embodiment described above, where the suction system 602 comprises a gas-permeable member 603. The reference numeral 604 denotes a supply port for supplying ink to a printing head 605. The interior of the ink tank 600 holds an ink-retaining member 606 for retaining ink by suction. At the time of supplying ink, as in the same way as that of each embodiment described above, ink is supplied into the ink tank 600 by the replenishment port 601 while air in the ink tank 600 is aspirated from the suction port 602 through the gas-permeable member 603. As the ink cannot permeate the gas-permeable member 603, so that the supply of ink stops automatically in response to the contact between the gas-permeable member 603 and the ink.

According to the present embodiment, the arrival order of the ink to the supply port 604 and the gas-permeable member 603 is determined so that ink to be supplied from the replenishment port 601 into the ink tank 600 reaches the supply port 604 after ink reaches the gas-permeable member 603. By setting such an arrival order of ink, the ink tank is filled with a sufficient amount of ink and then the ink reaches the gas-permeable member 603, and so the supply of ink is stopped. Alternatively, if the ink reaches the gas-permeable member 603 before the arrival of ink to the supply port 604, the ink tank 600 cannot be filled with ink sufficiently.

The arrival order of ink described above can be determined on the basis of various conditions. As shown in FIG. 33, f or example, the arrival order of ink can be determined by the relational expression of:

$$L1<L2$$

wherein L1 represents a distance between the replenishment port 601 and the supply port 604; and L2 represents a distance between the replenishment port 601 and the gas-permeable member 603. In consideration of the influences of a density condition of the ink absorber, gravitation, and so on, the ink absorber 606 may be configured to have different absorption velocities thereof in part. That is, the absorption velocity of the area between the replenishment port 601 and the supply port 604 may be comparatively fast while the absorption velocity of the area between the replenishment port 601 and the gas-permeable member 603 may be comparatively slow.

Eleventh Preferred Embodiment

FIGS. 34 to 42 illustrate an eleventh preferred embodiment of the present invention.

Figure 34:
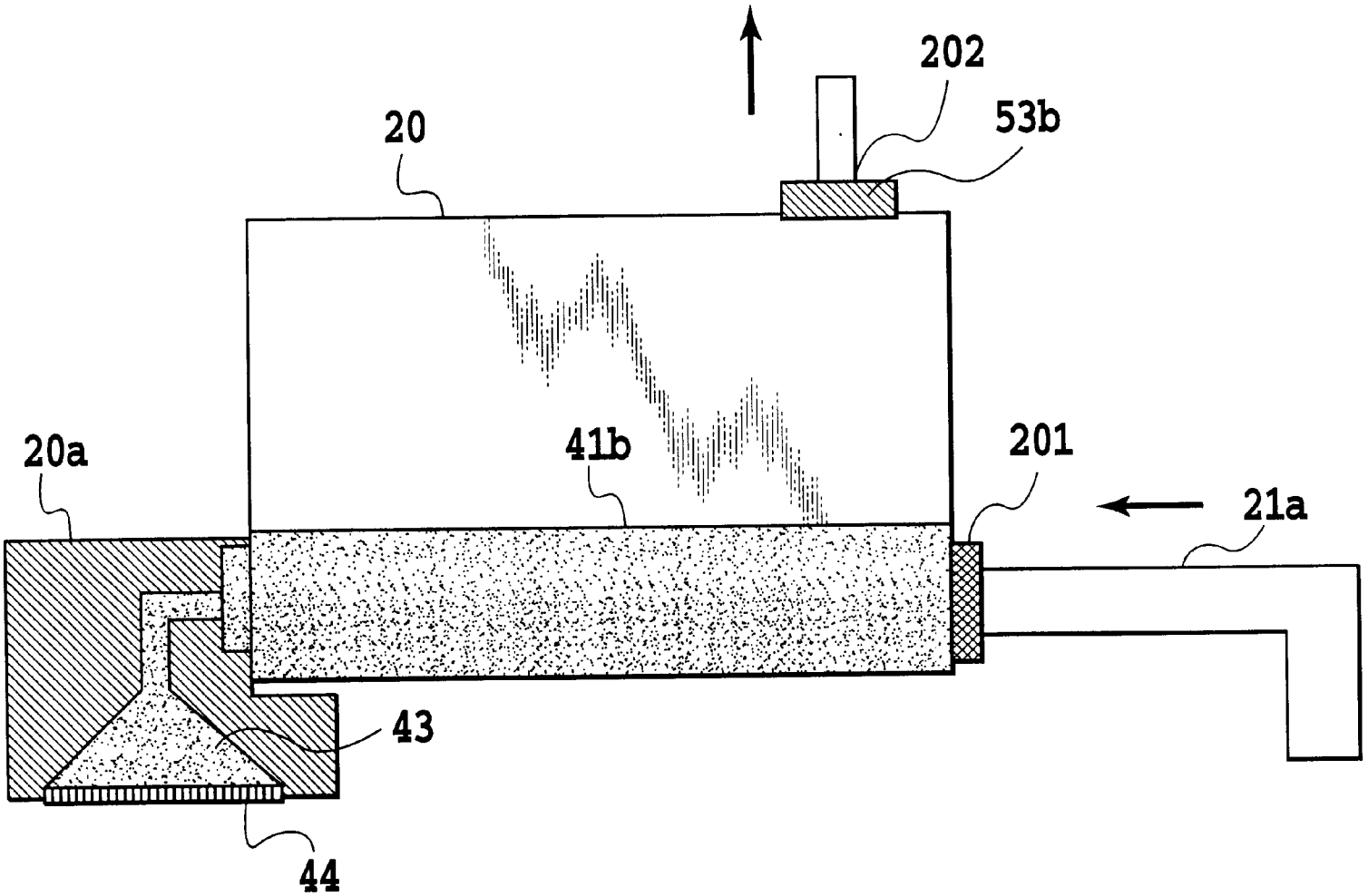
FIG. 34 is a schematic view for illustrating the configuration of the ink tank in accordance with the eleventh embodiment of the present invention.
Figure 35:
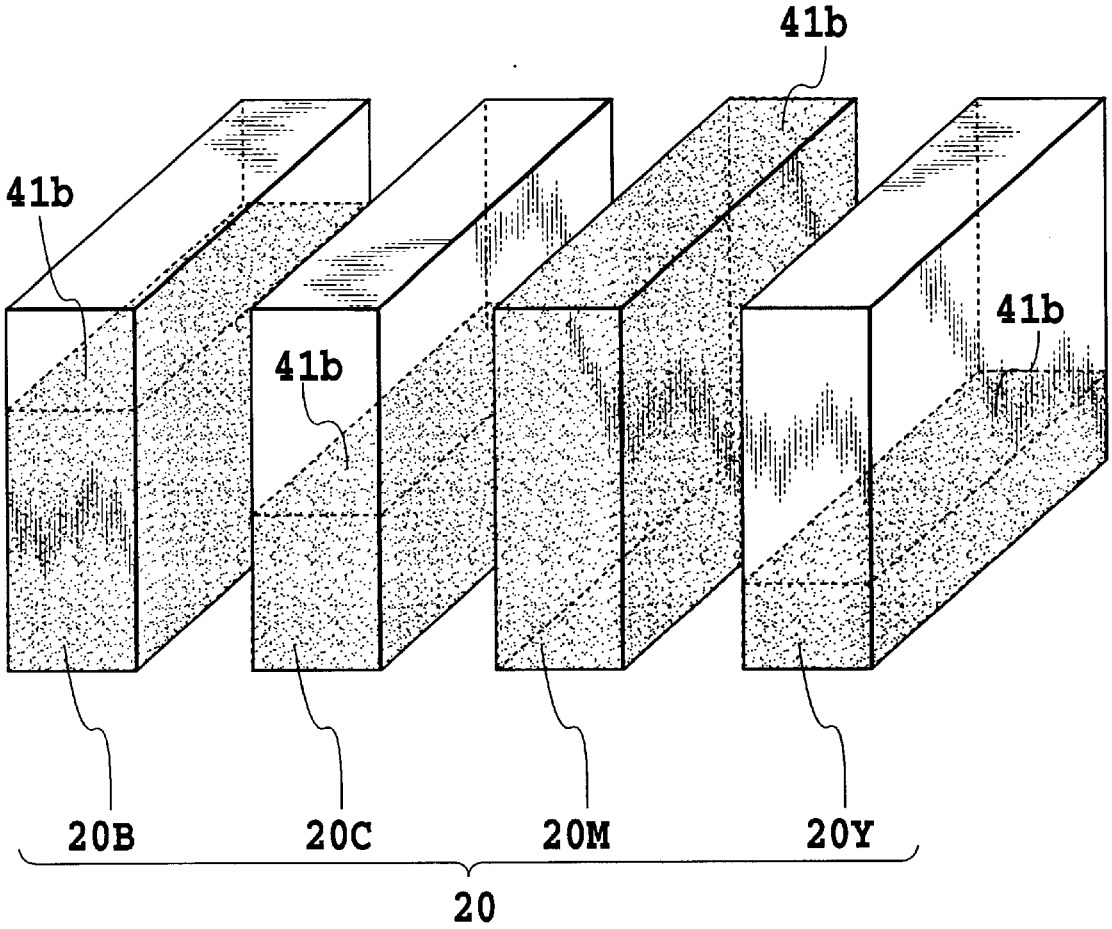
FIG. 35 is a schematic perspective view of the ink tank shown in FIG. 34.
Figure 36:
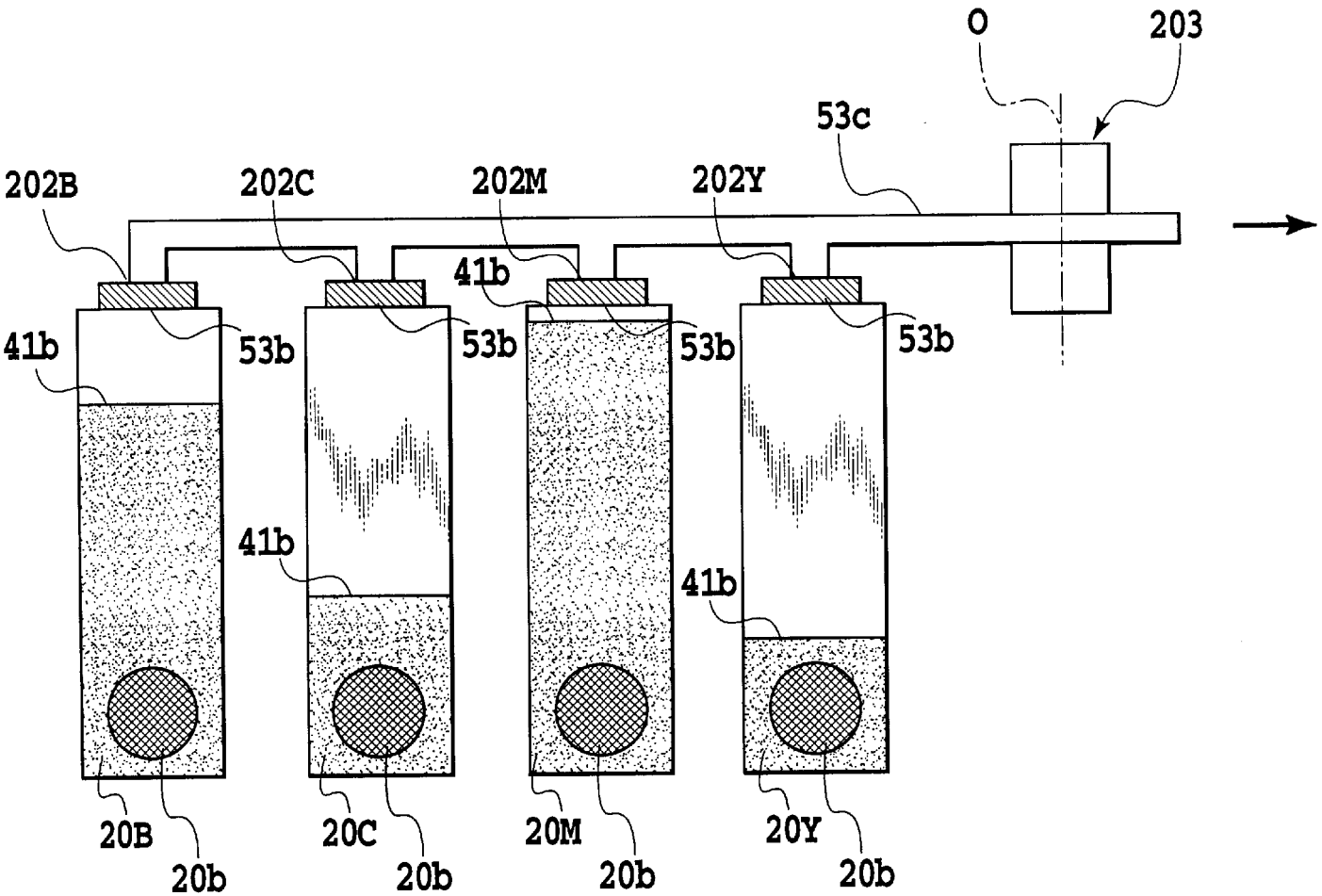
FIG. 36 is a schematic view for illustrating the configuration of the air-suction system to be connected to the ink tank shown in FIG. 34.

In this embodiment, as shown in FIG. 34, an ink inlet 20*b* and a suction port 53*b* are formed on each of the reserve ink tanks 20Y, 20M, 20C, and 20B of FIG. 35. Each suction port 53*b* has the same gas-permeable member (not shown) as that of the fifth embodiment described above. In the figure, the reference numeral 201 denotes a supply joint for each type of ink. The supply joint 201 is configured to make a connection to each ink inlet 20*b*, and connected to the same ink-supplying system as that of fifth embodiment described above. The reference numeral 202 denotes a suction joint configured to make connection to each suction port 53*b* as shown in FIG. 36. All suction joints 202 are gathered into the suction passage 53*c* and then connected to the same ink suction system as that of the fifth embodiment described above.

Figure 38:
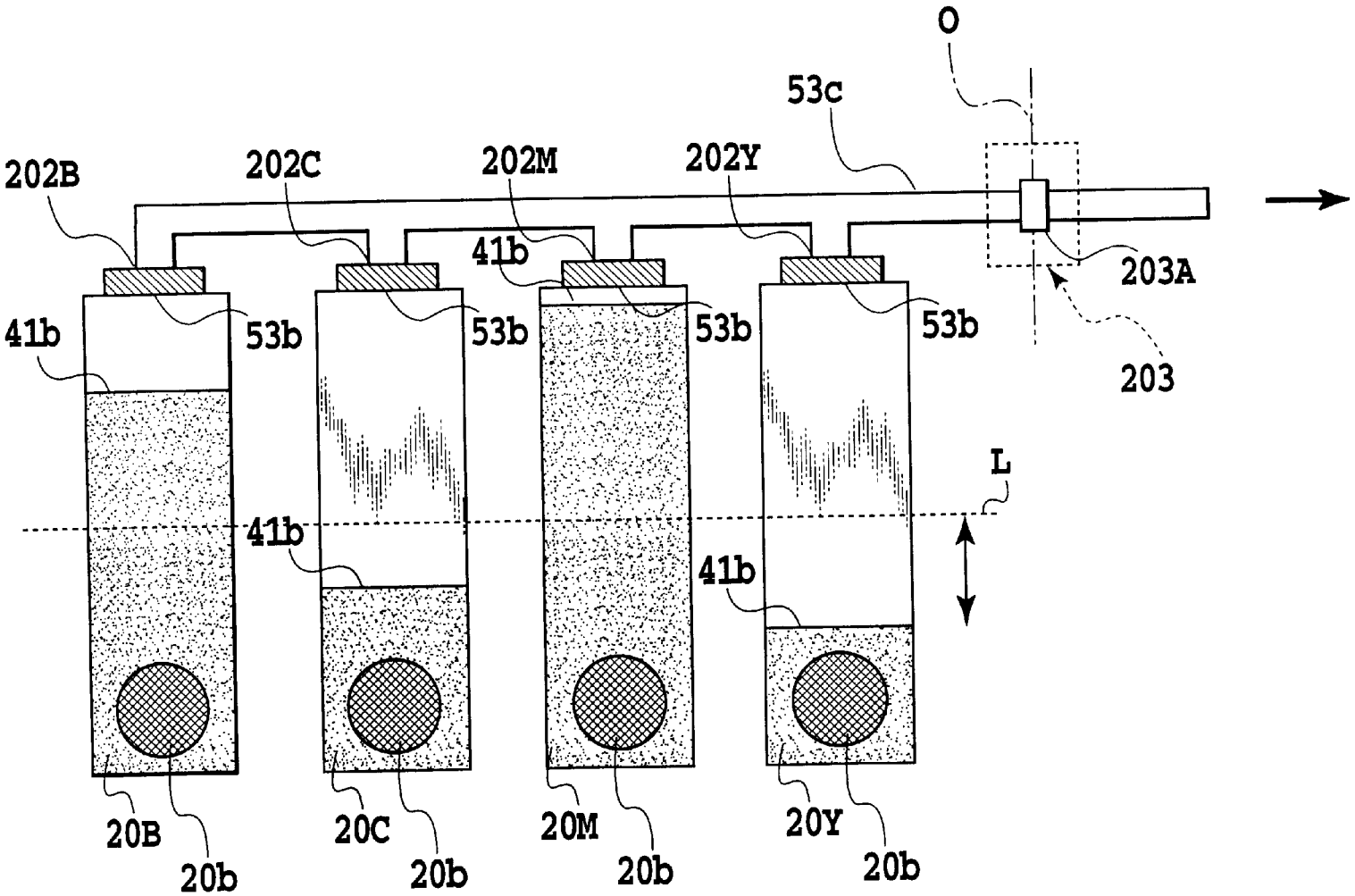
FIG. 38 is an explanation view for illustrating the condition before the supply of ink to the ink tank shown in FIG. 34.
Figure 39:
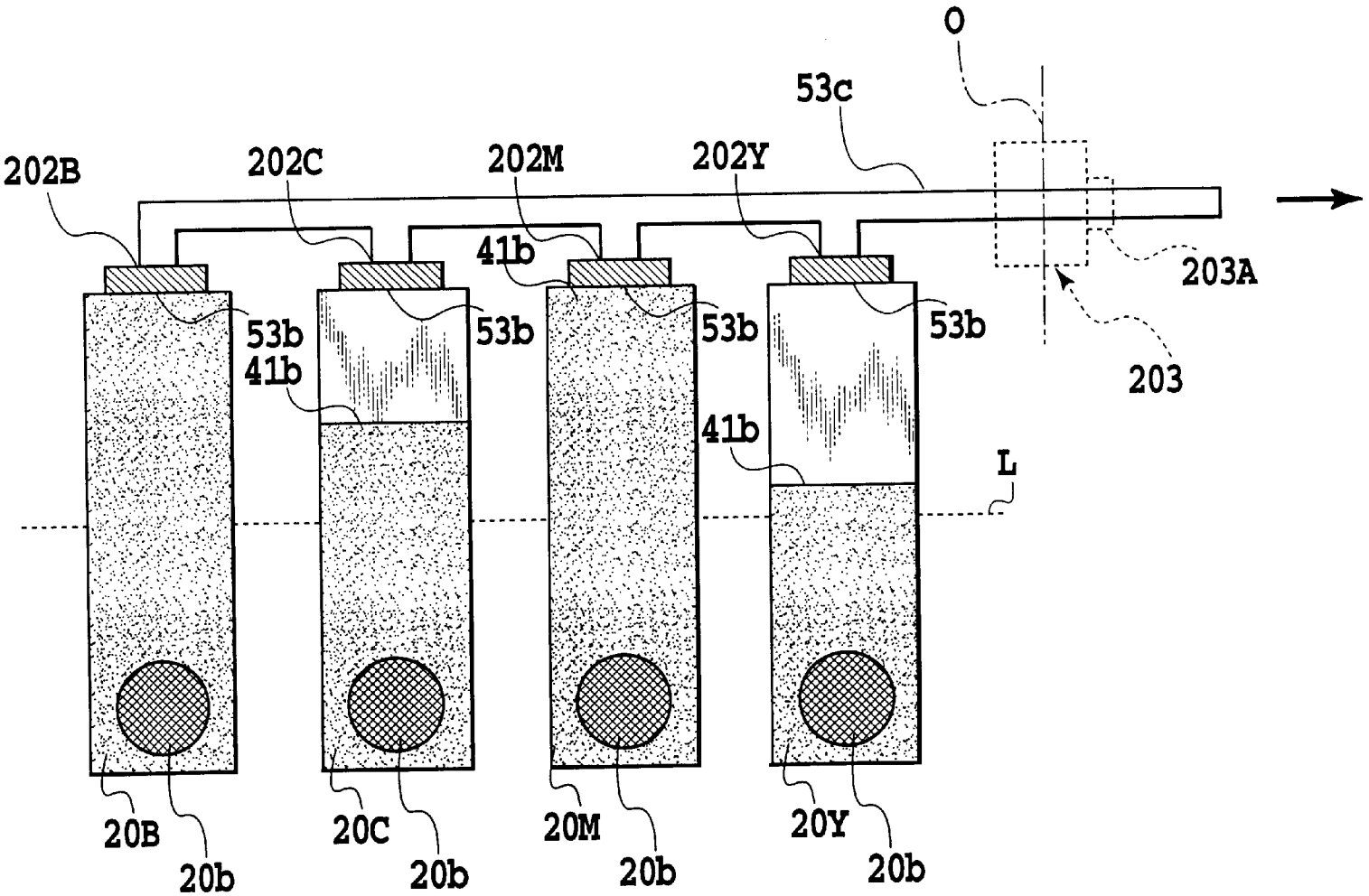
FIG. 39 is an explanation view for illustrating the condition during periods of supplying ink to the ink tank shown in FIG. 34.

The letter "L" in FIG. 38 represents a detection reference level for detecting the level 41*b* of ink. A means for detecting the level 41*b* of ink may be an electric level sensor, an optical level sensor, or the like. The electric level sensor detect the level 41*b* due to the existence of ink between electrodes placed in the reserve ink tank 20. The remaining amount of ink in the reserve ink tank 20 may be estimated by obtaining the amount of ink consumed on the basis of the number of ink-eject from the printing head 20*a*. The remaining amount of ink may be detected in each of the reserve ink tanks 20Y, 20M, 20C, and 20K.

Figure 37A:
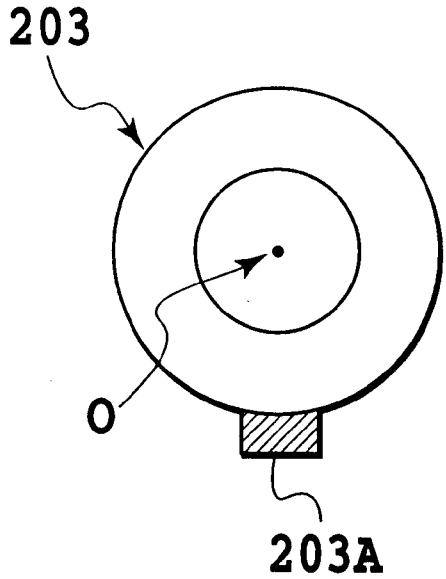
FIGS. 37A and FIG. 37B are front and side views of the stopper shown in FIG. 34, respectively.
Figure 37B:
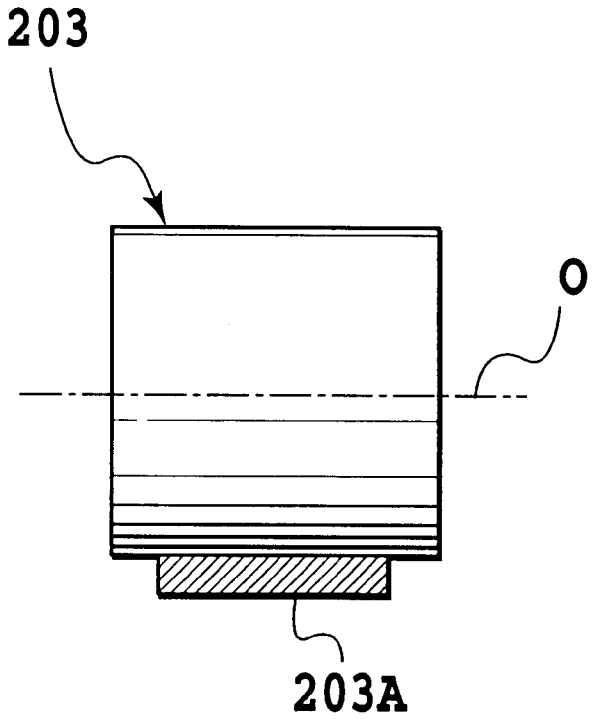

The suction passage 53*c* has a stopper 203 as a means for closing or opening the suction passage 53*c*. In addition, a stopper portion 203A is formed on an outer peripheral surface of the stopper 203 as shown in FIG. 37A and FIG. 37B. If the stopper 203 rotates about its central axis "O" so that the stopper portion 203A faces the suction passage 53*c*, as shown in FIG. 38, the stopper portion 203A presses and closes the suction passage 53*c*. If the stopper 203 rotates about its central axis "O" so that the stopper portion 203A is detached from the suction passage 53*c*, the suction passage 53*c* returns to its original open state.

During the action of supplying ink to the reserve ink tanks 20Y, 20M, 20C, and 20K, the suction passage 53*c* is opened at first. Then, negative pressure is caused in each ink tank 20 from the suction port 53*b* through the gas-permeable member as in the case of the embodiment described above. The negative pressure allows the supply of ink through the ink inlet 20*b*. Hereinafter, the process including these steps is so-called "the action of supplying ink". The action of supplying ink allows the concurrent supply of ink to the reserve ink tanks 20Y, 20M, 20C, and 20K. The stopper 203 closes the suction passage 53*c* except when the action of supplying ink is currently progress.

Figure 42:
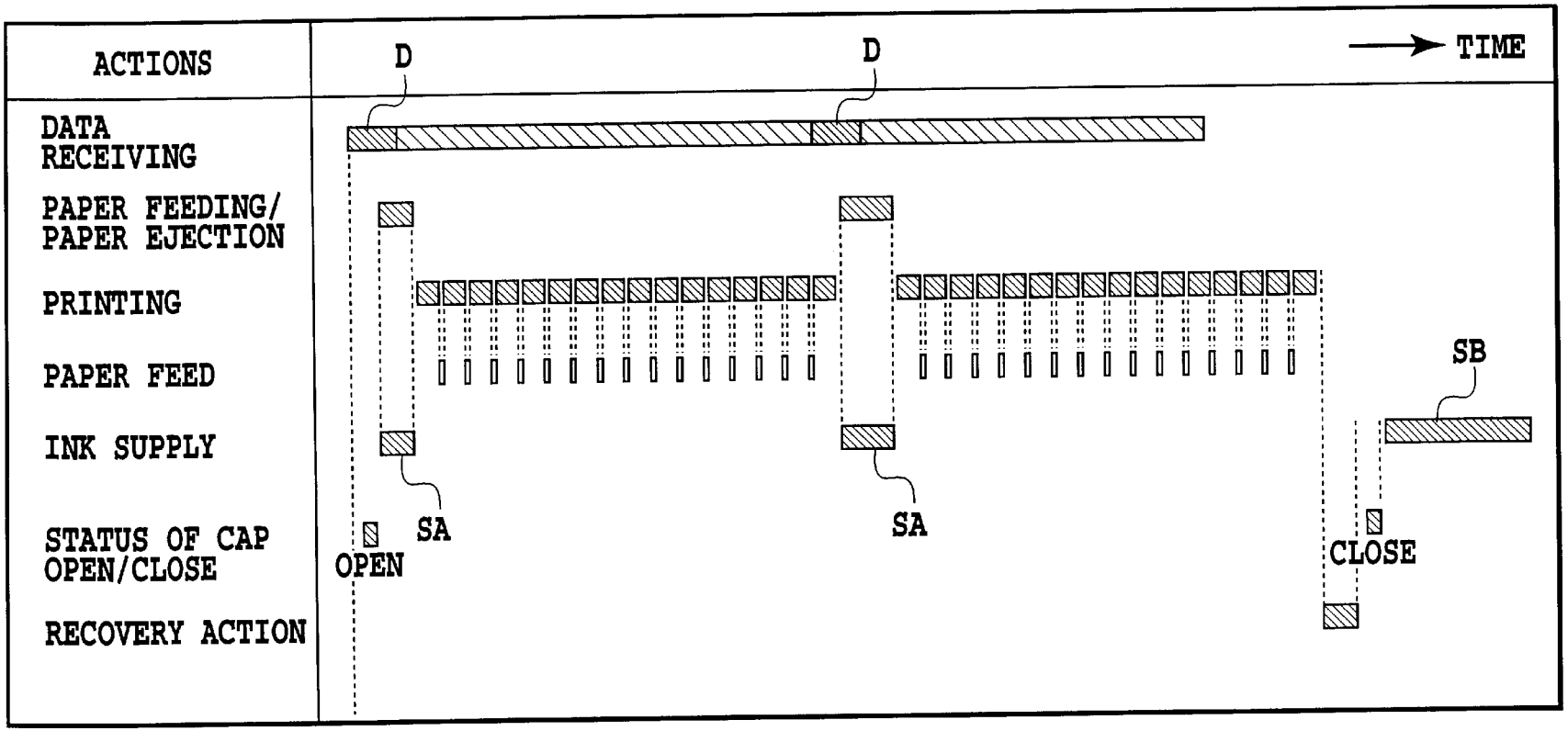
FIG. 42 is a timing chart for illustrating the operation of supplying ink to the ink tank shown in FIG. 34.

FIG. 42 is a timing chart for illustrating a series of actuation of the printing apparatus. At first, the printing apparatus receives printing data "D" corresponding to one page of the printing medium. Then, the printing apparatus repeats the steps of: performing the printing movement for printing one line of the image by moving the printing head 20*a* in the main-scanning direction after the action of providing the printing medium; and feeding the printing medium for one line of the image. After the image printing, the printing medium is discharged from the printing apparatus and then the next printing medium is provided to perform the next printing movement. The action of capping shown in FIG. 42 is for the printing head 20*a*. In advance of starting the printing movement, a capping means is detached from the printing head 20*a*, bringing about its "OPEN" state (hereinafter, also referred to as a "cap-open" state), and then the capping means is attached to the printing head 20*b* after performing a series of steps in the printing movement, bringing about its "CLOSE" state (hereinafter, also referred to as a "cap-close" state). In addition, the recovery action is performed prior to the cap-close state, which makes the printing head 20*a* eject a predetermined amount of ink without contributing to any image formation. The recovery movement may include the action of discharging ink from nozzles 44 of the printing head 20*a* under suction, the action of primary eject of ink from the printing head 20*a*, or the like. The supply of ink shown in FIG. 42 is the action of supplying ink described later, which can be performed every time after printing an image on one page of the printing medium.

Figure 40:
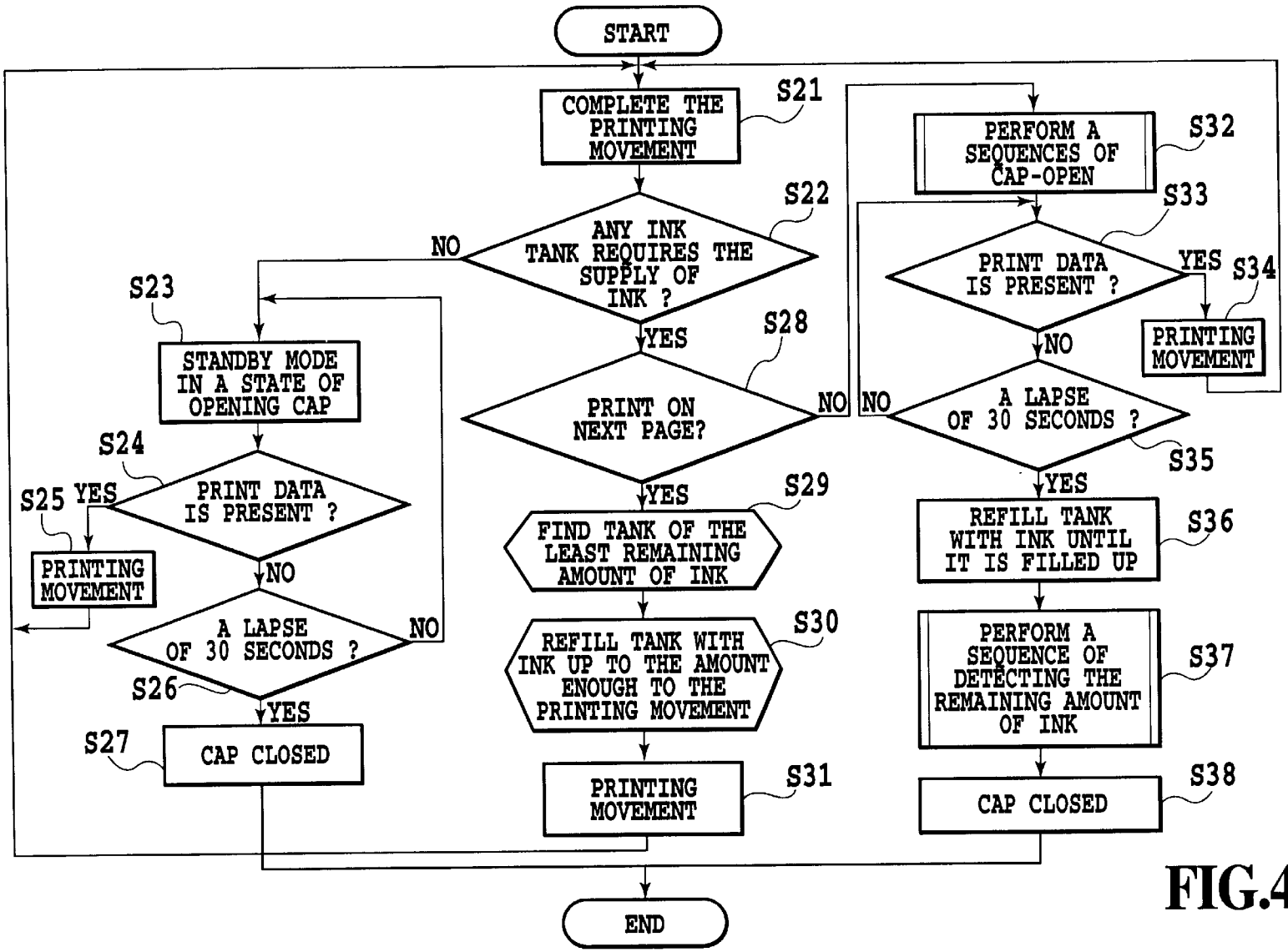
FIG. 40 is a flow chart for illustrating the operation of supplying ink to the ink tank shown in FIG. 34.

FIG. 40 is a flow chart for illustrating the action of supplying ink.

After the printing movement by one page of the printing apparatus, the printing apparatus detects the remaining amount of ink in each of the reserve ink tanks 20Y, 20M, 20C, and 20K. Subsequently, it judges whether the remaining amount of ink is decreased to a predetermined level by which it becomes necessary to supply the required amount of ink on the basis of the results of such a detection (steps S21, S22). In this embodiment, such a judgement is based on a rule that the need for supplying ink arises when the level 41*b* of ink is lowered than a predetermined level "L".

If the supply of ink is not required, the printing apparatus is kept in the cap-open state (step S23) or performs the printing movement when it receives printing data "D" (step 25). If the printing data "D" is not received even if fixed time has elapsed, it is switched to the cap-close state (in this embodiment, after lapse of 30 seconds) to complete to sequence.

If the supply of ink is required, it is judged whether there is a need for printing the next page (step S28). The ink tank having the minimum remaining amount of ink is judged from the reserve ink tanks 20Y, 20M, 20C, and 20K at the time of printing the next page (i.e., at the state of ink-supply "SA" in FIG. 42). In the case of shown in FIG. 38, the reserve ink tank 20Y is judged as the one having the minimum remaining amount of ink. Thus, the ink tank having the minimum remaining amount of ink receives the supply of ink until it is filled up to a predetermined target remaining amount of ink enough to perform the printing movement (step S30). The target remaining amount of ink may be defined as the amount of ink that corresponds to the predetermined level "L" of ink. Moreover, the target remaining amount of ink may be also defined as the minimum amount of ink to be required for printing an image on the next one page. Depending on the types (e.g., colors) of ink, the ink tanks may have their respective target remaining amounts of ink. In each reserve ink tank, the supply of ink to the ink tank filled up with ink is automatically stopped by means of the gas-permeable member during the action of supplying ink. In the case of shown in FIG. 39, the actions of supplying ink to both the reserve ink tanks 20M, 20B are automatically stopped. Following such an action of supplying ink, the next printing movement for one page is performed (step S31).

Figure 41A:
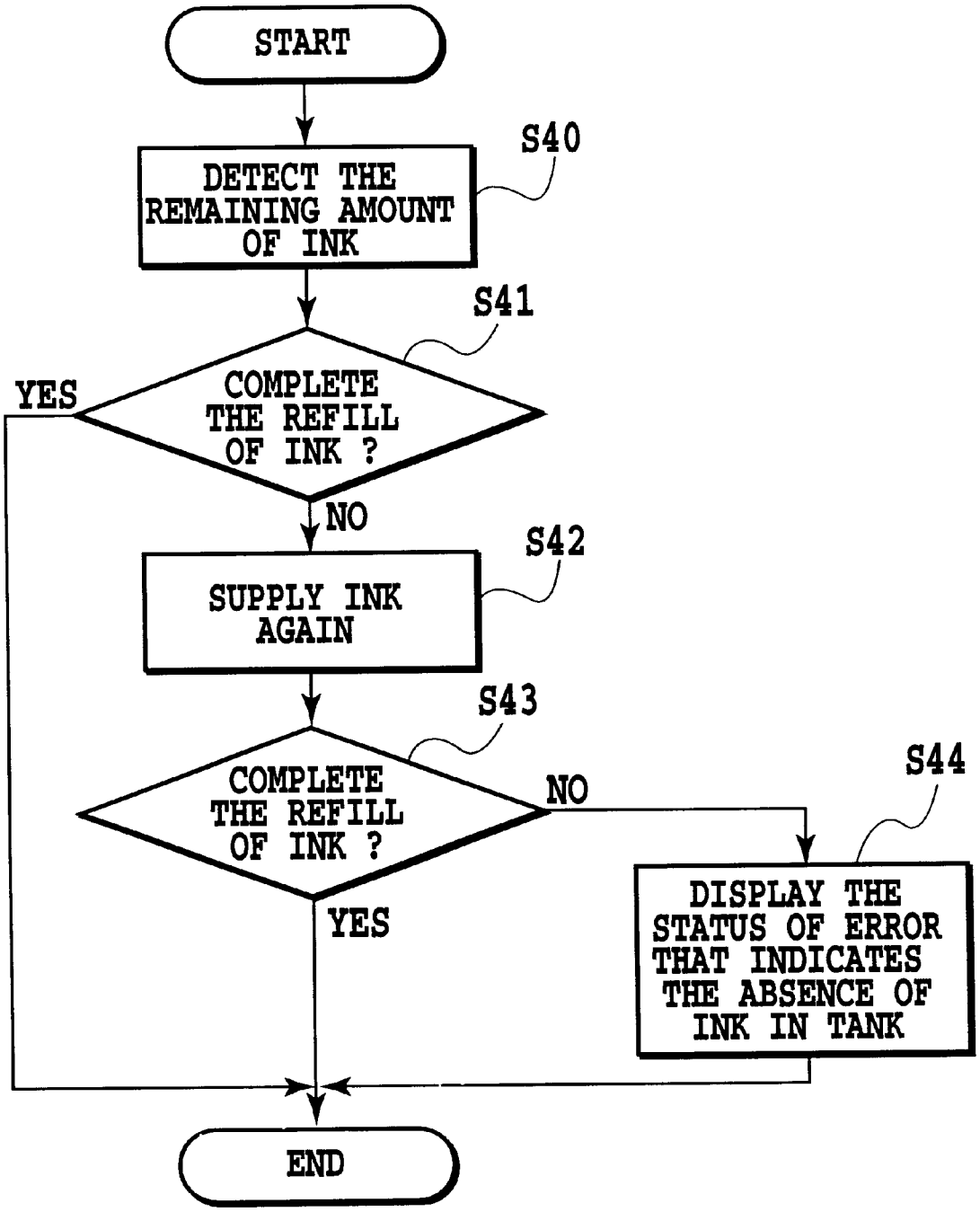
FIG. 41A is a flow chart for illustrating the sequence of detecting the remaining amount of ink in the ink tank shown in FIG. 40
Figure 41B:
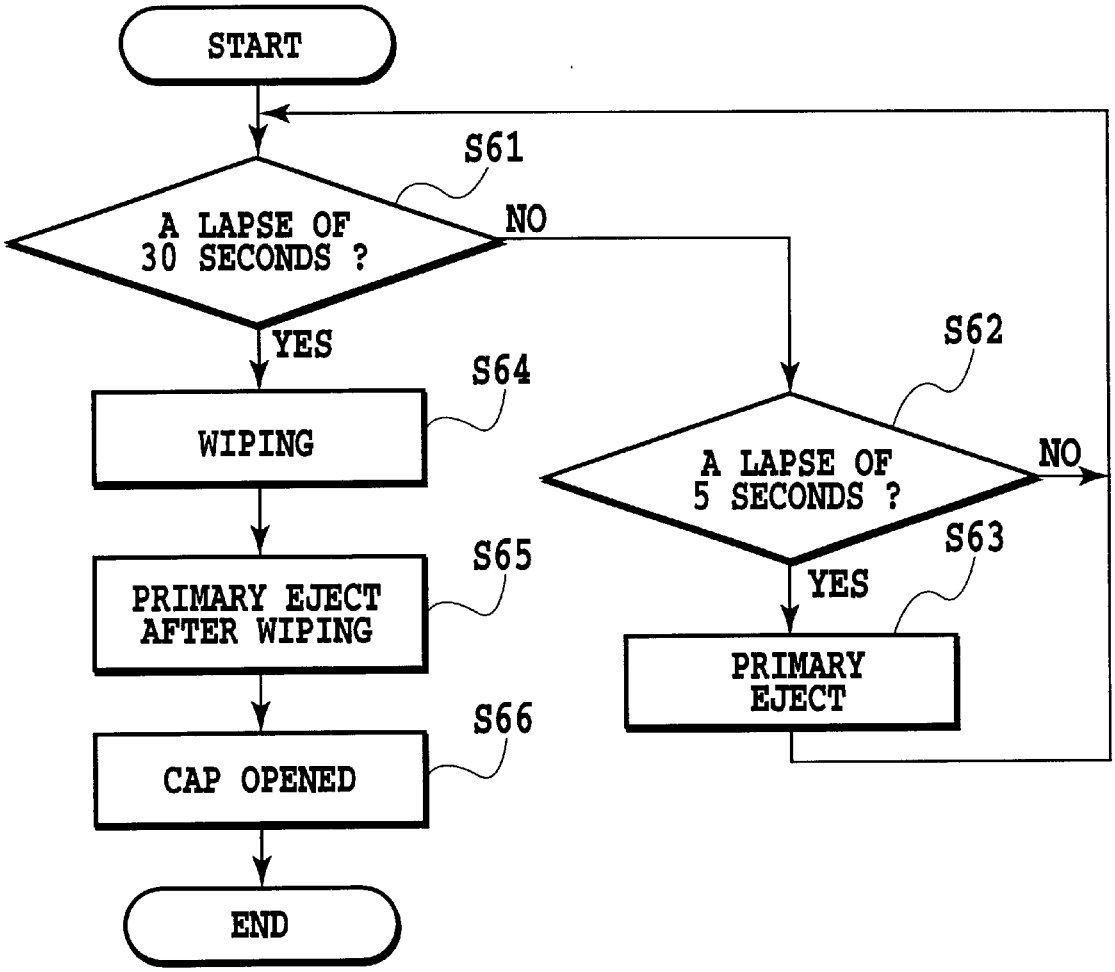
FIG. 41B is a flow chart for illustrating the sequence of opening the cap shown in FIG. 40.

On the other hand if the next printing movement for one page is not performed (i.e., if the supply of ink is performed during the period "SB" shown in FIG. 42), a sequence of the cap-open shown in FIG. 41B is executed. That is, the printing head 20*a* ejects ink which is not responsible for any image formation (primary eject) every five seconds until a predetermined time interval is expired (in this embodiment, 30 seconds) (steps S61, S62, S63). After a lapse of 30 seconds, the printing head 20*a* is subjected to the step of wiping (step 64) and the step of primary eject (step S65), followed by the step of cap-close (step S66) to complete the sequence.

After that, the printing head 20*b* waits a predetermined time interval (in this embodiment, 30 seconds) for the input of the printing data "D". If the printing head receives the printing data "D" within the predetermined time interval, the printing movement is performed (step S34). If it does not receive the printing data "D" within the predetermined time interval, each of the reserve ink tanks 20Y, 20M, 20C, and 20K is filled with ink by the action of supplying ink (step S36). The supply of ink to each of the reserve ink tanks 20Y, 20M, 20C, and 20K is automatically stopped in order of being filled up with ink. Following the step of supplying ink to fill up the respective reserve ink tanks 20Y, 20M, 20C, and 20K, a sequence for detecting the remaining amount of ink in each of them described later is performed and then completed after the cap-close (step S38).

In this way, if the next printing movement for one page is not performed, the reserve ink tanks 20Y, 20M, 20C, and 20K are filled up with ink respectively during the period after the printing movement without imposing a severe time limit. After that, the printing movement can be started at one because the reserve ink tanks 20Y, 20M, 20C, and 20K are being filled up with ink at the time of rebooting the printing apparatus. During the period in which the printing apparatus is not used, furthermore, the adhesion of ink in the reserve ink tank 20 can be prevented by keeping the reserve ink tank 20 in a state of being filled up with ink.

FIG. 41A is a flow chart for illustrating a sequence of detecting the remaining amount of ink in the reserve ink tank 20.

First, the sequence is switched on (step S40) and then starts to judge whether the charge of ink into the respective reserve ink tanks 20Y, 20M, 20C, and 20K is completed (step S41). If the charge of ink is completed, the sequence is terminated. If the charge of ink is not completed, the same action of aspirating ink as that of the step S36 is performed (step S42). Subsequently, it is judged again that whether the charge of ink is completed (step S41). If the charge of ink is completed, the sequence is terminated. If it is not completed, it is judged that the main-tank (refill ink tank) to be used for supplying ink to the reserve ink tank 20 is empty and then an error is represented on a display means (not shown) (step S44).

In the present embodiment, by the way, the reserve ink tank 20 may be always connected to the ink-supplying system and the air-suction system.

Twelfth Preferred Embodiment

An oil-repellent finished porous material may be used as a most stable gas-permeable member (gas-liquid separating means).

For example, a material of tetrafluoride ethylene is drawn into a porous membrane having an almost unlimited number of micro-pores and then the obtained porous membrane can be subjected to an oil-repellent finish using a compound having fluoride atoms. The porous membrane having micro-pores of 0.05 to 5.0 $\mu$m in diameter may be used, so that it acts as a gas-permeable membrane. Therefore, the gas-permeable member made of the oil-repellent finished porous material makes full use of the capabilities of gas-liquid separating means while it renders the surface thereof repellent to ink sufficiently, resulting in the increase in the durability of the gas-permeable member. That is, the pores of the oil-repellent finished porous material repellent to ink sufficiently so that the pores can be prevented from being clogged by ink, resulting in the increase in the gas-permeable member. If the ink composition comprises an additive such as a surface-active agent for increasing the permeability in addition to simple components such as pigment, glycerin, and water, the durability of the gas-permeable member is substantially increased. In addition, the holes of the porous material can be prevented from being closed too much by ink. As a result, negative pressure can be effectively applied in the ink tank to smoothly supply ink into the ink tank.

The porous material that forms the gas-permeable member is not limited to a porous membrane made of a resin such as polyolefin, polypropylene, or polyethylene. It is also possible to use another porous material made of a natural or synthesis material such as knitted fabric, woven fabric, non-woven fabric, net, felt, porcelain, unglazed pottery, or earthenware and also such a material can be subjected to an oil-repellent finish to be provided as a gas-permeable member.

Furthermore, if the oil-repellent finish is performed using a compound having fluoride atoms, a compound having a polyfluoroalkyl group may be used as an oil-repellent agent. Such an oil-repellent agent may be selected so as to be fit for the composition of ink to be used. For obtaining preferable oil-repelling characteristics of the oil-repelling agent, a terminal portion of the polyfluoroalkyl group may be a tryfluoromethyl group ($CF_3$). For obtaining the best oil-repelling characteristics of the oil-repelling agent, it is preferable to use an oil-repellent agent having a perfluoroalkyl group in which all of hydrogen atoms in the polyfluoroalkyl group are substituted with fluoride atoms.

Thirteenth Preferred Embodiment

FIGS. 43 to 46 are explanatory views for illustrating a thirteenth preferred embodiment of the present invention.

Figure 43:
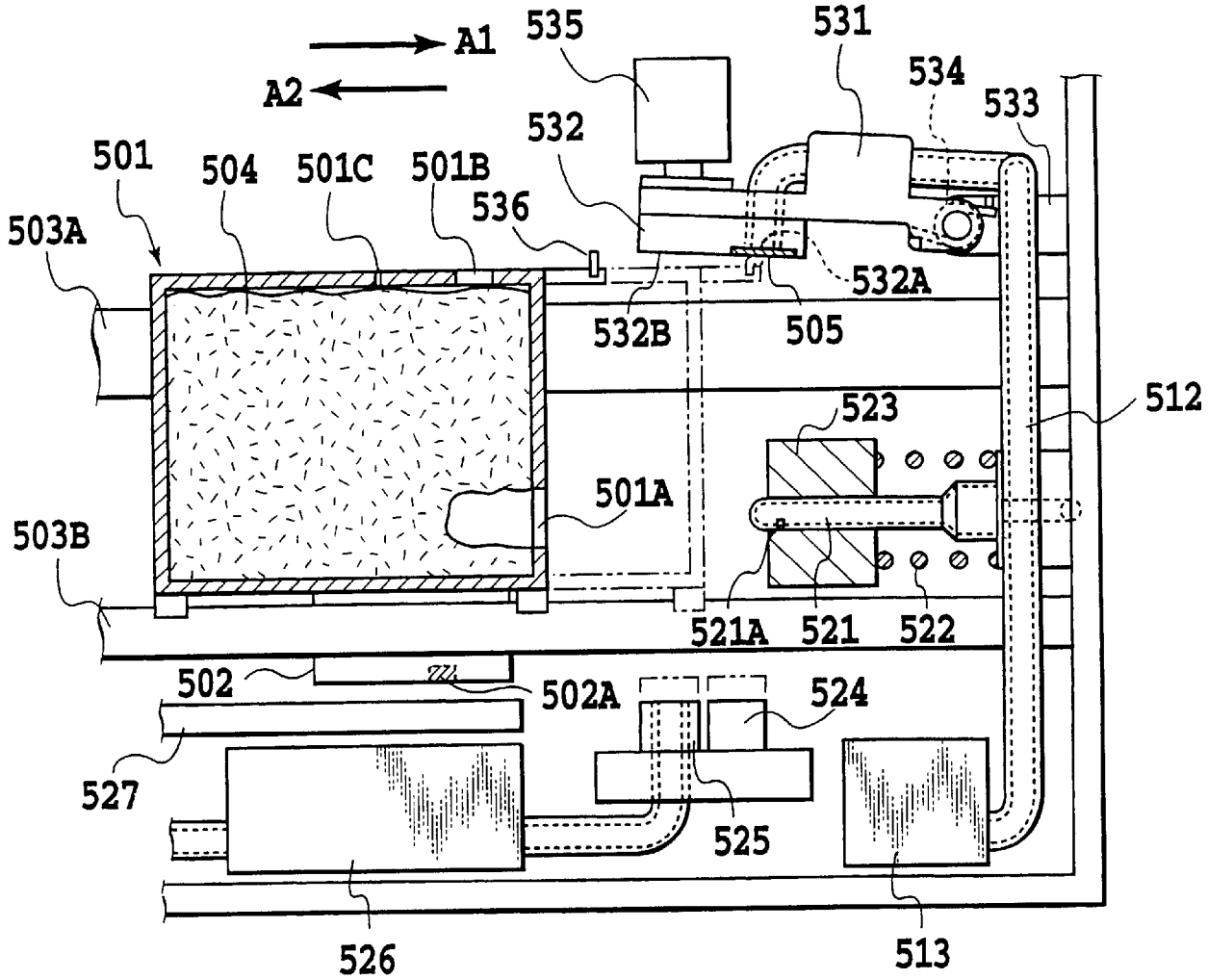
FIG. 43 is a cross sectional view of a main part for illustrating the thirteenth embodiment of the present invention.

In FIG. 43, the reference numeral 501 denotes a sub ink tank (hereinafter, also referred to as a sub tank) that is able to store ink, and 502 denotes a printing head that is able to receive the ink stored in the sub tank 501 and eject the ink from its nozzle portion 502A. These sub tank 501 and the printing head 502 is moved along guide shafts 503A, 503B in the main scanning direction (i.e., the direction of the arrow A1 or A2). In addition, the sub tank 501 and the printing head 502 can be removably installed on a carriage (not shown) guided by guide shafts 503A, 503B. The sub tank 501 has an ink inlet 501A, a suction port 501B, an air-communicating port 501C, and an ink-supplying port (not shown) that communicates with the printing head 502. In addition, an ink absorber 504 is placed in the sub tank 501 to retain ink under suction.

According to the present embodiment, the sub tank 501 comprises four different ink-storage portions. That is, there are an ink-storage portion 501C for cyan ink, an ink-storage portion 501M for magenta ink, an ink-storage portion 501Y for yellow ink, and an ink-storage portion 501B for black ink. Furthermore, each ink-storage portion has an ink inlet 501A, a suction port 501B, an air-communicating port 501C, and an ink-supplying port that communicates with the printing head 502. Considering that the black ink is used frequently in comparison with those of the others, the capacity of the ink-storage portion 501B for black ink is larger than those of the others. The nozzles 502A of the printing head 502 is configured so as to befit the respective ink-storage portions 501A, 501B, 501C, and 501B for different colors. The sub tank 501 and the printing head 502 may be configured to be coupled together to form an ink-jet cartridge. Alternatively, the sub tank 501 and the printing head 502 may be configured to be provided as separated structures for the respective ink colors.

Referring again to FIG. 43, the reference numeral 521 denotes a projected hollow member formed on the main body's side of the printing apparatus. In addition, a seal member 523 is coaxially fitted over an outer peripheral surface of the projected member 521 so that the seal member 523 is able to slide over the surface. Furthermore, a spring 522 is also fitted over the outer peripheral surface of the projected portion 521 so that it pushes the seal member 523 leftward. A through hole 521A is formed on the peripheral surface of the projected member 521, which is opened or closed by the seal member 523. The tip of the projected member 521 is being closed, while the base thereof is connected to a main ink tank (hereinafter also referred to as a main tank) (not shown).

Figure 44:
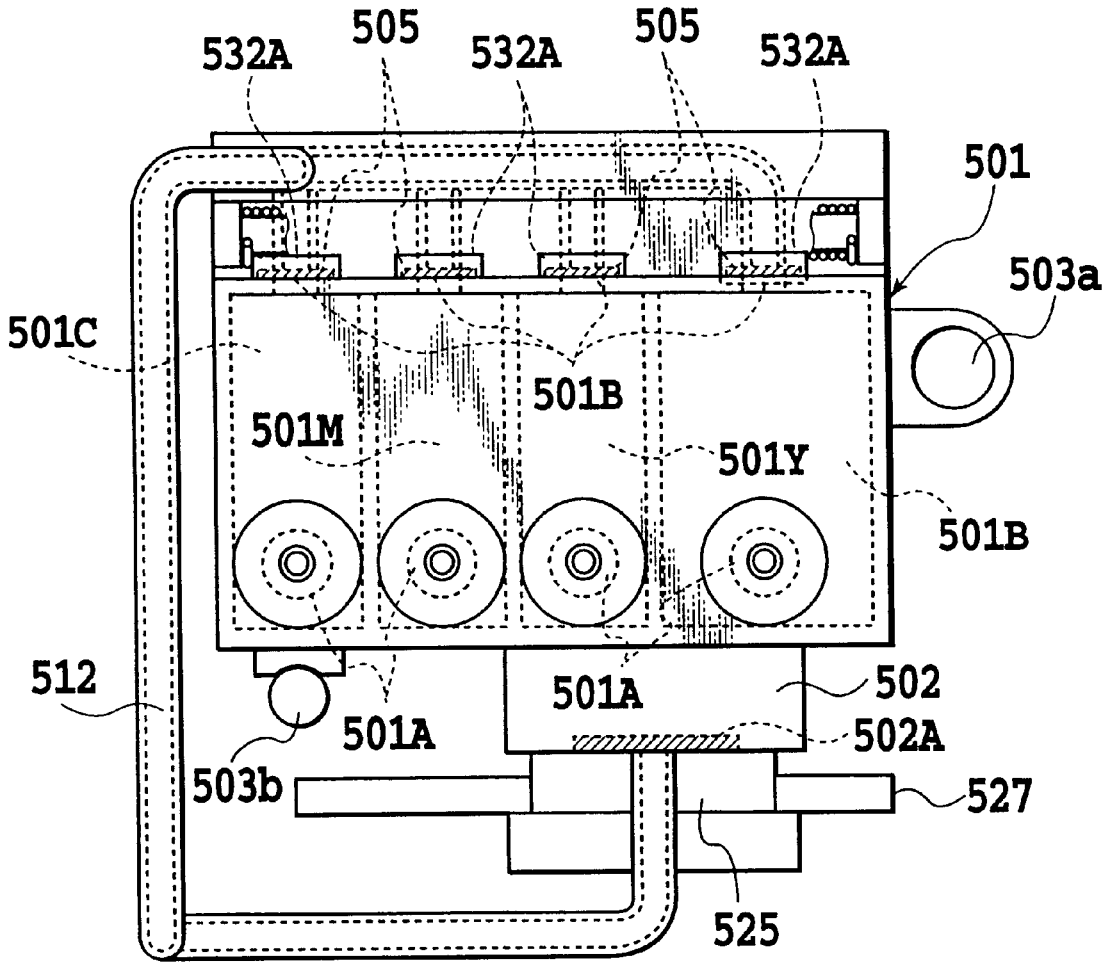
FIG. 44 is a side view of the main part shown in FIG. 43.

The reference numeral 531 denotes an arm member that is supported by a support member 533 on the main body's side of the printing apparatus so as to turn up and down and downwardly spring-loaded by a spring 534. A seal member 532 that is coaxially provided on the arm member 531 has an opening 532A and a seal portion 532B. The opening 532A is able to communicate with the suction port 501B and connected to a suction pump through a suction tube 512. On the other hand, the seal portion 532B is able to close and open the suction port 501B and the air-communicating port 501C. In this embodiment, as shown in FIG. 44, the openings 532A adapted to the respective suction ports 501B of the ink-storage portions 501C, 501M, 501M, and 501B are gathered to the suction tube 521 and then connected to a common suction pump 513. Furthermore, a gas-permeable member 505 is placed in the opening 532A, which permeates gas but ink. The gas-permeable member 505 may be of a thin sheet type and made of a tetrafluoride ethylene resin or other porous resin materials. On the other hand, a blade 536 is provided on the side of the sub tank 501. The blade 536 is ale to wipe the bottom surface of the seal member 532 including the gas-permeable member 505. Furthermore, the reference numeral 535 denotes a stopper member that regulates the position of upward movement of the arm member 531.

The reference numerals 524, 525 denote first and second cap members that are provided on the main body's side of the printing apparatus. These cap members 524, 525 are able to move up and down. In addition, the second cap member 525 is connected to a waste ink tank (not shown) through a suction pump 526. The reference numeral 527 denotes a platen for guiding a printing medium to a printing position where an image formation is performed by the printing head 502. The printing medium is carried by a feeding mechanism (not shown) in the sub-scanning direction that crosses with the main-scanning direction (the direction of the arrow A1 or A2). Every part of the image is formed successively on the printing medium by repeating the printing movement of the printing head 502 in the main-scanning direction while ejecting ink and the feeding movement of the printing medium in the sub-scanning direction.

During the printing movement, the printing head 502 is initially located in the moving range on the left side from its home position (see FIG. 45) and then moves in the direction of the arrow A1 or A2 while printing an image by ejecting ink.

Figure 45:
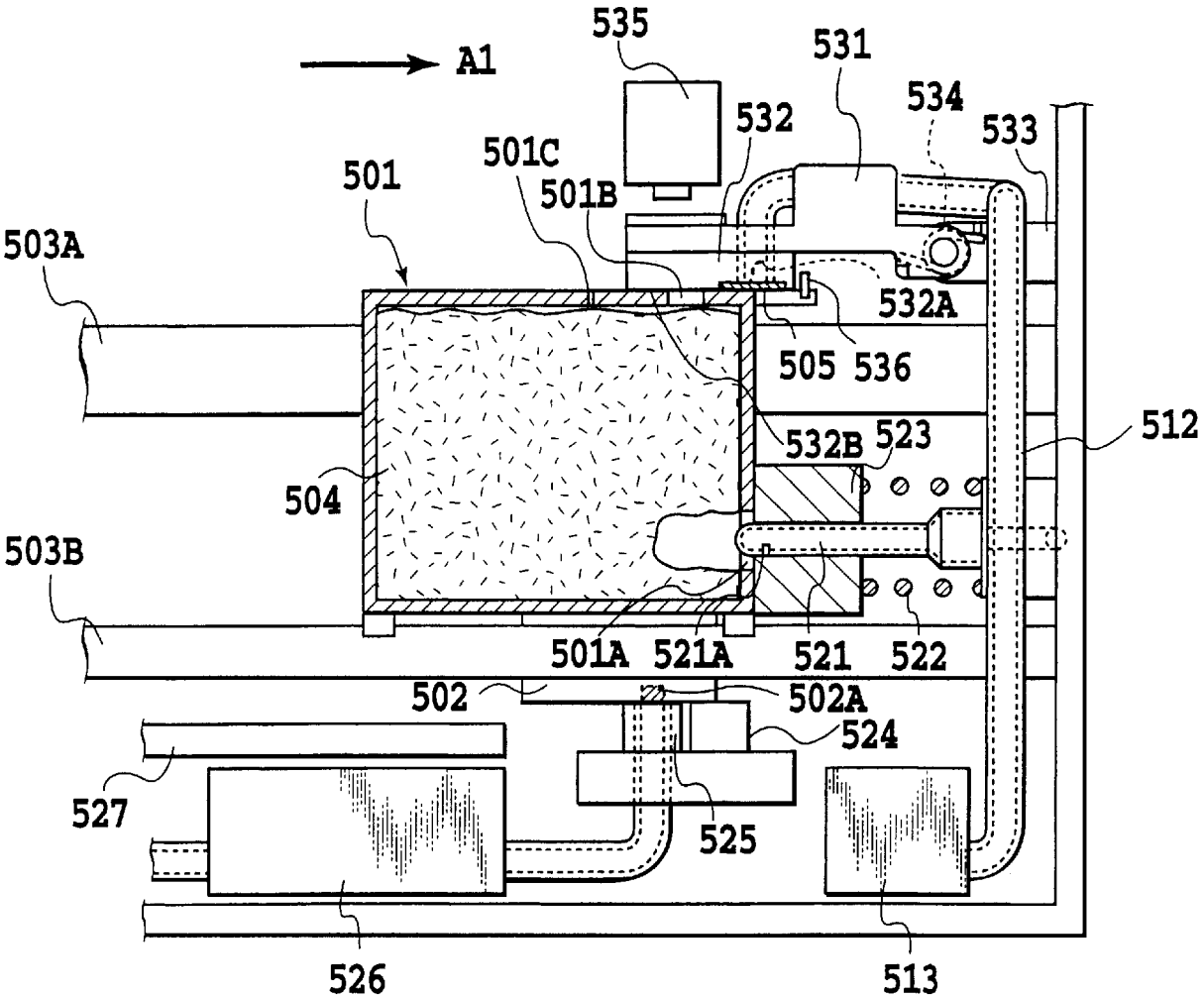
FIG. 45 is an explanation view for illustrating the condition of the printing head of FIG. 43 being capped.

If the printing head 502 reaches to the home position, both the first and second cap members 524, 525 are raised as shown in FIG. 45. As a result, the nozzle portion 502A of the printing head 502 is capped by the second cap member 525. At this time, the seal member 523 closes the ink inlet 501A while keeping the through hole 521A of the projected member 513 in a closed state. In addition, the seal member 532 closes the suction port 501B. Accordingly, an increase in the viscosity of ink in the sub tank 501 can be prevented by closing the ink inlet 501A and the suction port 501B. In addition, the gas-permeable member 505 is located rightward in FIG. 45 at a location some distance from the suction port 501B, so that the contact between the gas-permeable member 505 and the ink in the sub tank 501 can be avoided. Consequently, the gas-permeable member 505 can be remained intact by avoiding the long-term contact with ink. The printing head 502 being located on the home position is subjected to the recovery procedure in which the printing head 502 discharges ink that is not used in the process of printing an image, so that the condition of ejecting ink can be kept in a favorable condition. The recovery procedure includes the process of sucking and draining ink and the process of ejecting the ink. The process of sucking and draining ink comprises the step for forcing ink out of the ink eject port of the nozzle portion 502A under suction by causing negative pressure in the second cap 525 member by the suction pump 526. The process of ejecting ink comprises the step for ejecting ink from the ink eject port of the nozzle portion 502A into the second cap member 525.

Figure 46:
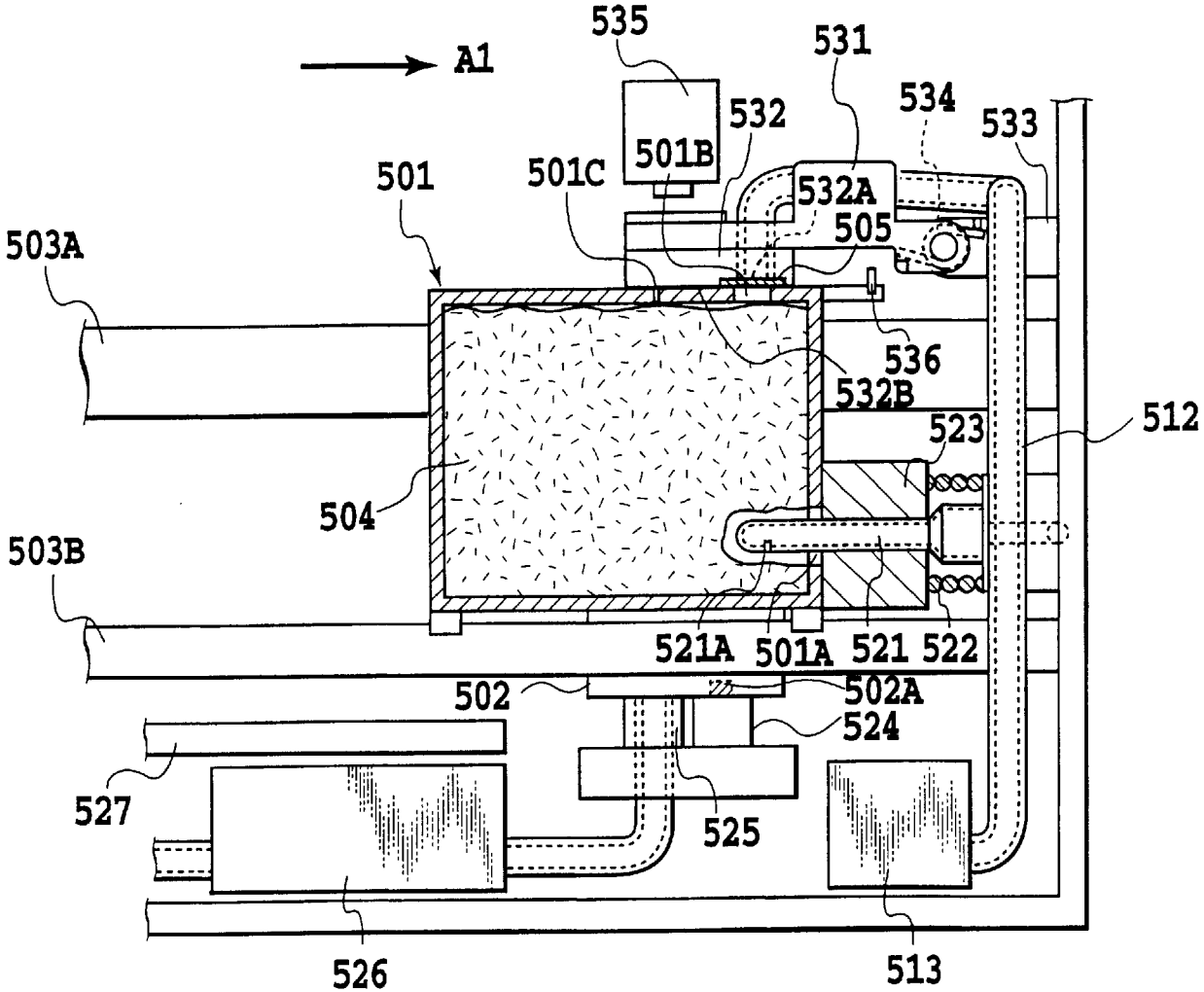
FIG. 46 is an explanation view for illustrating the condition of supplying ink to the sub-tank shown in FIG. 43.

During the action of supplying ink, as shown in FIG. 46, the printing head 502 moves from the home position to the ink-supplying position in the direction of the arrow A1. If the printing head 502 arrives at the ink-supplying position, as shown in FIG. 46, both the first and second cap members 524, 525 are raised, and then the nozzle portion 502A of the printing head 502 is capped by the first cap member 524. As a result, the cap member 524 seals the ink eject port of the nozzle portion 502A. At this time, the seal member 523 opens the through hole 521A by its relative movement with reference to the projection member 521 while keeping the ink inlet 501A in a closed state. The through hole 521A forms an ink-supplying system between the sub tank 501 and the main tank by communicating the through hole 521A with the inside of the sub tank 501. Also, the seal member 532 closes the air-communicating port 501C and then connects the opening 532A to the suction port 501B to form an air suction system between the opening 532A and the suction pump 513. The gas-permeable member 505 lies in the suction system.

On the occasion of the supply of ink, air in the sub tank 501 is aspirated by the suction pump 513 through the gas-permeable member 505 to discharge the air into a liquid waste container (not shown), causing negative pressure in the sub tank 501. Thus, ink in the main tank is introduced into the sub tank 501 under suction by an effect of the negative pressure. The ink flowing into the sub tank 501 permeates the ink absorber 504, so that a level of ink rises as the permeation of ink proceeds. The rising rate of the level of ink depends on the suction force of the suction pump 513, so that it is adjusted to an appropriate rate corresponding to the degree of actuating the suction pump 513. If the level of ink reaches to the gas-permeable member 505, the supply of ink is automatically stopped because liquid such as ink cannot pass through the gas-permeable member 505. In addition, the supply of ink is concurrently performed on the ink-storage portions 501C, 501M, 501Y, and 501B, so that the supply of ink to each of the reserve ink tanks 20Y, 20M, 20C, and 20K is stopped by the gas-permeable member 505 in order of being filled up with ink.

After completing such an action of supplying ink, the printing apparatus is recovered to its original state as shown FIG. 45 or FIG. 43 by returning the printing head 502 to its home position or its position of starting the printing movement.

By the way, the blade 536 touches the bottom surface of the seal member 532 in accordance with the movement of the sub tank 501, as indicated by a two-short dashed line in FIG. 43, so that the blade 536 wipes the bottom surface of the seal member 532 including the gas-permeable member 505 while the arm member 531 is turned up and down. The wiping operation removes undesired materials such as thickened ink being adhered on the gas-permeable member 505, the opening 532, and the seal member 532, so that they can be kept in good conditions.

Fourteenth Preferred Embodiment

Figure 47:
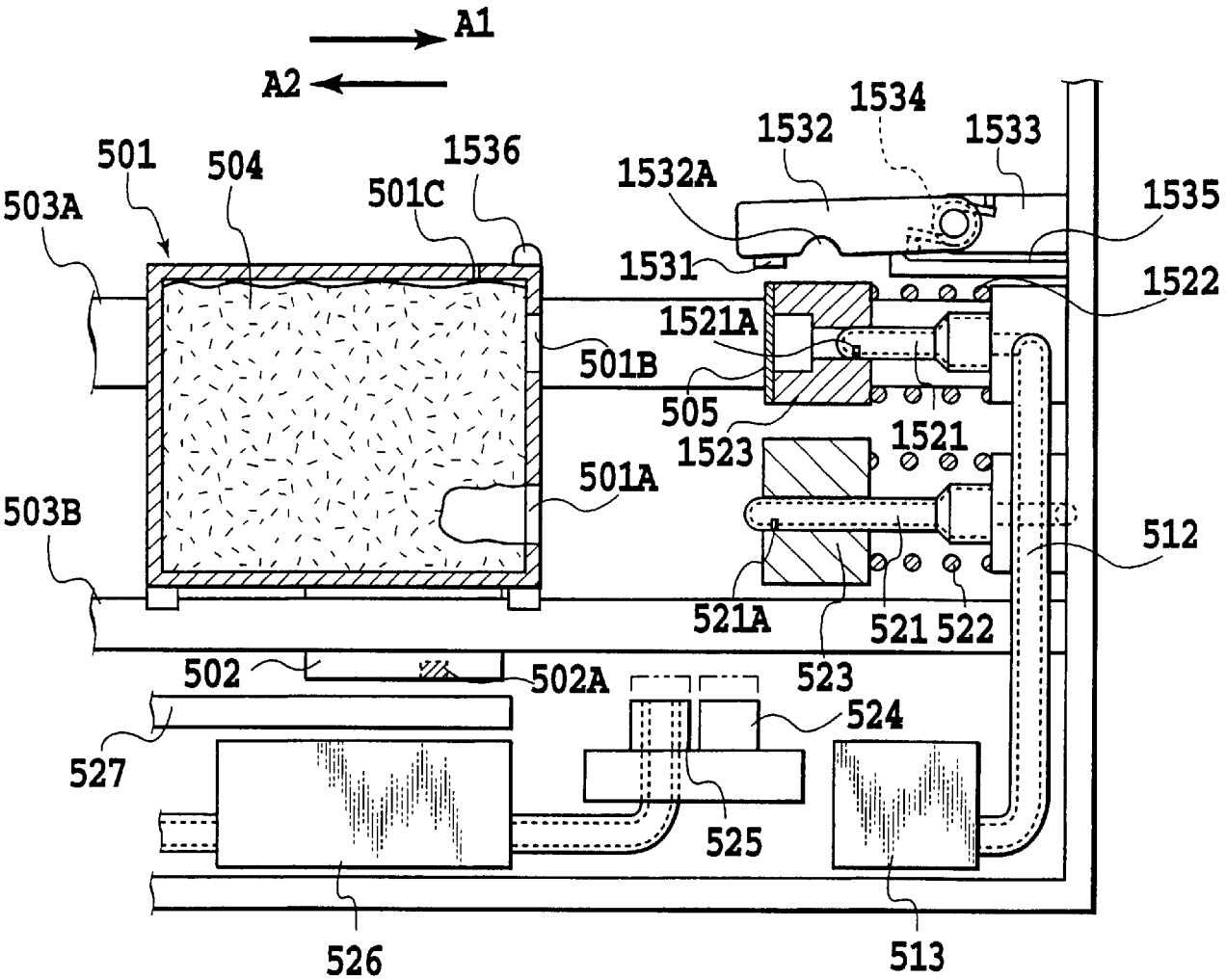
FIG. 47 is a cross sectional view of a main part for illustrating the fourteenth embodiment of the present invention.
Figure 48:
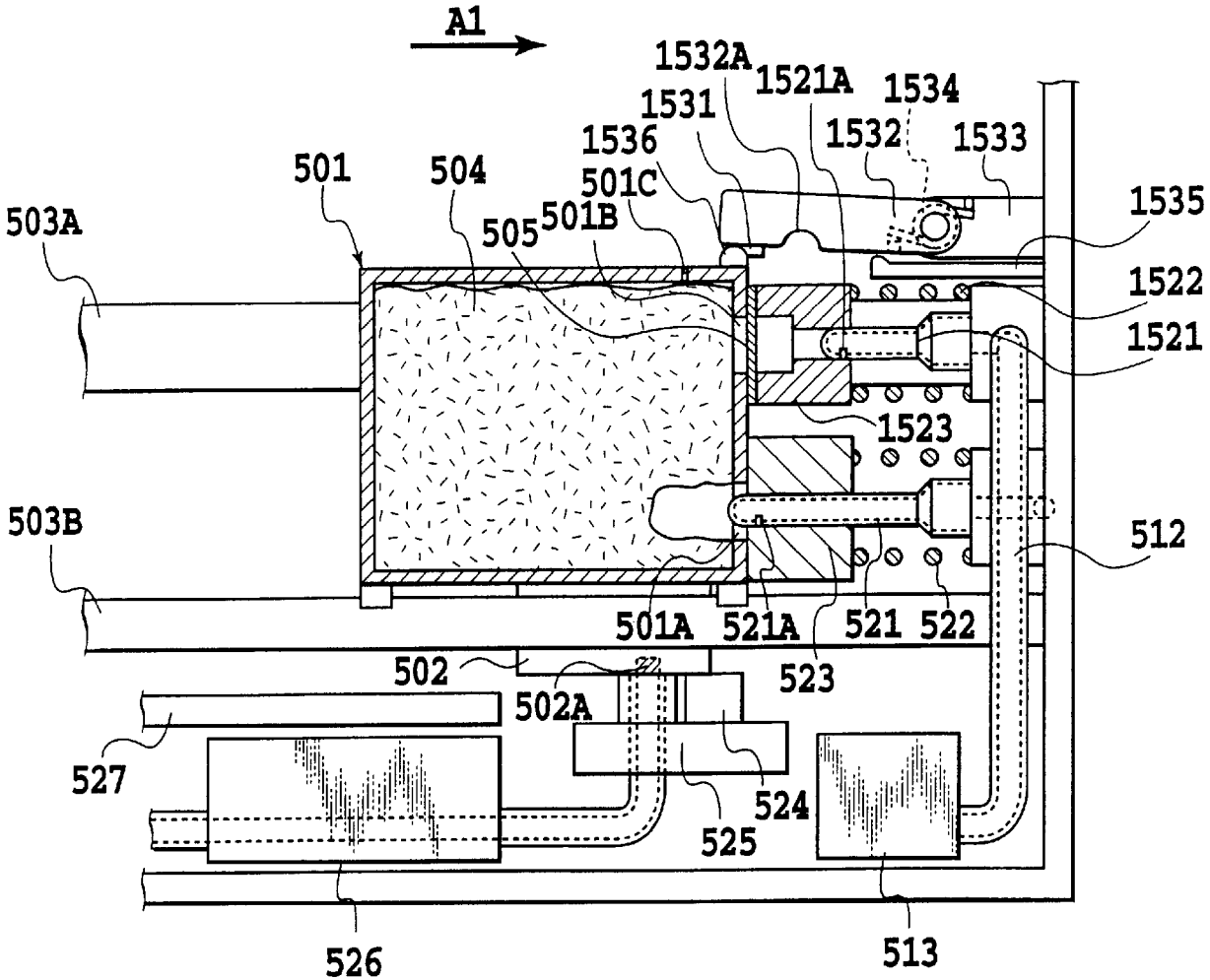
FIG. 48 is an explanation view for illustrating the condition of the printing head of FIG. 47 being capped.
Figure 49:
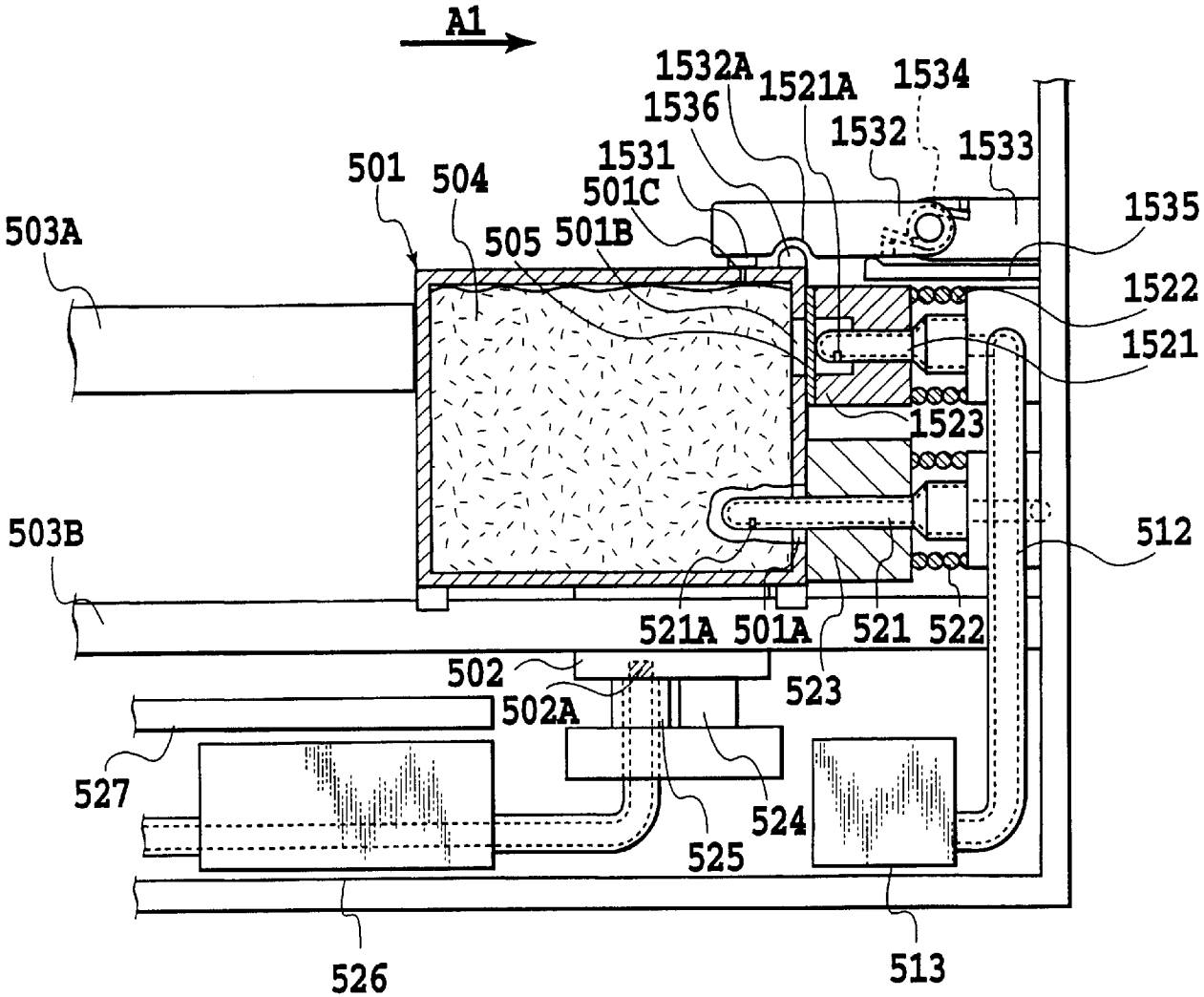
FIG. 49 is an explanation view for illustrating the condition of supplying ink to the sub-tank shown in FIG. 47.

FIGS. 47 to 49 are explanatory view for illustrating the fourteenth preferred embodiment of the present invention. An explanation for the some reference numerals as those of the thirteenth preferred embodiment will be omitted in the following description.

In these figures, the reference numeral 1521 denotes a projected hollow member formed on the main body's side of the printing apparatus. In addition, a seal member 1523 is coaxially fitted over an outer peripheral surface of the projected member 1521 so that the seal member 1523 is able to slide over the surface. Furthermore, a spring 1522 is also fitted over the outer peripheral surface of the projected member 1521 so that it pushes the seal member 1523 leftward. A through hole 1521A is formed on the peripheral surface of the projected member 1521, which is opened or closed by the seal member 1523. The tip of the projected member 1521 is being closed, while the base thereof is connected to a main tank (not shown). A gas-permeable member is placed in a opening of the seal member 1523.

The reference numeral 1531 denotes a seal member which is able to close the air-communicating port 501C of the sub tank 501. The seal member 1531 is mounted on the tip portion of an arm member 1532. A base portion of the arm member 1532 is supported by a support member 1533 so as to turn up and down and downwardly spring-loaded by a spring 1534, where the support member 1533 is placed on the side of the main body of the printing apparatus. The reference numeral 1535 denotes a stopper member that regulates the position of downward movement of the arm member 1532. The reference numeral 1536 denotes a projection portion formed on the sub tank 501. The projection portion 1536 actuates the arm member 1532 up and down in response to the location of the sub tank 501 being moved. As shown in the figure, the arm member 1532 has a recess 1532A in which the projection portion 1536 can be slipped.

In the present embodiment, the seal member 1523 closes the suction port 501B when the printing head 502 is located at its home position as shown in FIG. 48. If the printing head 502 arrives at the ink-supplying position, as shown in FIG. 49, an air suction system is formed through the gas-permeating member 505 and the through hole 1521A, while the air-communicating port 501C is closed by the seal member 1531. In this case, by the way, the longitudinal length of the protruded member 1521 is adjusted so that it is not inserted into the sub tank 501.

Fifteenth Preferred Embodiment

Figure 50:
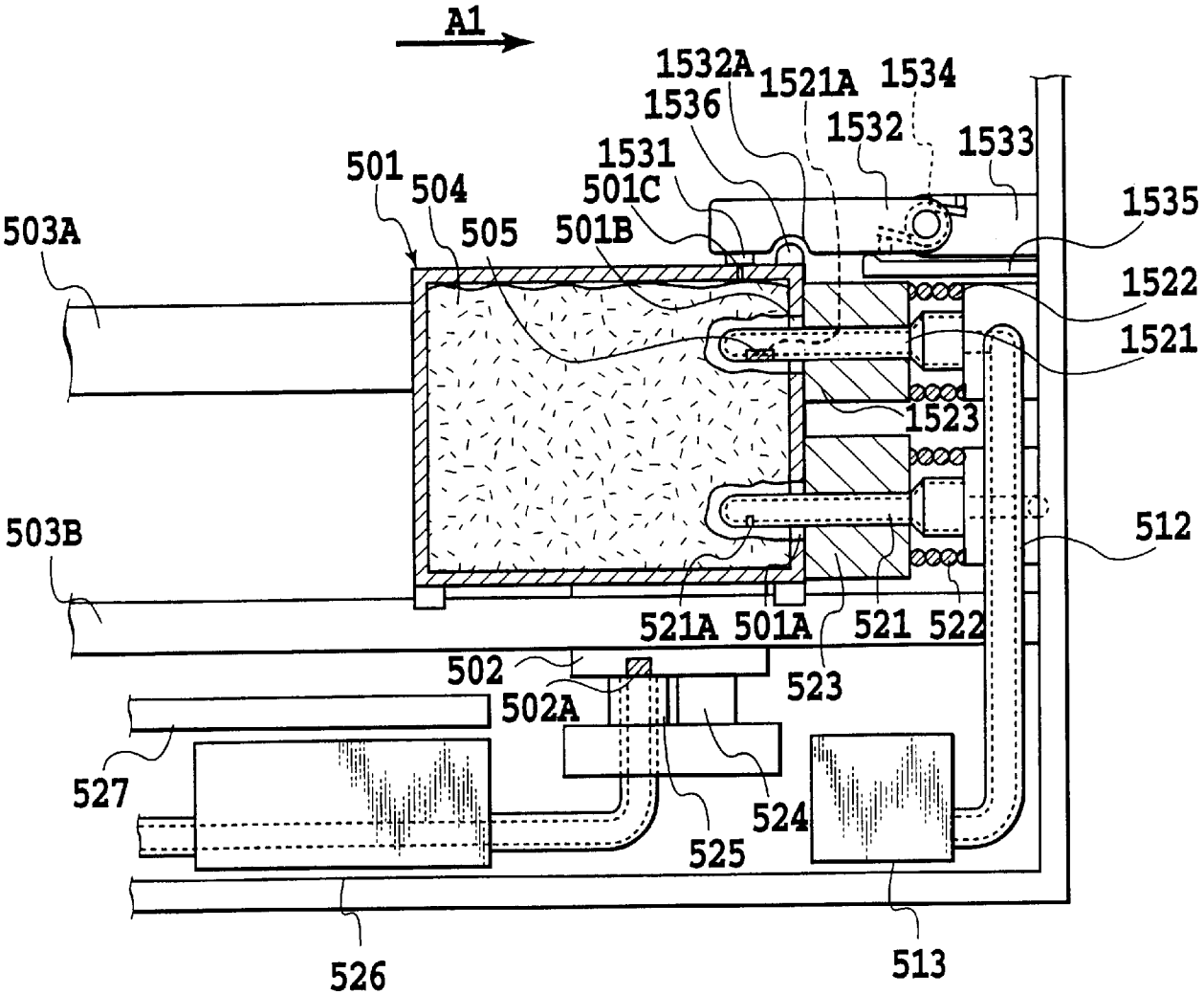
FIG. 50 is a cross sectional view of the main part for illustrating the fifteenth embodiment of the present invention.

FIG. 50 is an explanatory view for illustrating a fifteenth preferred embodiment of the present invention.

In this embodiment, the length of the protruded member 1521 as described in the fourteenth preferred embodiment is comparatively long enough to insert its tip into the sub tank 501 at the time of supplying ink. In addition, the gas-permeable member 505 is placed in opening of the through hole 1521A of the protruded member 1521. Thus, an air suction system is formed through the gas-permeable member 505 when the tip of the protruded member 1521 is inserted into the sub tank 501.

Sixteenth Preferred Embodiment

In this embodiment, the shape or characteristics of the gas-permeable member 505 is altered according to the capacity of the sub tank 501 or the type of ink to be retained in the sub tank 501.

For example, it is possible to provide a porous body as a gas-permeable member 505 and make a change in its own characteristics and shape so as to alter the negative pressure to be caused in the sub tank 501 according to the capacity of the sub tank 501 having the gas-permeable member 505 or the type of ink to be retained in the sub tank 501. Concretely, the thickness of the gas-permeable member 505 is modified so as to have a different pore size or a thickness thereof. Also, a space of the through hole 49 to be occupied by the gas-permeable member 505 may be changed, while the dimension of the gas-permeable member 505 may be changed so as to be fit to the modified space. The space to be occupied by the gas-permeable member 505 may be adjustable by providing an adjustable displacement cover on the gas-permeable member 505.

Accordingly, the rate of supplying ink to each sub tank 501 can be adjusted by making a change in the negative pressure in the sub tank 501. If the sub tank 501 stores ink having a large flow resistance or having a large ink capacity is used, a gas-permeable member 505 may be selected so as to establish large negative pressure in the sub tank 501. Therefore, the supply of ink can be effectively performed on a plurality of sub tanks 501.

Concretely, the characteristics of the gas-permeable member 505 can be optimally adjusted using parameters such as the thickness of the gas-permeable member 505 is modified so as to have a different pore size or a thickness of the gas-permeable member 505 or an opening area of the ventilation path 49. In addition, the physical properties (e.g., air permeability) of the gas-permeable member 505 may be also modified.

Eighteenth Preferred Embodiment

FIGS. 51 to 57 are explanatory views for illustrating an eighteenth preferred embodiment of the present invention.

Figure 51:
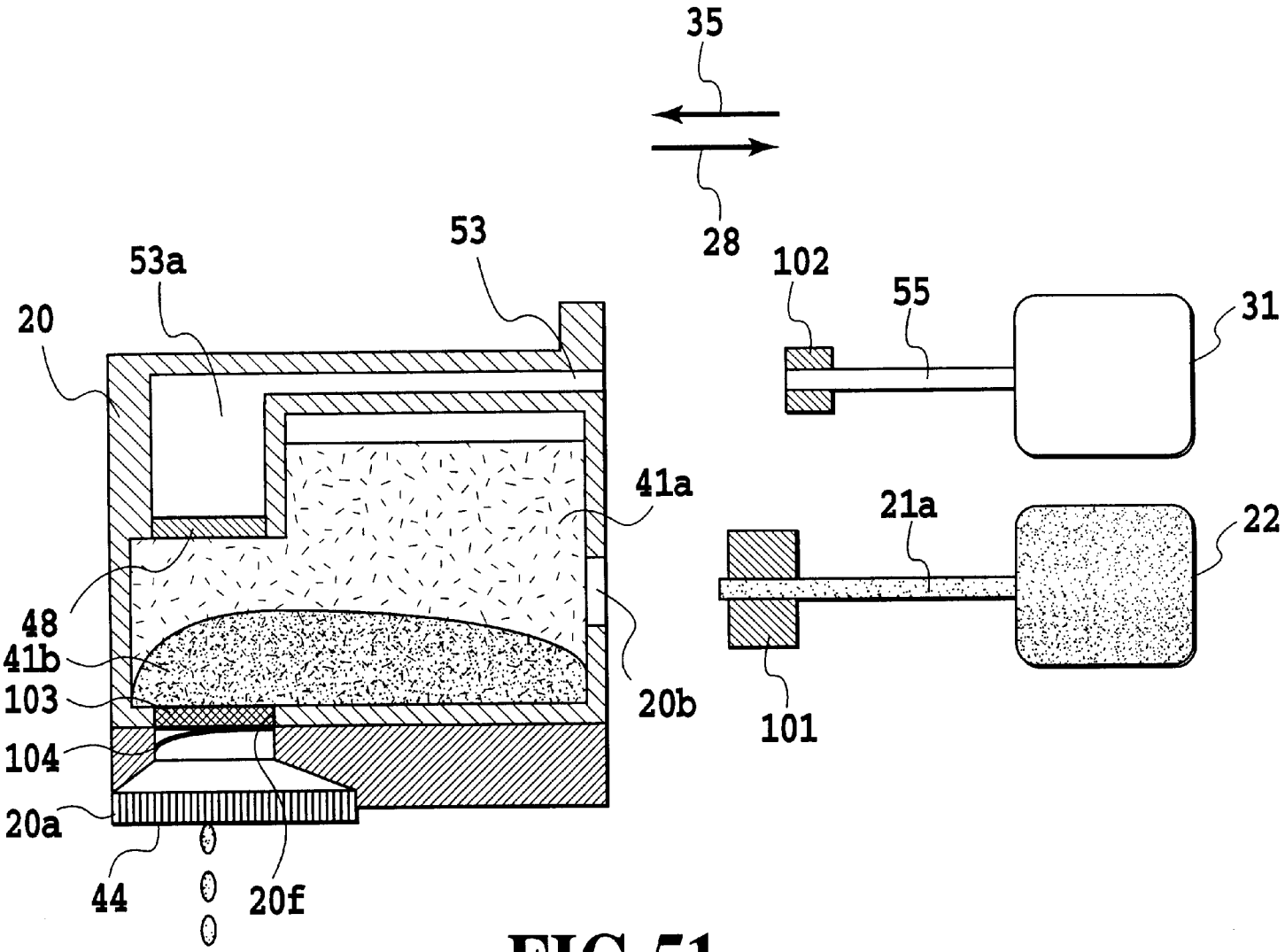
FIG. 51 is a schematic structural view of the main part of the ink-jet printing head in accordance with the eighteenth embodiment of the present invention.

In FIG. 51, the reference numeral 20 denotes a reserve ink tank (sub ink tank), and 20*a* denotes an ink-jet printing head that is able to eject ink. They are removably mounted on a carriage (not shown) in a serial-scanning type ink-jet printing apparatus. The printing head 20*a* ejects ink from ink eject ports of the nozzles 44 in accordance with image information, where the ink is supplied from the reserve ink tank 20. The reference numeral 20*f* denotes a supply port of the reserve ink tank 20 for supplying ink from the tank 20 to the head 20*a*. Each nozzle 44 has a means of generating energy for ink eject. In this embodiment, an electrothermal converter may be used as such an eject-energy generating means. The carriage is moved by a transfer mechanism in the direction of the arrow 28 or 35 (i.e., the main-scanning direction). A printing medium is transferred by a transfer mechanism in the direction, i.e., sub-scanning direction) perpendicular to the main-scanning direction. Accordingly, an image can be successively formed by repeating the main-scanning movement of the carriage having the printing head 20*a* and the-ink tank 20 and the sub-scanning movement of the printing medium.

A suction port 523 and an ink inlet 20*b* are formed on the side of the reserve ink tank 20. The suction port 53 communicates with the inside of the reserve ink tank 20 through a suction passage 53*a*. A gas-permeable member 48 is installed in an opening of the suction passage 53*a* in the reserve ink tank 20. The gas-permeable member 48 is provided as a means of separating gas and liquid, which permeates air but ink. The gas-permeable member 48 may be of a thin-sheet type and made of a tetrafluoride ethylene resin or other porous resin materials. In addition, an ink absorber 41*a* is placed in the reserve ink tank 20 for retaining ink by absorption.

Figure 57B:
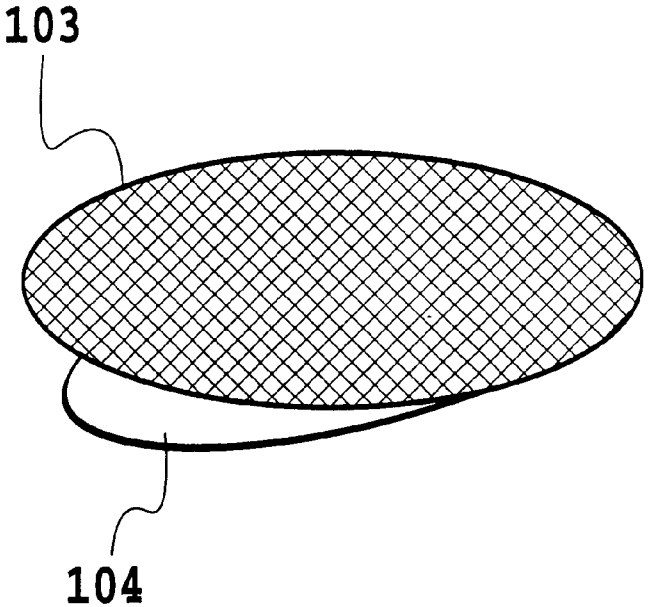
FIG. 57B is a perspective view that illustrates the valve and the filter are combined together.
Figure 57A:
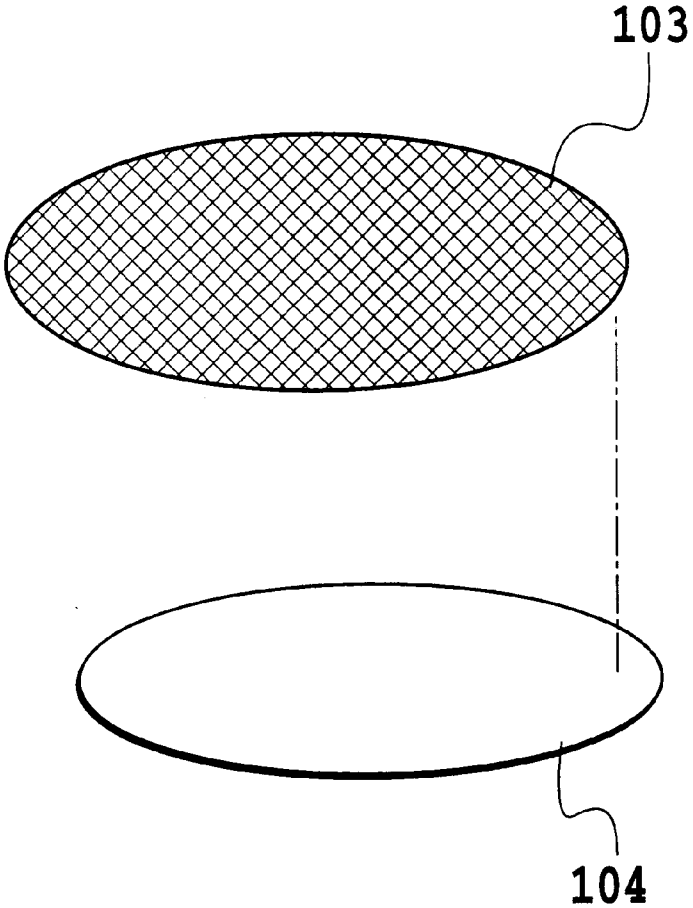

In the supply port 20*f*, a filter 103 and a valve 104 are provided. In this embodiment, the valve 104 is in a sheet shape as shown in FIG. 57A and FIG. 57B. The base portion of the valve 104 is bound to the filter 103 by applying heat. As described later, the valve 104 opens and closes the supply port 20*f* in response to an inner pressure of the reserve ink tank 20. The valve 104 may be made of a low-density compound or the like such as polyethylene (PE), polyvinylidene fluoride (PVDF), polyvinylidene (PVDC), polyethylenevinyl alcohol (PEVOH), polyethylene terephthalate, or mixtures thereof.

The reference numeral 101 denotes a supply joint connectable to the ink inlet 20*b* of the reserve ink tank 20. The supply joint 101 is connected to a main tank 22 on the body's side of the printing apparatus through a tube 21*a*. The reference numeral 102 denotes a suction joint connectable to a suction port 53. The suction joint 102 is connected to a suction pump 31 through a conduit 55. The joints 101, 102 are provided on the body's side of the printing apparatus so that they face to the ink inlet 20*b* and the suction port 53 in the direction that the carriage performs its scanning movement.

During the printing movement, as shown in FIG. 51, the valve 104 is being opened, so that ink is supplied from the reserve ink tank 20 to the printing head 20*a*.

FIGS. 52 to 56 are explanatory views that illustrate the action of supplying ink from a main ink tank 22 to the reserve ink tank 20.

Figure 52:
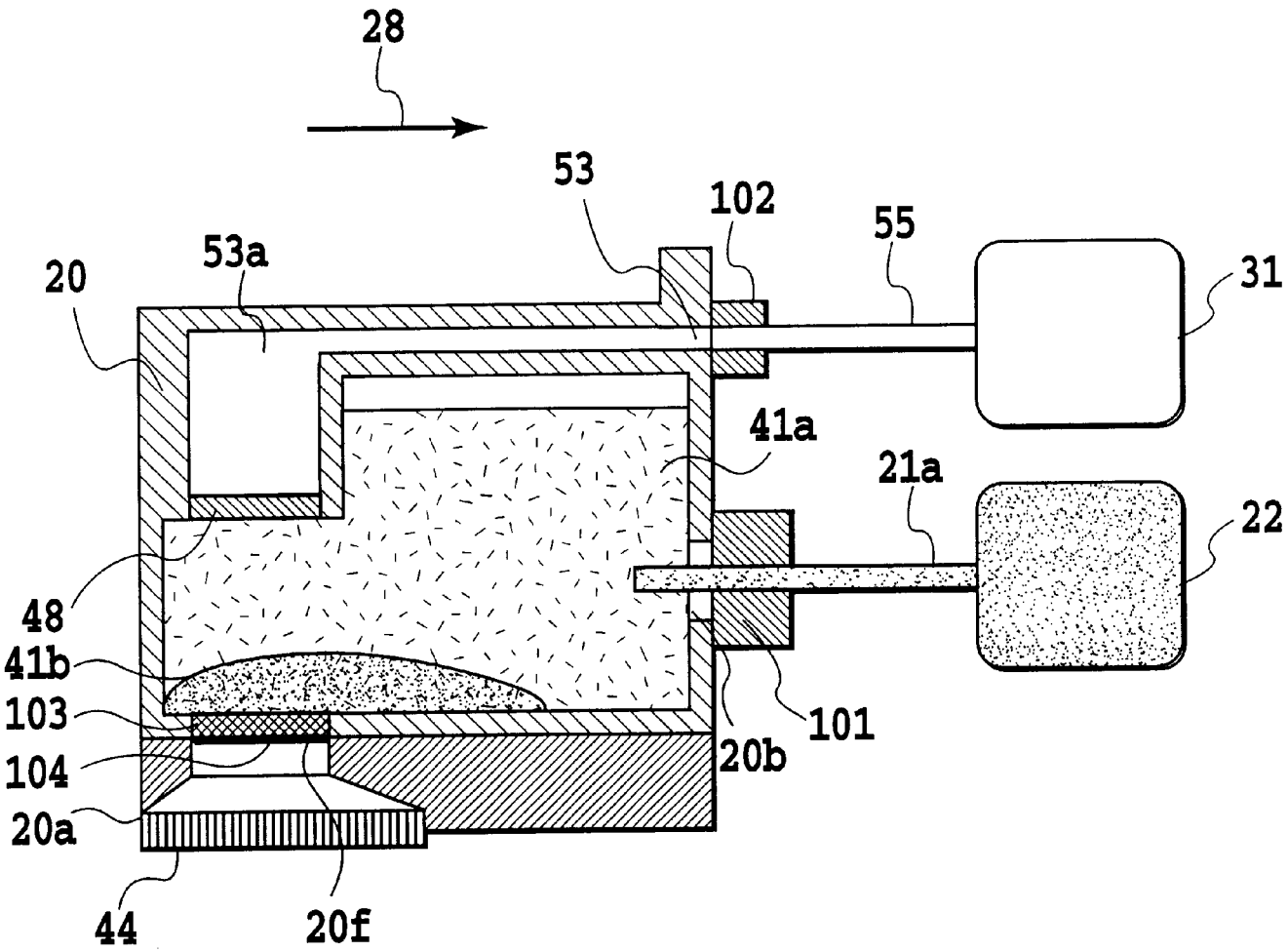
FIG. 52 is an explanation view for illustrating the connection between the reserve ink tank and the ink-supplying system shown in FIG. 51.

At the time of supplying ink, at first, the carriage moves in the direction of the arrow 28 to connect the ink inlet 20*b* and the suction port 53 to the joints 101, 102 respectively, as shown in FIG. 52. Then, air in there serve ink tank 20 is aspirated by the suction of the suction pump 31 through the gas-permeable member 48, resulting in negative pressure in the reserve ink tank 20. The negative pressure in the reserve ink tank 20 allows that ink in the main ink tank 22 is aspirated into the reserve ink tank 20 as shown in FIG. 53 and FIG. 54.

Figure 53:
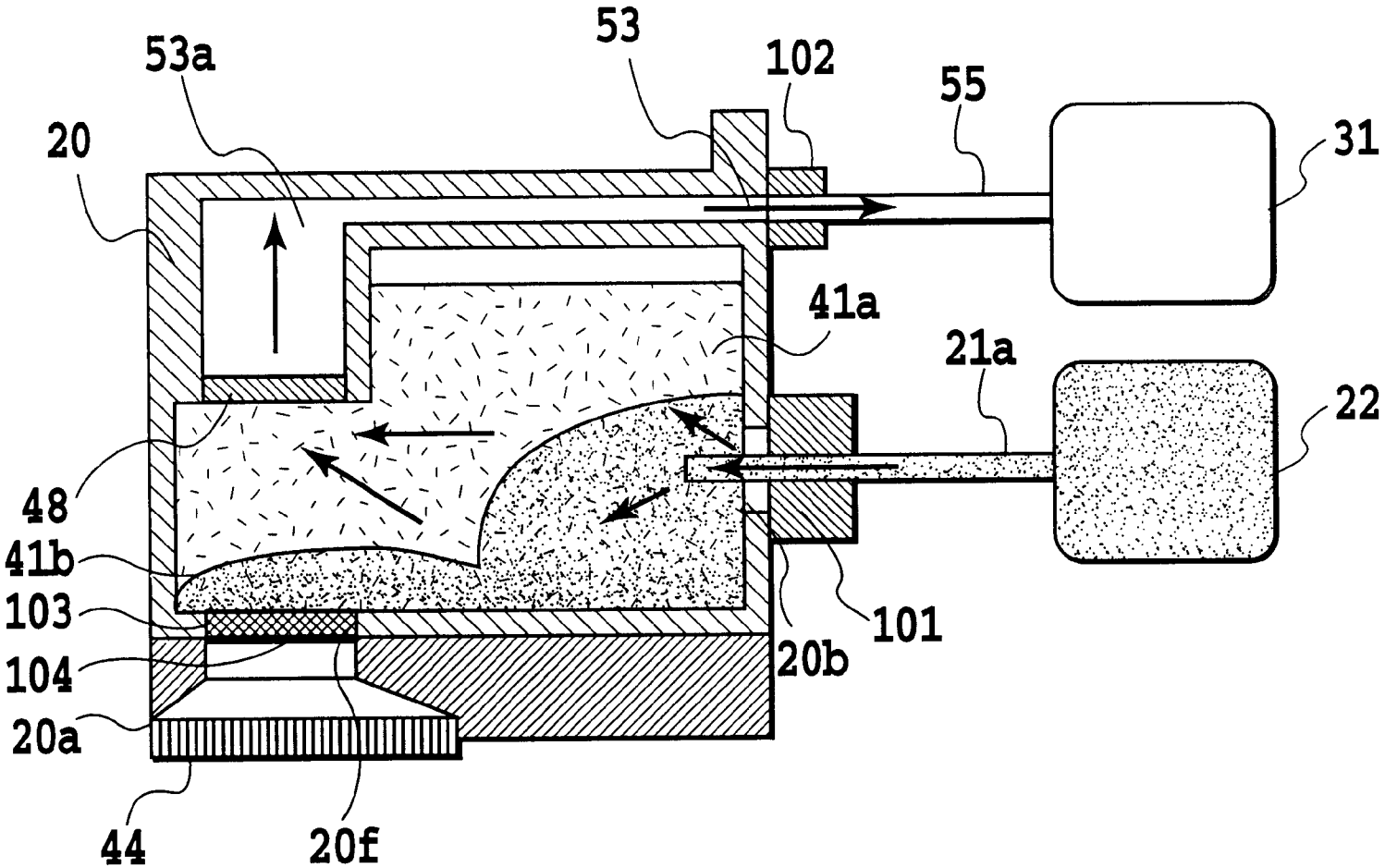
FIG. 53 is an explanation view for illustrating the condition of half way through the supply of ink by the ink-supplying system shown in FIG. 51.
Figure 54:
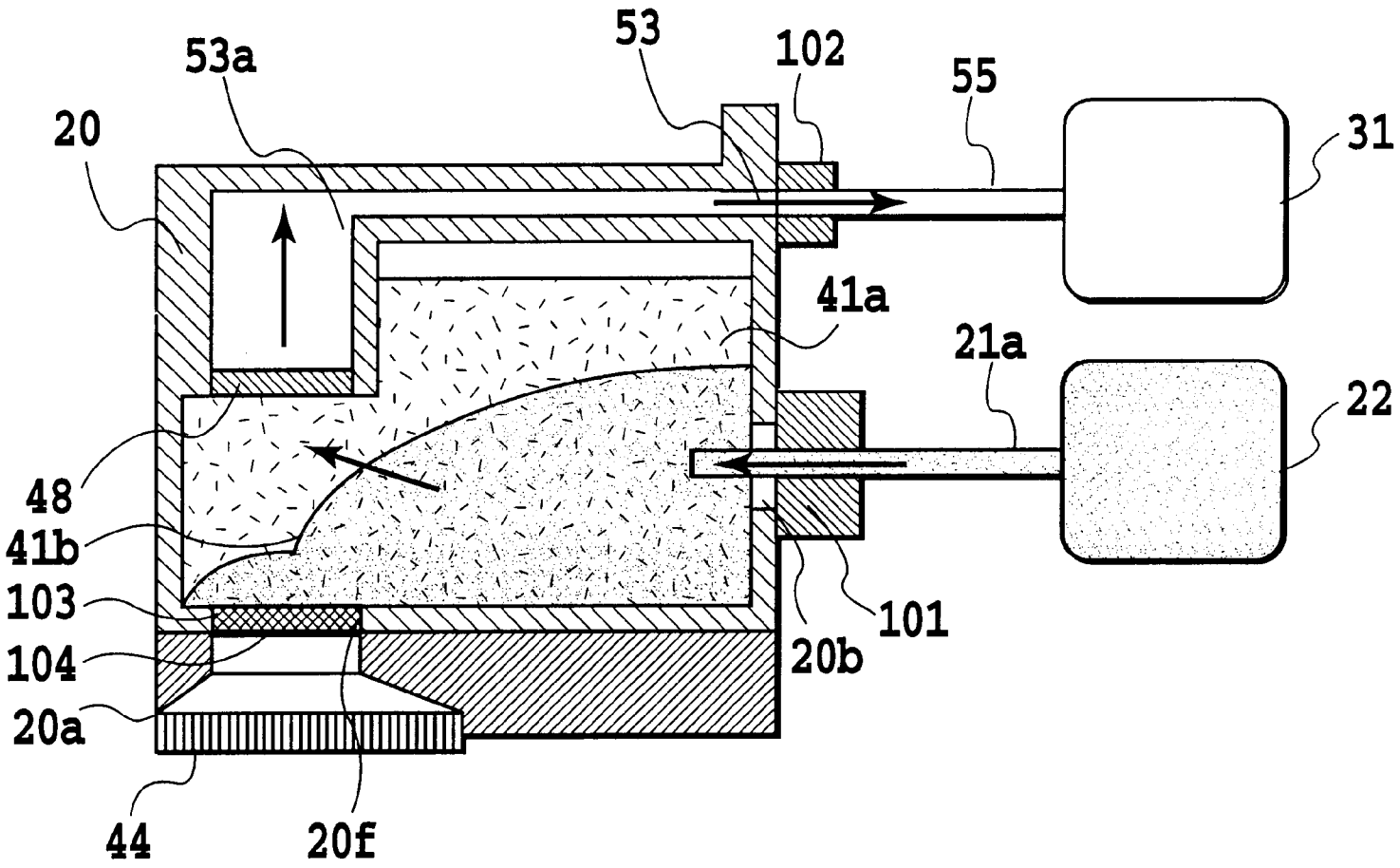
FIG. 54 is an explanation view for illustrating the condition of half way through the supply of ink by the ink-supplying system shown in FIG. 51.

On that occasion, as shown in FIG. 53 and FIG. 54, the valve 104 closes the supply port 20*f* under the influence of the negative pressure in the reserve ink tank 20. Therefore, ink in the printing head 29*a* is not aspirated into the reserve ink tank 20, so that ink meniscus formed on each ink eject port remains intact. In addition, there is no air introduced into the printing head 29*a* and the reserve ink tank 20 from the ink eject ports. As a result, ink can be supplied by suction into the reserve ink tank 20 with reliability.

Figure 55:
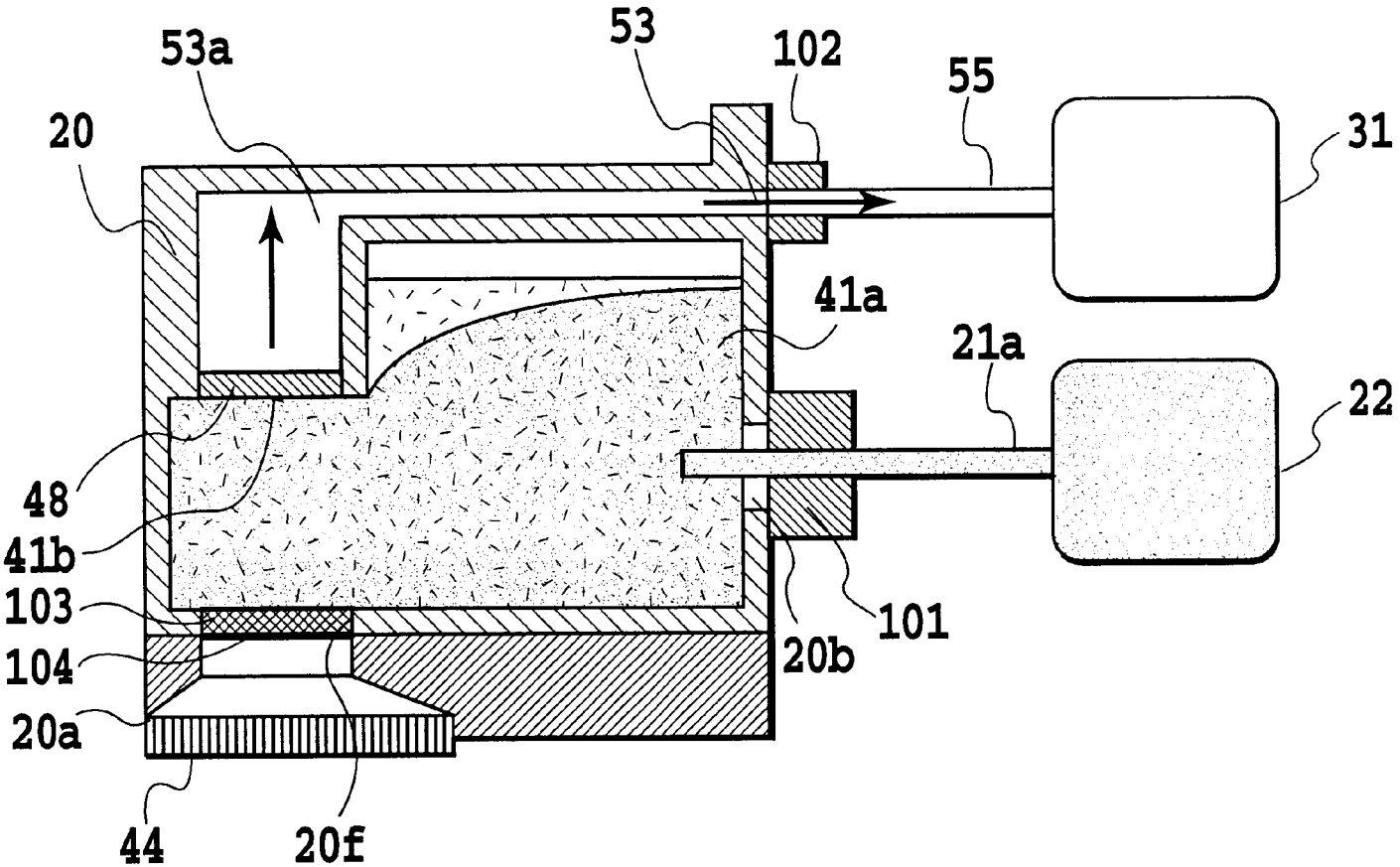
FIG. 55 is an explanation view for illustrating the condition in which the supply of ink is suspended by the ink-supplying system shown in FIG. 51.
Figure 56:
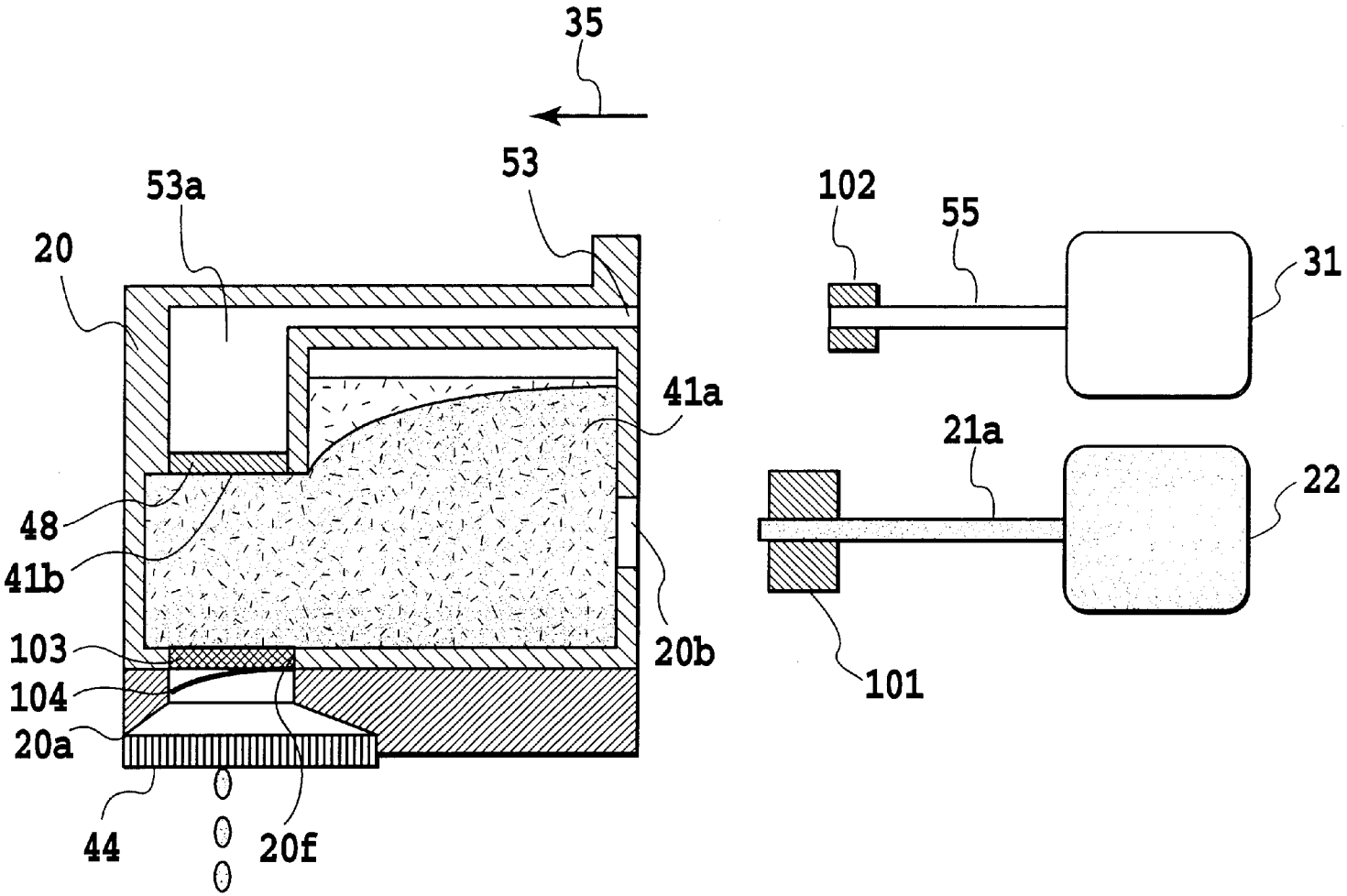
FIG. 56 is an explanation view for illustrating the operation of the ink-supplying system shown in FIG. 51 after completing the supply of ink.

If the level 41*b* of ink in the reserve ink tank 20 reaches the gas-permeable member 48, as shown in FIG. 55, the supply of ink under suction can be automatically stopped as consequence of the impermeability of the gas-permeable member 48 in respect to a liquid such as ink. After that, as shown in FIG. 56, the movement of the carriage 19 in the direction of the arrow 35 disengages the ink inlet 20*b* and the suction port 53 from the respective joints 101, 102 to complete a series of the motions of ink-supply.

By the way, the response of the valve 106 for opening and closing is adjusted in consideration of the negative pressure to be required to form ink meniscus on the ink eject port. If negative pressure caused in the reserve ink tank is larger than the one to be required to form ink meniscus on the ink eject port, the valve 104 is adjusted to close the supply port 20*f* to prevents that the negative pressure is excessively exerted on the printing head 2*a*.

Nineteenth Preferred Embodiment

Figure 58B:
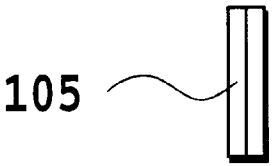
FIG. 58B is a plan view of such a valve.
Figure 58A:
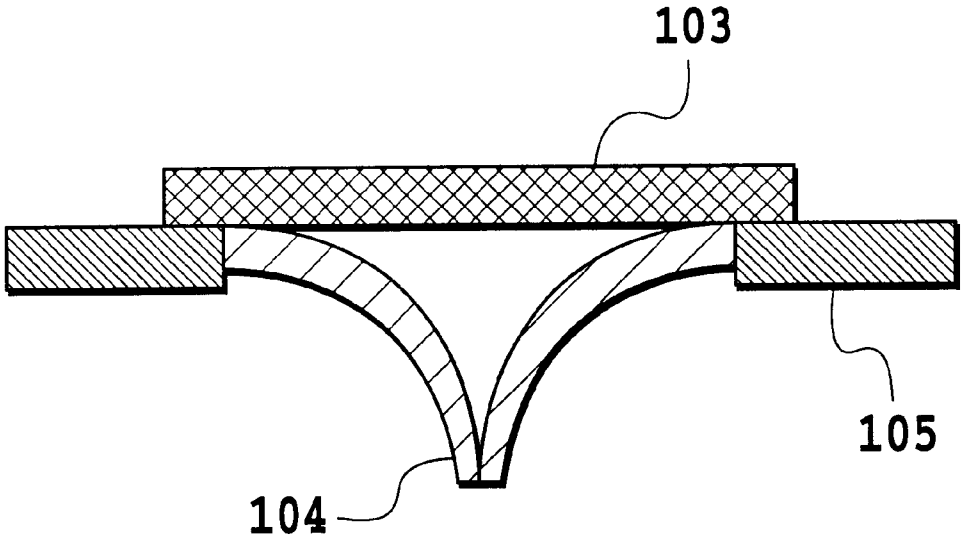

FIGS. 58A and 58B are explanatory views that illustrate another configuration of valve 104.

In this embodiment, a valve 104 is configured as a so-called dug-hill valve that only allows the flow of a fluid from the top to the bottom in FIG. 58A. The valve 104 is housed in housing 105 together with the filter 103.

The valve 104 may be available in any configuration, so that it is not limited to the above embodiment. In the eighteenth and nineteenth embodiments, the gas-permeable member 48 is not always required. The reserve ink tank 20 may be provided in other configurations in addition to the configuration in which it moves together with the printing head 20*a*. The reserve ink tank 20 may be also used in other various printing systems of the printing apparatus. In these cases, for example, the reserve ink tank 20 may be installed in a predetermined position in the printing apparatus.

Furthermore, the reserve ink tank 20 may be detachably or permanently connected to the printing head 20*a* to form an ink-jet cartridge. The valve 104 may be installed in either the reserve ink tank 20 or the printing head 20*a*. It is essential only that the valve 104 be positioned in the ink-supplying path between them. If the valve 104 is installed in the printing head 20*a*, the valve 104 is placed in a connection port on the side of the printing head 20 to be connected to the supply port 20*f* of the reserve ink tank 20.

Twentieth Preferred Embodiment

Figure 59:
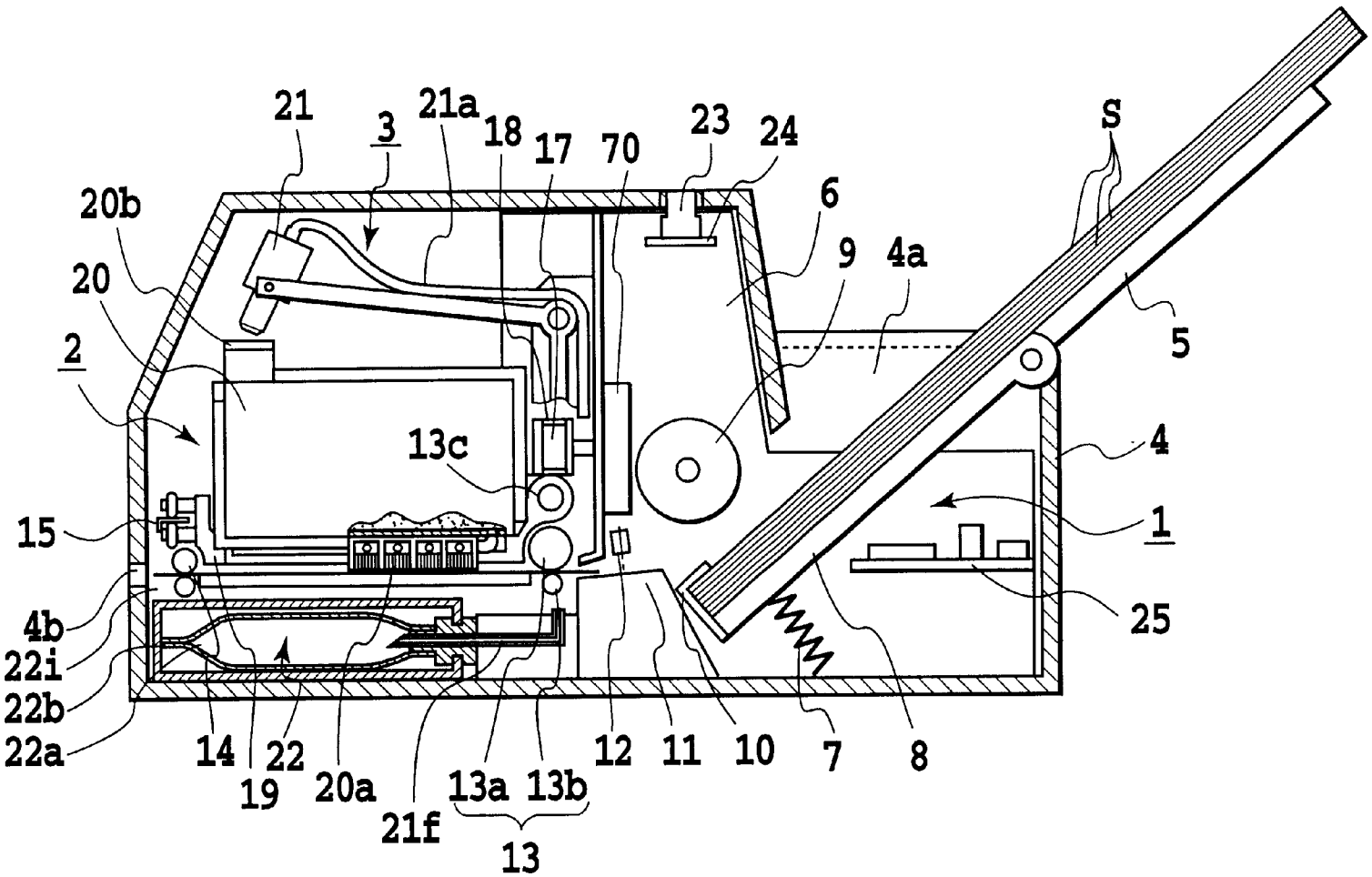
FIG. 59 is a cross sectional view of the printing apparatus in accordance with the twentieth embodiment of the present invention.
Figure 60:
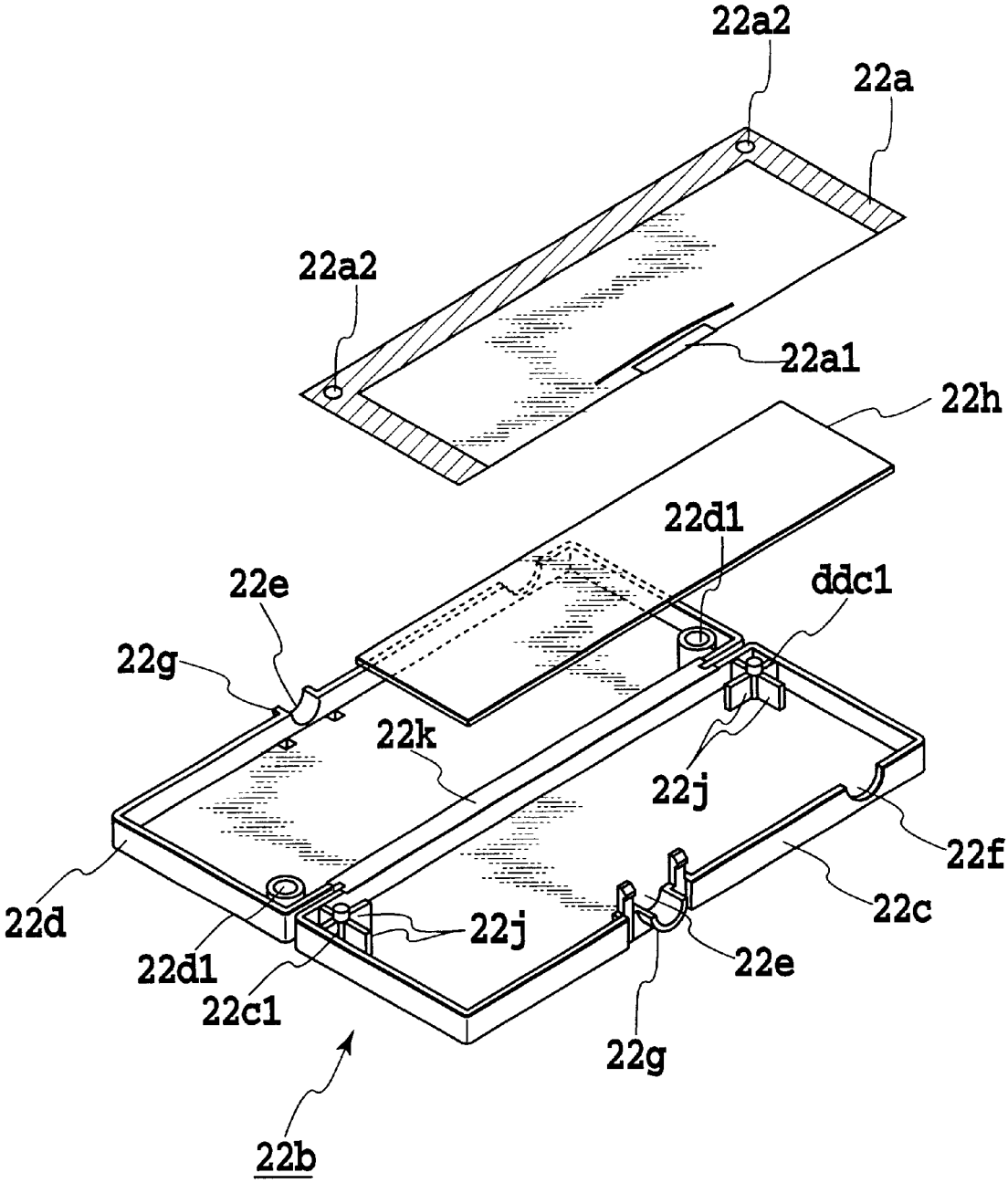
FIG. 60 is an exploded perspective view of the ink tank shown in FIG. 59.
Figure 61:
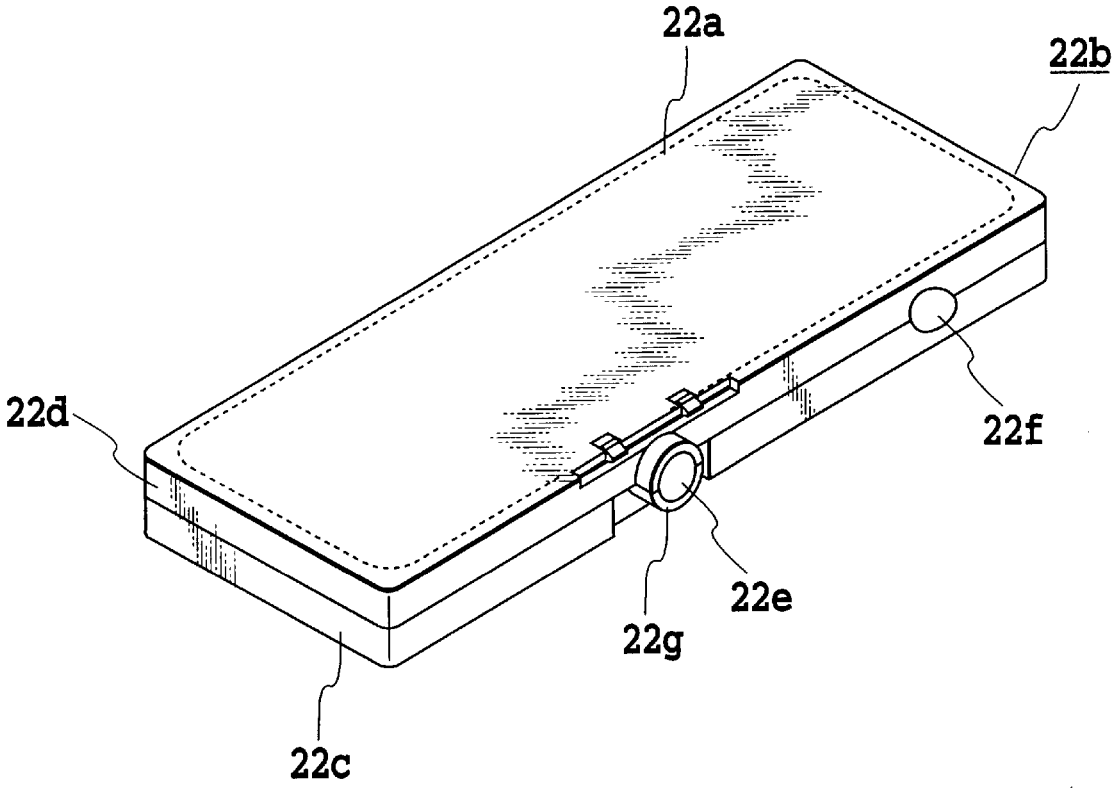
FIG. 61 is a perspective view of the ink tank shown in FIG. 59.

FIGS. 59 to 61 are explanatory views that illustrate a twentieth preferred embodiment of the present invention. In the present embodiment, the configuration of a printing apparatus is the same as that of the first preferred embodiment except the configuration of the ink-supplying device portion 3.

An ink-supplying device portion 3 of the present embodiment is configures as follows.

C. [Configuration of the Ink-supplying Device Portion 3]

In the ink-supplying device portion 3, the reference numeral 21 denotes a means for supplying ink, which communicates with the supplementary ink tank 22 through the tube 21*a* and a refill pipe 21*f* provided as a hollow cylinder. This ink-supplying means 21 replenishes ink of the supplementary ink tank 22 into the reserve ink tank 20 by tightly connecting to the ink inlet 20*b* of the reserve ink tank 20.

C-1. [Supplementary Ink Tank]

As shown in FIG. 60, the supplementary ink tank 22 comprises an ink bag 22*a* filed with ink and a tank case 22*b*.

The ink bag 22*a* is made of a sheet of a soft film or the like that is folded down in one side so that one part lies on another part and three sides except the folding part are bound together by heat to form an almost "U"-shaped bonded area represented by hatch lines in the figure. The folding part of the bag 22 is labeled with a seal member 22*a*1 made of an elastic material such as rubber. Both corners of the side opposite to the folding part have locating holes 22*a*2.

The tank case 22*b* comprises a first tank case 22*c* and a second tank case 22*d*, which is shaped like a flat rectangular box with a small thickness.

The first case 22*c* is shaped like a flat rectangle that is greatly opened upward in Figure. In the bottom of the first case 22*c*, protrusions 22*c*1 are protruded from the positions near the respective peripheral portions of the longitudinal side of the first case 22*c*. In addition, locating projections 22*j* are formed on the lower peripheral surface of each protrusion 22*c*1. In the opposite longitudinal side of the first case 22*c*, two grooves in a semicircular shape are formed on different positions. One forms a needle-inserting hole 22*e* and the other forms an ink-outlet 22*f*.

The second case 22*d* is also shaped like a flat rectangle just as in the case of the first case 22*c*. In the bottom of the first case 22*c*, recessed portions 22*d*1 in the shape of cylinder are protruded from the positions near the respective peripheral portions of the longitudinal side of the second case 22*d*. In the opposite longitudinal side of the second case 22*d*, two grooves in a semicircular shape are formed on different positions. One forms a needle-inserting hole 22*e* and the other forms an ink-outlet 22*f*.

The protrusions 22*c*1 of the first case 22*c* are engaged with the respective recessed portions 22*d*1 to bind them together. Therefore, the needle-inserting hole 22*e* and the ink-outlet 22*f* are formed as circular openings, respectively. The fist and second cases 22*c*, 22*d* may be molded in one piece with an integral hinge 22*k* or formed as separated parts being attached together by a hinge 22*k* so as to be opened and closed repeatedly. A locking hook 221 on the side of the first case 22*c* and a locking hole 22*m* on the side of the second case 22*d* are able to fitted together to close and lock the cases 22*c*, 22*d* as shown in FIG. 61. A needle-passage 22*g* is also formed by a portion that is externally protruded through the opening of the needle-inserting hole 22*e*.

An ink-draining sheet 22*h* made of felt or the like with the ability of retaining a liquid such as ink is installed in the tank case 22*b* in addition to the ink bag 22*a*. The ink-draining sheet 22*h* absorbs ink leaked in the inside of the case to avoid the leakage of ink to the outside of the case. An excess amount of ink that is not absorbed by the ink-draining sheet 22*h* is discharged from the ink outlet 22*f*.

The ink bag 22*a* and the ink-draining sheet 22*h* are placed in the case as follows.

When the tank case 22*b* is installed in the body of the printing apparatus, the first case 22*c* to be positioned on the bottom side is coated with the ink-draining sheet 33*h*. The ink bag 22*a* is placed on the ink-draining sheet 33*h* and then the locating holes 22*a*2 of the ink bag 22*a* are fitted with the respective protrusions 22*c*1 of the first case 22*c*. Thus, the ink bag 22*a* is placed in the tank case 22*b* with precision. Furthermore, the first and second cases 22*c*, 22*d* are closed and joined together. Consequently, the peripheral portions of the ink bag 22*a* are sandwiched between the locating projections 22*j* of the first case 22*c* and the inner surface of the second case 22*d* to prevent them from slipping in the tank case 22*b*. Therefore, the ink log 22*a* is placed together the ink-draining sheet in the tank case with precision. In addition, the seal member 22*a*1 is labeled on the folding portion of the ink bag 22*a* in advance, so that the seal member 22*a*1 is pressed against the needle-inserting hole 22*e* at the time of seating the ink bag 22*a* in the tank case 22*b*.

FIG. 61 is a perspective view of the tank case 22*b* in which the ink bag 22*a* is fitted. The tank case 22*b* can be provided as the supplementary ink tank 22 that can be removably installed on the printing apparatus. For example, as shown in FIG. 59, the printing apparatus has an opening 22*i* for loading and unloading the supplementary ink tank 22.

C-2. [Ink-supply Means]

The ink-supplying means 21 connects the reserve ink tank 20 to the supplementary ink tank 22 through the tube 21*a* and the refill conduit 21*f* so that ink flows between them.

The ink-supplying means 21 is connected to the supplementary ink tank 22 by the following procedures.

As shown in FIG. 59, the refill conduit 21*f* of the ink-supplying means is provided as a hollow conduit having a needle-like tip portion. In the refill conduit 21*f*, the need-like tip portion is placed so as to face the opening 22*i* while a base portion is connected to the tube 21*a*.

The supplementary ink tank 2 is installed in the printing apparatus through the opening 22*i* so as to place the needle-inserting hole 22*e* in front of the refill conduit 21*f*. If the supplementary ink tank 22 is forced into the opening 22*i* (i.e., forced in the direction from left to right in FIG. 59), the refill conduit is inserted into the supplementary ink tank 22 through the needle-inserting hole 22*e*. Subsequently, the needle-like tip portion of the refill conduit 21*f* penetrates the seal member 22*a*1, resulting the connection between the supplementary ink tank 22 and the refill conduit 21*f*. By the way, the seal member 22*a*1 is made of an elastic material such as rubber or silicon with excellent adhesion properties, so that a hole opened by the penetration of the refill conduit 21*f* can be closed by the adhesion properties of the seal member 22*a*1. Therefore, the seal member 22*a*1 is brought into intimate contact with the peripheral surface of the refill conduit 22*f*, so that ink cannot be leaked from the ink bag 22*a* to the outside through the hole.

The direction of penetrating the ink bag 22*a* by the refill conduit 21*a*1 is not from the top or bottom side but from the folding portion's side because of being advantageous for extending the refill conduit 21*f* inward at a sufficient distance from an outer surface of the point. That advantage is explained as follows. As shown in FIG. 59, the refill conduit 21*f* is placed as close as to the refill ink tank 22 and then forced into the folding portion of the ink bag 22*a*. If the refill conduit 21*f* is further forced into the ink bag 22*a*, there is no likelihood of penetrating through the opposite side because the ink bag 22*a* has a sufficient longitudinal length (i.e., the left-right length thereof in FIG. 59) which is larger than its height (i.e., the up-down length thereof). Accordingly, it is advantageous to insert the refill conduit 21*f* into the folding portion of the ink bag 22*a*.

By the way, the configuration of the tank case and the configuration of the ink bag are not limited to those disclosed in the above embodiment. They may be marked in any configurations that insure the connection between the refill conduit 21*f* and the ink bag 22*a* to form an ink-flow path between them.

According to the present embodiment, as described above, the ink bag 22*a* can be simply configured by sticking the seal member 22*a*1 made of an elastic material with high adhesion properties on the ink bag 22*a* and inserting the needle-like tip of the refill conduit through the seal member 22*a*1 for sucking ink. Therefore, such a configuration of the ink bag 22*a* brings down the cost of manufacturing.

Twenty-first Preferred Embodiment

In the twentieth preferred embodiment, the gas-permeable member 48 is used as a component for stopping the supply of ink. However, it is configured that a level sensor or other means may be used for stopping the supply of ink.

In the twentieth preferred embodiment, the refill conduit 21*f* is inserted into the seal member 22*a*1 made of the elastic material on a part of the ink bag 22*a*. However, it is configured that the whole of the ink bag 22*a* may be made of an elastic material.

In the twentieth preferred embodiment, the ink bag 22*a* is placed in the tank case 22*b*. However, it is configured that the ink bag 22*a* may be directly installed in the printing apparatus.

In addition, it is configured that the ink bag 22*b* may be used as a waste ink tank. Furthermore, it is configured that an elastic adhesive agent such as a hardening adhesive rubber is filled into the tank case 22*b* through the needle-inserting hole 22*e*, followed by boding the folding portion of the ink bag 22*a* on the inside of the tank case 22*b*. In this case, the refill conduit 21*f* can be inserted into the ink bag 22*a*, more effectively.

OTHER EMBODIMENTS

The gas-permeable member may be of having the function of separating gas and liquid, so that various kinds of materials may be used in accordance with the types of ink or usage patterns. The gas-permeable member may be an gas-permeable film made of a tetrafluoride ethylene resin or other porous resin materials. However, it is also possible to use another porous material made of a natural or synthesis material such as knitted fabric, woven fabric, non-woven fabric, net, felt, porcelain, unglazed pottery, earthenware, or ceramic. Furthermore, the gas-permeable member may be a mechanical valve that is closed when gas comes and opened when the flow of liquid comes.

The ink tank of the present invention is not limited to the one that moves together with the printing head in the serial-scan type printing apparatus. It is also possible to fix the ink tank in place. In addition, the ink tank may be always connected to the supplementary ink tank (sub ink tank) through the tube.

The ink-jet cartridge of the present invention may be configured to joint the ink tank and the printing head in an integral or removable manner.

The present invention may be also configured that the main tank for supplying ink to the ink tank is always connected to the ink tank through the tube. In this case, furthermore, the ink tank is not limited to the one that moves together with the printing head. It is also possible to fix the ink tank in place.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink tank comprising:

a body forming a structure of the ink tank;

a suction port for introducing a negative pressure into the ink tank;

an inlet capable of introducing ink into the ink tank by the negative pressure introduced into the ink tank;

an ink absorber which is provided in the body and which is capable of retaining ink by absorption;

gas-liquid separating means which is provided at the suction port and which permits gas to pass but inhibits ink from passing; and a space provided between the gas-liquid separating means and the ink absorber, wherein the gas-liquid separating means and/or an inner wall surface of the body which defines/define the space are/is subjected to a water-repellent treatment.

2. An ink tank as claimed in claim 1, wherein the gas-liquid separating means is a gas-permeable membrane made of a material selected from a tetrafluoride ethylene resin and other porous resin materials.

3. An ink tank as claimed in claim 1, wherein the gas-liquid separating means is a gas-permeable membrane made of a material selected from porcelain, unglazed pottery, ceramic, and other porous materials.

4. An ink tank as claimed in claim 1 , wherein the gas-liquid separating means is placed on an inner wall surface that defines the space.

5. An ink tank as claimed in claim 1, further comprising:

a supply port for supplying ink stored in the ink tank to the outside.

6. An ink tank as claimed in claim 5, wherein the ink introduced through the inlet is absorbed in the ink absorber and the ink being absorbed reaches the supply port before reaching the gas-liquid separating means.

7. An ink tank as claimed in claim 6, wherein a distance between the inlet and the supply port is shorter than a distance between the inlet and the gas-liquid separating means.

8. An ink tank as claimed in claim 5, wherein the supply port is connectable to an ink-jet printing head which is able to eject ink.

9. An ink tank as claimed in claim 1, wherein a plurality of the ink tanks are combined together as an ink tank assembly.

10. An ink tank as claimed in claim 9, wherein respective suction ports of each of the plurality of the ink tanks communicate with a common suction port that is common to the plurality of ink tanks.

11. An ink tank as claimed in claim 10, wherein the respective gas-liquid separating means of each of the plurality of the ink tanks vary in a degree of negative pressure to be introduced into each of the plurality of ink tanks, by the ink tank.

12. An ink tank as claimed in claim 11, wherein the respective gas-liquid separating means of each of the plurality of the ink tanks are porous bodies having a different pore diameter.

13. An ink tank as claimed in claim 10, further comprising:

a joint portion which is provided at the common suction port and which is connectable to a suction passage.

14. An ink tank as claimed in claim 9, wherein respective gas-liquid separating means of each of the plurality of the ink tanks have different properties.

15. An ink tank as claimed in claim 9, wherein the plurality of the ink tanks include at least two different types of ink.

16. An ink tank as claimed in claim 15, wherein the gas-liquid separating means of each of the plurality of ink tanks have air permeability for adjusting the negative pressure to be introduced into the ink tank through the suction port according to a flow resistance of ink to be stored.

17. An ink-jet cartridge comprising:

an ink tank as claimed in claim 1; and an ink-jet printing head which is able to eject ink introduced from the ink tank.

18. An inkjet cartridge as claimed claim 17, wherein the ink-jet printing head is provided with electrothermal-converting elements that generate thermal energies as energies for ejecting ink.

19. An ink-jet printing apparatus, comprising:

a mounting portion on which is mounted an ink-jet cartridge as claimed in claim 17; and transfer means for relatively moving the ink-jet cartridge and a printing medium.

20. An ink-supplying device for supplying ink to an ink tank as claimed in claim 1 or an ink tank of an ink-jet cartridge as claimed in claim 17, comprising:

ink-supplying means for supplying ink stored in a main ink tank into the ink tank through the inlet; and negative-pressure loading means for loading negative pressure caused by a suction pump into the ink tank through the suction port.

21. An ink-supplying device as claimed in claim 20, further comprising:

a joint portion for releasably connecting between the ink-supplying means and the inlet of the ink tank; and a joint member for releasably connecting between the ink-supplying means and the suction port of the ink tank.

22. An ink-supplying device for supplying ink to an ink tank as claimed in claim 15 or an ink tank of an ink-jet cartridge as claimed in claim 17, comprising:

ink-supplying means for supplying ink stored in a main ink tank into the ink tank through the inlet;

negative-pressure loading means for loading negative pressure caused by a suction pump into the ink tank through the suction port; and capping means capable of capping an ink eject port of the ink-jet printing head by a cap member.

23. An ink-supplying device as claimed in claim 22, wherein the cap member is able to close the ink eject port when the ink tank is supplied ink.

24. An ink-supplying device as claimed in claim 22, further comprising:

negative-pressure loading means for a recovery process which loads negative pressure caused by a suction pump into the cap member so that ink is discharged from the ink eject port by suction.

25. An ink-supplying device as claimed in claim 24, wherein the suction pump of the negative-pressure loading means also functions as the suction pump of the negative-pressure loading means for the recovery process.

26. An ink-jet printing apparatus, comprising:

a mounting portion on which an ink tank as claimed in claim 1 and an ink-jet printing head are mountable, where the ink-jet printing head is able to eject ink supplied from the ink tank; and transfer means which performs relative movements of the ink-jet printing head and a printing medium.

27. An ink-jet printing apparatus as claimed in claim 26, wherein the ink-jet printing head is provided with electrothermal-converting elements that generate thermal energies as energies for ejecting ink.

28. An ink-jet printing apparatus as claimed in claim 26, further comprising:

an ink-supplying device comprising:

ink-supplying means for supplying ink stored in a main ink tank into the ink tank through the inlet; and negative-pressure loading means for loading negative pressure caused by a suction pump into the ink tank through the suction port.

29. An ink-jet printing apparatus as claimed in claim 28, further comprising:

means for forming ink meniscus on the ink eject port by a recovery process which discharges ink from the ink eject port of the ink-jet printing head under suction before supplying of ink to the ink tank.

30. An ink-jet printing apparatus as claimed in claim 28, wherein ink in the ink tank is moved away from the gas-liquid separating means by a recovery process which discharges ink from the ink eject port of the ink-jet printing head under suction after supplying ink to the ink tank.

31. An ink-jet printing apparatus as claimed in claim 28, wherein ink in the ink tank is moved away from the gas-liquid separating means by ejecting ink which is not responsible for an image formation from the ink eject port of the ink-jet printing head after the supply of ink to the ink tank.

32. An ink-jet printing apparatus as claimed in claim 28, further comprising:

negative-pressure controlling means for applying negative pressure from the outside to the ink eject port of the ink-jet printing head in addition to introducing negative pressure into the ink tank through the suction port at the time of supplying ink to the ink tank.

33. An ink-jet printing apparatus as claimed in claim 32, wherein the negative pressure to be applied on the ink eject port of the printing head is not enough to suck ink from the ink eject port.

34. An ink-jet printing apparatus as claimed in claim 32, wherein the negative pressure to be applied on the ink eject port of the printing head, when the ink touches the gas-liquid separating means, is not enough to suck ink from the ink eject port.

35. An ink-jet printing apparatus as claimed in claim 32, wherein the negative pressure to be applied on the ink eject port of the printing head, when the ink touches the gas-liquid separating means, is able to suck ink from the ink eject port.

36. An ink-jet printing apparatus as claimed in claim 26, further comprising:

an ink-supplying device comprising:

ink-supplying means for supplying ink stored in a main ink tank into the ink tank through the inlet;

negative-pressure loading means for loading negative pressure caused by a suction pump into the ink tank through the suction port; and capping means capable of capping an ink eject port of the ink-jet printing head by a cap member.

37. An ink-jet printing apparatus as claimed in claim 36, further comprising:

means for forming ink meniscus on the ink eject port by a recovery process which discharges ink from the ink eject port of the ink-jet printing head under suction before supplying of ink to the ink tank.

38. An ink-jet printing apparatus as claimed in claim 36, wherein ink in the ink tank is moved away from the gas-liquid separating means by a recovery process which discharges ink from the ink eject port of the ink-jet printing head under suction after supplying ink to the ink tank.

39. An ink-jet printing apparatus as claimed in claim 36, wherein ink in the ink tank is moved away from the gas-liquid separating means by ejecting ink which is not responsible for an image formation from the ink eject port of the ink-jet printing head after the supply of ink to the ink tank.

40. An ink-jet printing apparatus as claimed in claim 36, further comprising:

negative-pressure controlling means for applying negative pressure from the outside to the ink eject port of the ink-jet printing head in addition to introducing negative pressure into the ink tank through the suction port at the time of supplying ink to the ink tank.

41. An ink-jet printing apparatus as claimed in claim 40, wherein the negative pressure to be applied on the ink eject port of the printing head is not enough to suck ink from the ink eject port.

42. An ink-jet printing apparatus as claimed in claim 40, wherein the negative pressure to be applied on the ink eject port of the printing head, when the ink touches the gas-liquid separating means, is not enough to suck ink from the ink eject port.

43. An ink-jet printing apparatus as claimed in claim 40, wherein the negative pressure to be applied on the ink eject port of the printing head, when the ink touches the gas-liquid separating means, is able to suck ink from the ink eject port.

44. A method for supplying ink to an ink tank as claimed in claim 1 or to an ink tank of an ink cartridge as claimed in claim 17, comprising the steps of:

supplying ink into the ink tank from the inlet by loading negative pressure into the ink tank from the suction port through the gas-liquid separating means; and stopping the loading of negative pressure into the ink tank from the suction port.

45. A method for supplying ink as claimed in claim 44, wherein with respect to a plurality of ink tanks, loading negative pressure into the ink tank from the suction port through the gas-liquid separating means, so that the supply of ink is concurrently performed on the plurality of the ink tanks.

46. An ink-jet printing apparatus, comprising:

a mounting portion on which an ink tank as claimed in claim 1 and an ink-jet printing head are mountable, where the ink-jet printing is able to eject ink supplied from the ink tank;

transfer means which performs relative movements of the ink-jet printing head and a printing medium; and means for forming ink meniscus on the ink eject port by a recovery process which discharges ink from the ink eject port of the ink-jet printing head under suction before supplying of ink to the ink tank.

47. An ink tank as claimed in claim 1, wherein the gas-liquid separating means is provided with a member made of a porous material with an oil repellent finish.

48. An ink tank as claimed in claim 47, wherein the gas-liquid separating means is a gas-permeable membrane made of a material selected from a tetrafluoride ethylene resin, a polyolefin resin, and other porous resin materials, which is subjected to an oil-repellent finish.

49. An ink tank as claimed in claim 47, wherein the gas-liquid separating means is a gas-permeable membrane made of a material selected from porcelain, unglazed pottery, ceramic, and other porous materials, which is subjected to an oil-repellent finish.

* * * * *

UNITED STATES PATENT AND TRADEMARK OFFICE

CERTIFICATE OF CORRECTION

PATENT NO. : 6,540,321 B1
DATED : April 1, 2003
INVENTOR(S) : Hirano et al.

It is certified that error appears in the above-identified patent and that said Letters Patent is hereby corrected as shown below:

Column 2,
Line 66, “connected” should read -- connected to --.

Column 3,
Line 25, “have” should read -- has --.

Column 4,
Line 28, “consistently” should read -- consistent --.

Column 6,
Lines 60 and 62, “inkjet” should read -- ink-jet --.

Column 8,
Line 40, “FIG. 9:” should read -- FIG. 9; --.

Column 9,
Line 16, “invention:” should read -- invention; --;
Line 47, “FIG. 37B” should read -- 37B --;
Line 59, “FIG. 40” should read -- FIG. 40; --; and
Line 67, “tion:” should read -- tion; --.

Column 10,
Line 8, “tion:” should read -- tion; --.

Column 11,
Line 54, begin a new paragraph after “19.”; and
Line 65, “2M,” should read -- 20M, --.

Column 13,
Line 9, “bug” should read -- bung --; and
Line 27, “pass” should read -- passes --.

Column 14,
Line 40, “teeth” should read -- tooth --.

Column 15,
Line 49, “light” should read -- right --.

UNITED STATES PATENT AND TRADEMARK OFFICE

CERTIFICATE OF CORRECTION

PATENT NO. : 6,540,321 B1
DATED : April 1, 2003
INVENTOR(S) : Hirano et al.

It is certified that error appears in the above-identified patent and that said Letters Patent is hereby corrected as shown below:

Column 16,
Line 16, “than” should read -- than the --;
Line 18, “automatically” should read -- automatic --; and
Line 21, “color faint,” should read -- faint color, --.

Column 17,
Line 37, “treaching” should read -- reaching --; and
Line 62, “gas-permeable. member” should read -- gas-permeable member --.

Column 19,
Line 3, “form” should read -- from --; and
Line 26, “formed” should read -- formed on --.

Column 20,
Lines 29 and 35, “varyingly” should read -- varied --; and
Line 62, “nozzle 44. in” should read -- nozzle 44 in --.

Column 21,
Line 15, “of” should be deleted;
Line 27, “detect” should read -- detects --;
Line 55, “form” should read -- from --; and
Line 64, “be also” should read -- also be --.

Column 22,
Line 60, “inktank” should read -- ink tank --; and
Line 65, “be also” should read -- also be --.

Column 26,
Line 25, “which s” should read -- which is --.

Column 27,
Line 12, “f or” should read -- for --;
Line 40, “of” should read -- of the --; and
Line 51, “detect” should read -- detects --.

Column 28,
Line 14, “currently” should read -- currently in --;
Line 56, “lowered” should read -- lower --; and
Line 63, “to” (second occurrence) should read -- the --.

UNITED STATES PATENT AND TRADEMARK OFFICE

CERTIFICATE OF CORRECTION

PATENT NO. : 6,540,321 B1
DATED : April 1, 2003
INVENTOR(S) : Hirano et al.

It is certified that error appears in the above-identified patent and that said Letters Patent is hereby corrected as shown below:

Column 29,
Line 3, “of” should read -- as --;
Line 12, “be also” should read -- also be --; and
Line 19, “of” should read -- as --.

Column 30,
Line 12, “be always” should read -- always be --.

Column 31,
Line 5, “These” should read -- This --; and
Line 61, “501M,” (second occurrence) should read -- 501Y, --.

Column 33,
Line 31, “shown” should read -- shown in --;
Line 46, “view” should read -- views --; and
Line 48, “the some” should read -- some --.

Column 34,
Line 33, “in” should read -- in the --.

Column 35,
Line 6, “be” should read -- also --;
Line 7, “also” should read -- be --;
Line 27, “i.e.,” should read -- (i.e., --; and
Line 31, “the-ink” should read -- the ink --.

Column 36,
Line 42, “prevents” should read -- prevent --; and
Line 58, “be also” should read -- also be --.

Column 37,
Line 13, “configures” should read -- configured --;
Line 61, “fist” should read -- first --; and
Line 66, “able to” should read -- able to be --.

Column 38,
Line 23, “together” should read -- together with --;
Line 46, “need-like” should read -- needle-like --; and
Line 56, “resulting” should read -- resulting in --.

UNITED STATES PATENT AND TRADEMARK OFFICE

CERTIFICATE OF CORRECTION

PATENT NO. : 6,540,321 B1
DATED : April 1, 2003
INVENTOR(S) : Hirano et al.

It is certified that error appears in the above-identified patent and that said Letters Patent is hereby corrected as shown below:

Column 39,
Line 5, “close as” should read -- close --.

Column 40,
Line 1, “be always” should read -- always be --;
Line 5, “joint” should read -- join --;
Line 7, “be also” should read -- also be --; and
Line 47, “1 , wherein” should read -- 1, wherein --.

Column 41,
Line 33, “inkjet” should read -- ink-jet --; and “claimed” should read -- claimed in --.

Column 42,
Line 18, “where” should read -- wherein --.

Column 44,
Line 27, “where” should read -- wherein --.

Signed and Sealed this

Second Day of December, 2003

JAMES E. ROGAN
*Director of the United States Patent and Trademark Office*